US006814625B2

(12) United States Patent
Richmond et al.

(10) Patent No.: US 6,814,625 B2
(45) Date of Patent: Nov. 9, 2004

(54) ELECTRICAL CONNECTOR

(75) Inventors: Mark A. Richmond, Batavia, IL (US); Christopher FitzSimons, Bartlett, IL (US)

(73) Assignee: Cinch Connectors, Inc., Lombard, IL (US)

( * ) Notice: Subject to any disclaimer, the term of this patent is extended or adjusted under 35 U.S.C. 154(b) by 515 days.

(21) Appl. No.: 09/829,665

(22) Filed: Apr. 10, 2001

(65) Prior Publication Data

US 2002/0146931 A1 Oct. 10, 2002

(51) Int. Cl.[7] ..... H01R 13/64

(52) U.S. Cl. ..... 439/681; 439/157; 439/491; 439/903; 439/939

(58) Field of Search ..... 439/680, 681, 439/157, 610, 347, 573, 472, 532, 939, 491, 903

(56) References Cited

U.S. PATENT DOCUMENTS

| | | | | | |
|---|---|---|---|---|---|
| 2,238,696 | A | | 4/1941 | Hanley | |
| 3,243,759 | A | * | 3/1966 | Miller | 439/553 |
| 3,491,330 | A | | 1/1970 | Barnhart et al. | |
| 3,582,867 | A | * | 6/1971 | Thompson et al. | 439/362 |
| 3,611,272 | A | | 10/1971 | Fairbairn et al. | |
| 4,073,563 | A | * | 2/1978 | Bailey et al. | 439/532 |
| 4,229,064 | A | | 10/1980 | Vetter et al. | |
| 4,688,868 | A | * | 8/1987 | Noyes | 439/108 |
| 4,820,204 | A | | 4/1989 | Batty | |
| 4,895,535 | A | | 1/1990 | Emadi et al. | |
| 4,934,960 | A | * | 6/1990 | Capp et al. | 439/620 |
| 4,975,072 | A | * | 12/1990 | Afshar | 439/131 |
| 4,990,099 | A | | 2/1991 | Marin et al. | |
| 5,052,947 | A | * | 10/1991 | Brodie et al. | 439/607 |
| 5,167,542 | A | | 12/1992 | Haitmanek | |
| 5,178,559 | A | * | 1/1993 | Mello | 439/472 |
| 5,254,019 | A | | 10/1993 | Noschese | |
| 5,289,554 | A | | 2/1994 | Cubukciyan et al. | |
| 5,335,301 | A | | 8/1994 | Newman et al. | |
| 5,370,557 | A | | 12/1994 | Olsson | |
| 5,392,194 | A | | 2/1995 | Zell et al. | |
| 5,441,426 | A | | 8/1995 | Boulais | |
| 5,462,455 | A | | 10/1995 | Reichle | |
| 5,584,726 | A | * | 12/1996 | Le Gallic et al. | 439/573 |
| 5,795,175 | A | | 8/1998 | Barr | |

(List continued on next page.)

FOREIGN PATENT DOCUMENTS

| | | |
|---|---|---|
| DE | 2433729 | 2/1976 |
| EP | 1087471 | 3/2001 |
| GB | 961714 | 6/1964 |
| WO | WO 00/62380 A1 | 10/2000 |

OTHER PUBLICATIONS

Two photographs of a 78–position plastic plug, No. 97–40–CD9 FAST–D 02 F–X, AIR LB, available prior to Apr. 10, 2000.

(List continued on next page.)

*Primary Examiner*—Neil Abrams
(74) *Attorney, Agent, or Firm*—Leydig, Voit & Mayer, Ltd.

(57) ABSTRACT

An electrical connector system (200) is disclosed that includes a plurality of modular components. The modular components can include a receptacle housing (210, 503, 1410, 1610, 1810, 1910, 2162, 2610, 3010, 3410), a socket insert (212, 214, 400, 500), a socket electrical contact (410), a grounding spring (216, 218, 1916, 1918).The system includes matching orientation indicia on the polarization keys (220, 270) and housing windows (254) for viewing the indicia. The coupler (290) is slidably mounted on the plug assembly and include cam slots for causing mating and retraction of the plug (204) and receptacle (202) and also includes open position and engaged position indicator strips (2320, 2330, 2340). The system may include grounding springs (216, 218, 1916, 1918) for engaging the mounting panel and may be used with various types of backshells (2800, 2900 3100, 3200, 3300) including shield wire termination types.

7 Claims, 65 Drawing Sheets

U.S. PATENT DOCUMENTS

| | | | | | |
|---|---|---|---|---|---|
| 5,871,373 | A | | 2/1999 | Pacini et al. | |
| 5,876,226 | A | * | 3/1999 | Tsukakoshi et al. | 439/157 |
| 5,938,483 | A | | 8/1999 | Zweigle et al. | |
| 5,964,603 | A | * | 10/1999 | Hanazaki et al. | 439/157 |
| 6,045,375 | A | * | 4/2000 | Aoki et al. | 439/157 |

OTHER PUBLICATIONS

Photograph of a two–cavity receptacle, TRI–STAR, AIRINC, available prior to Apr. 10, 2000.

Photograph of a single cavity, 96–position receptacle, AIRINC, available prior to Apr. 10, 2000.

Photograph of a single cavity, 96–position plug, AIRINC, available prior to Apr. 10, 20000.

ITT Cannon catalog, AIRINC 600 Rack and Panel Connectors, pp. 403–415, 1991.

Boeing Aerospace Corporation Specification BACC65AB, Connector, Electrical, General Purpose, Rectangular, Receptacle Shell, Jan. 28, 1999.

Boeing Aerospace Corporation Specification BACC65AA, Connector, Electrical, General Purpose, Rectangular, Plug Shell, Jan. 29, 1999.

Hypertonics Corporation catalog, pp. L1–L19 and N1–N11, 1993.

Photograph of a contact insertion/extraction tool, Nos. Ms27534–22D (insertion tool) and M8 1969 14–01 (extraction tool), Aiconics, U.S.A., available prior to Apr. 10, 2000.

Photograph of a 40–position contact insert, No. EPX40 SA 96 45, Radiall, available prior to Apr. 10, 2000.

Two photographs of a receptacle with a "B" insert and dust caps mounted thereto, No. EPX 2R 26C (receptacle), Radiall, available prior to Apr. 10, 2000.

Two photographs of a plug with dust caps mounted thereto, No. EPX 2P 29C (plug), Radiall, available prior to Apr. 10, 2000.

Three photographs of a 78–position plastic receptacle, No. 1900 ND02 P1 AIR LB 97–46, AIR LB, available prior to Apr. 10, 2000.

Photograph of a strain relief backshell, No. AIR LB 001901 050 00, AIR LB, available prior to Apr. 10, 2000.

* cited by examiner

FIG. 67
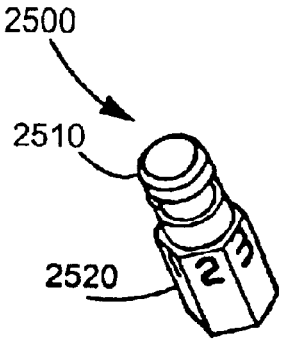
FIG. 70
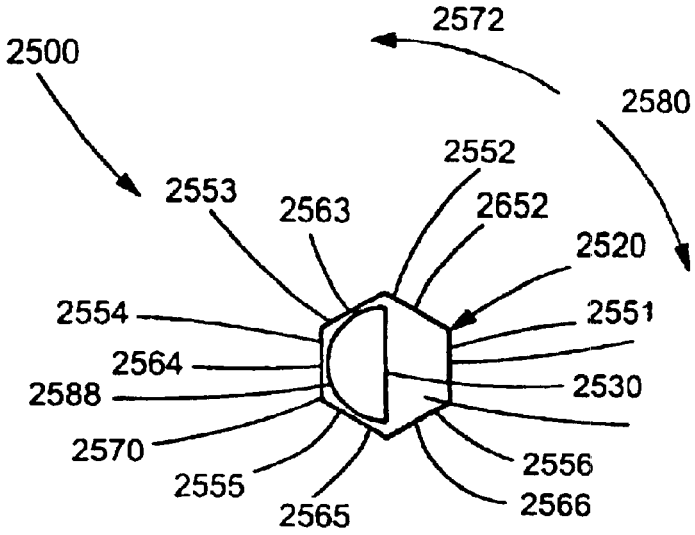
FIG. 68
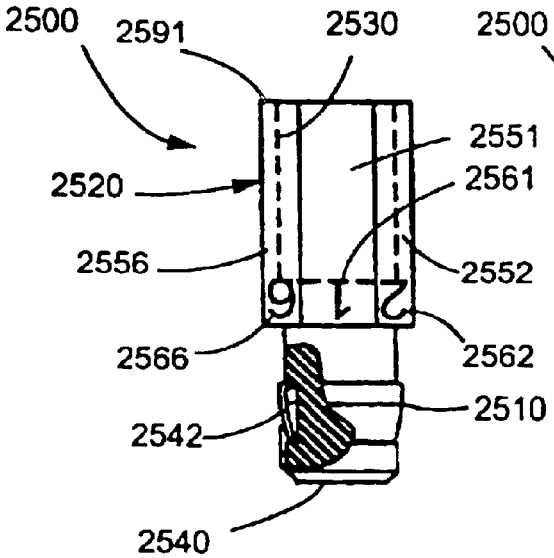
FIG. 69
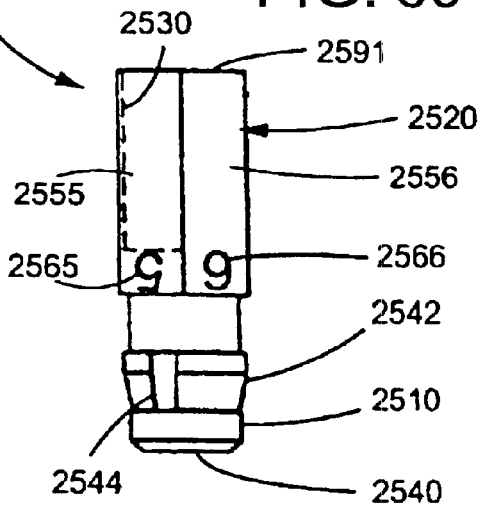
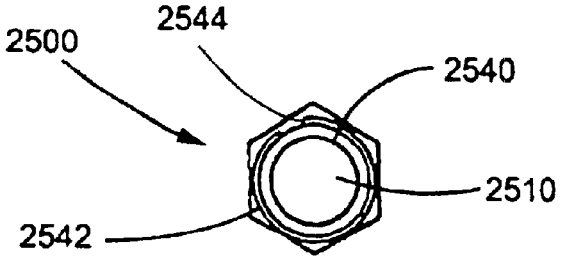
FIG. 71

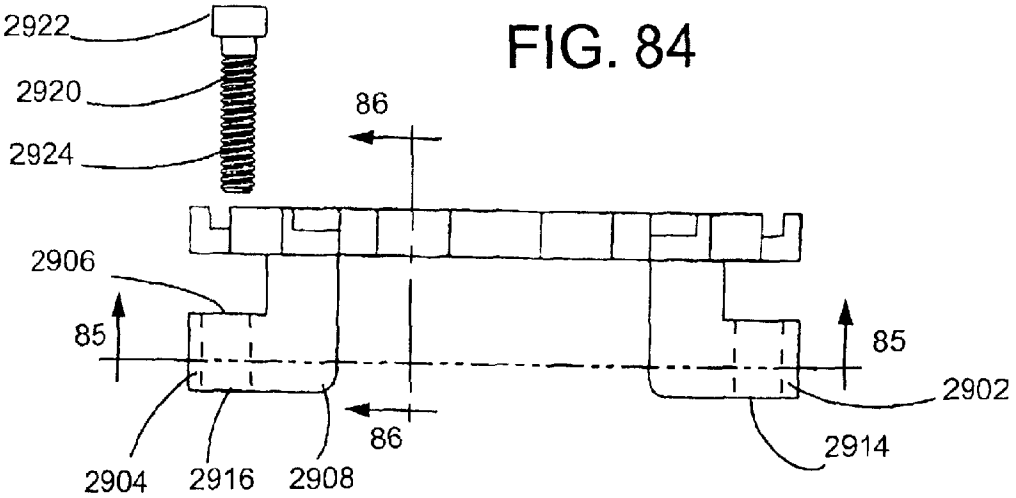
FIG. 84
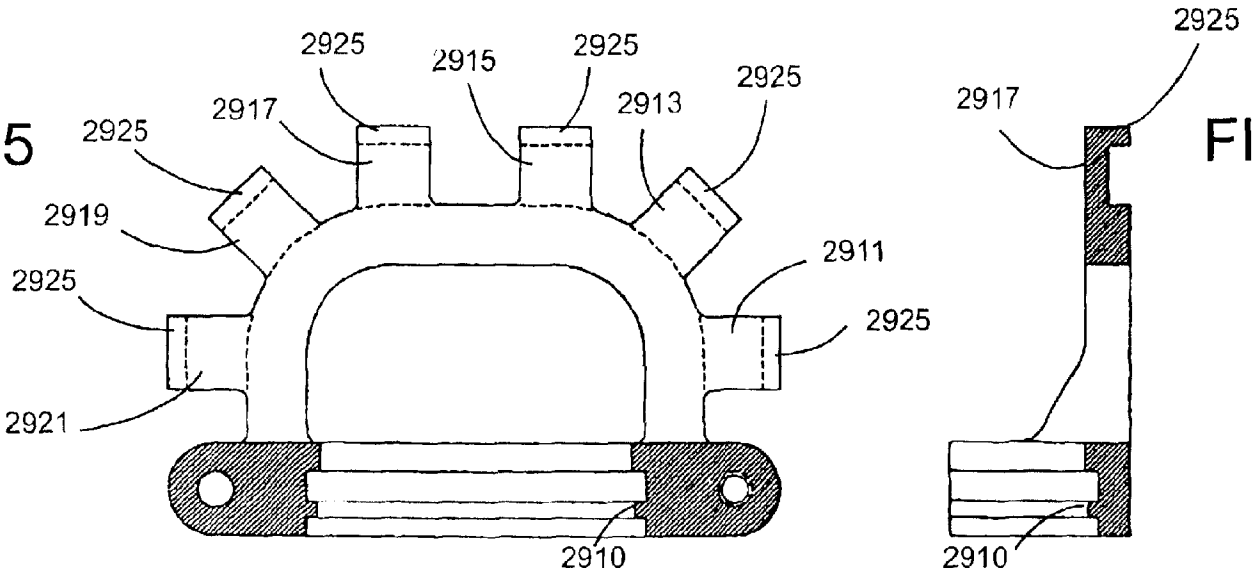
FIG. 86
FIG. 85

FIG. 99
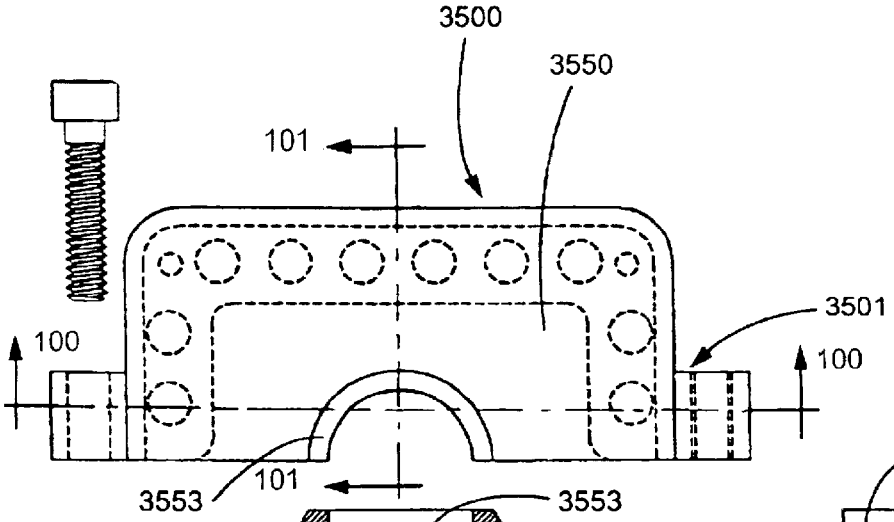
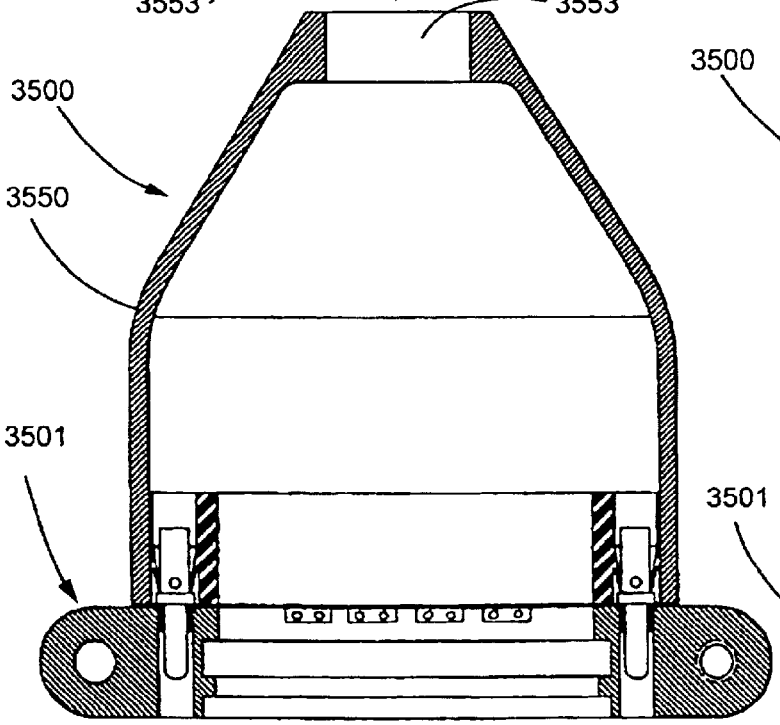
FIG. 100
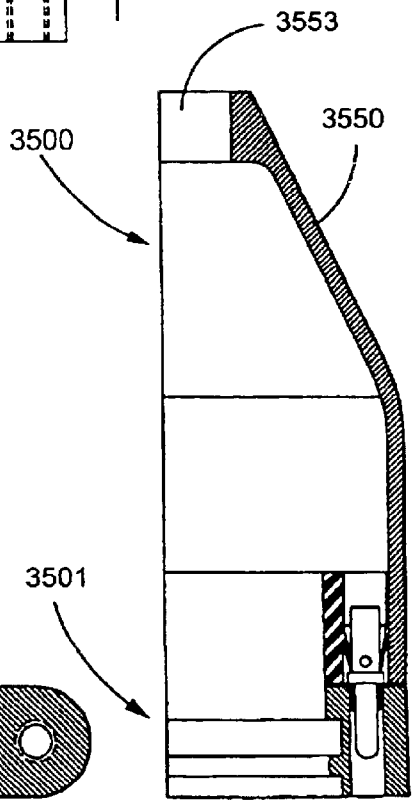
FIG. 101

ELECTRICAL CONNECTOR

FIELD OF THE INVENTION

The present invention relates generally to electrical interconnection and, more particularly, to a modular electrical connector system.

BACKGROUND OF THE INVENTION

The use of a mating plug and a receptacle for electrical interconnection is generally known. Furthermore, the use of a polarization system with electrical connectors is generally known to those skilled in the art.

Often one is confronted with a variety of electrical applications that possess unique, individual requirements. It can be impractical to buy and inventory specifically-configured plugs and mating receptacles suitable for each unique application. Furthermore, it can be difficult and time-consuming to modify existing plugs and receptacles for a different electrical application.

In a conventional polarization system, the manufacturer cannot apply a marking for the component that describes the specific polarization selected by the user because the polarization of the component is variable and determined by the user. Accordingly, the user must either mark the specific polarization selected for the component himself as a secondary step or be forced to leave the polarization selected unidentified on the component.

SUMMARY OF THE INVENTION

The present invention is directed toward an electrical connector system that includes a plurality of modular components which may be used in commercial aviation applications. The modular components can include a receptacle housing, a socket insert, a socket contact, a grounding spring, a male polarizing key, a plug housing, a coupler, a cover, a pin insert, a pin contact, and a female polarizing key. The modular configuration of the components provides an array of unique connectors. By matching each modular component to the performance levels required by a particular user, a plurality of connectors can be assembled to meet a disparate range of requirements. The connector system includes components having different sizes, styles, and options to offer a particular user the flexibility to select desired features to satisfy the user's particular requirements. Examples of the options available include housing size, material, finish, and mounting; contact size and type; grounding; shielding; bussing; and variable polarizing. The connector system can be used in a pressurized environment, for example as seen on a commercial aircraft.

The electrical connector system offers cost savings by providing a simplified yet comprehensive connector system. The modular design of the components of the connector system allows for a very large number of possible unique connector assemblies through iterative combinations of a relatively small number of components. The connector system can realize a cost saving to users based on standardization of components and piece part number reduction.

The modular configuration of each component of the connector system facilitates the assembly of the components into a particular connector assembly and the installation of any particular assembly. For example, any insert can fit into any housing. Any backshell can fit onto any housing. Any housing will accept any contact size and/or type. The modular configuration assists the assembler to rapidly produce an accurate and repeatable assembly. The connector system does not require any special tools for assembly. Each housing can be mounted and mated in a variety of ways.

The connector system facilitates repairs, changes, and/or upgrades occurring in the field. The modular components of the connector system can be easily removed and replaced so that an individual component can be removed from an assembly and replaced with a replacement component with a minimum of hand tools. Service can occur on an assembly even while the assembly is installed, such as in an aircraft. For example, a housing can be changed without rewiring the associated insert. In another example, a backshell can be changed while the rest of the connector assembly is still mounted and/or mated. As another example, additional contacts can be installed in an insert without disturbing existing shield terminations. Polarization keying can be changed, and the change can be identified, without the user re-marking the housing.

The reduction in assembly, installation, and repair time and re-work time because of assembly error contributes to the overall cost savings.

One embodiment of the connector system includes a plurality components. A plurality of contacts can be provided, including a 22 gauge pin contact, a 20 gauge pin contact, a 16 gauge pin contact, a 12 gauge pin contact, an 8 gauge pin contact, a fiber optic male contact, a coaxial male contact, a 22 gauge socket contact, a 20 gauge socket contact, a 16 gauge sock-et contact, a 12 gauge socket contact, an 8 gauge socket contact, a fiber optic female contact, and a coaxial female contact.

A plurality of inserts can be provided, including a 22 gauge pin insert, a 20 gauge pin insert, a 16 gauge pin insert, a 12 gauge pin insert, an 8 gauge pin insert, a fiber optic pin insert, a coaxial pin insert, a 22 gauge bussed pin insert, a 20 gauge bussed pin insert, a 22 gauge socket insert, a 20 gauge socket insert, a 16 gauge socket insert, a 12 gauge socket insert, an 8 gauge socket insert, a fiber optic socket insert, a coaxial socket insert, a 22 gauge bussed socket insert, a 20 gauge bussed socket insert, and a universal blank insert.

A plurality of housings can be provided, including a size 1 plastic plug housing, a size 2 plastic plug housing, a size 1 metal plug housing, a size 2 metal plug housing, a size 1 grounded plug housing, a size 2 grounded plug housing, a size 1 plastic receptacle housing, a size 2 plastic receptacle housing, a size 4 plastic receptacle housing, a size 1 metal receptacle housing, a size 2 metal receptacle housing, a size 4 metal receptacle housing, a size 1 grounded receptacle housing, a size 2 grounded receptacle housing, and a size 4 grounded receptacle housing.

A plurality of backshells can be provided, including a shield backshell, a shield termination backshell, a strain relief backshell, and a clamp backshell.

A pair of polarizing keys can be provided, including a male polarizing key and a female polarizing key.

In one embodiment, the modular components can be configured to provide a receptacle assembly and a mating plug assembly.

The present invention will become more readily apparent upon reading the following detailed description of the exemplified embodiments and upon reference to the accompanying drawings herein.

BRIEF DESCRIPTION OF THE DRAWINGS

FIG. 67 is a perspective view of a female polarizing key;

FIG. 68 is a front elevational view of the female polarizing key in FIG. 67;

FIG. 69 is a side elevational view of the female polarizing key in FIG. 67;

FIG. 70 is a top plan view of the female polarizing key in FIG. 67;

FIG. 71 is a bottom plan view of the female polarizing key in FIG. 67;

FIG. 84 is a top plan view of the backshell in FIG. 83;

FIG. 85 is a cross-sectional view taken along the line 85–85 in FIG. 84;

FIG. 86 is a cross-sectional view taken along the line 86–86 in FIG. 84;

FIG. 99 is a top plan view of another embodiment of a backshell;

FIG. 100 is a cross-sectional view taken along the line 100—100 in FIG. 99;

FIG. 101 is a cross-sectional view taken along the line 101—101 in FIG. 99;

DESCRIPTION OF THE EXEMPLIFIED EMBODIMENTS

In summary, an electrical connector system, constructed according to the teachings of the present invention, includes a family of modular interconnection components which can be used in commercial and general aviation applications. The modular configuration of the components provides an array of unique connectors that can be assembled to meet a disparate range of requirements. The connector system includes components having different sizes, styles and options to offer a particular user the flexibility to select desired features to satisfy the user's particular requirements. In one embodiment, the modular components can be configured to provide a receptacle assembly and a plug assembly.

Figure 1:
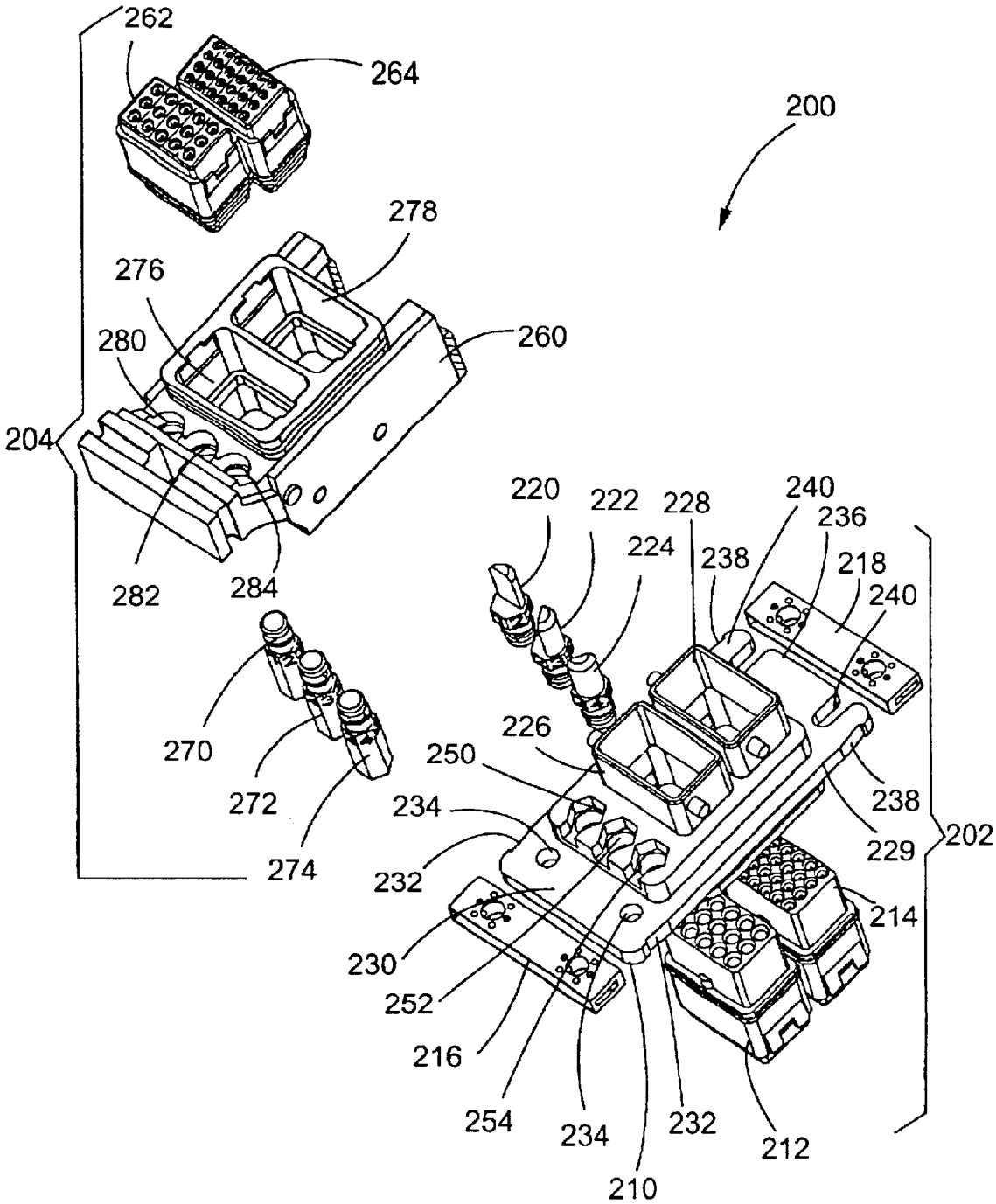
FIG. 1 is an exploded view of an electrical connector system according to the present invention.

Turning to the Figures, FIG. 1 illustrates an embodiment of an electrical connector system 200 including a receptacle assembly 202 and a plug assembly 204. The receptacle assembly 202 includes a grounded-style, "size 2" receptacle housing 210, a first socket insert 212, a second socket insert 214, a first grounding spring 216, a second grounding spring 218, a first male polarizing key 220, a second male polarizing key 222, and a third male polarizing key 224. The receptacle housing 210 includes a first cavity 226 and a second cavity 228. The first socket insert 212 can be mounted to the receptacle housing 210 in either the first cavity 226 or the second cavity 228. The second socket insert 214 can be mounted to the receptacle housing 210 in either the first cavity 226 or the second cavity 228. Each socket insert 212, 214 can house a plurality of electrical contacts. Each insert 212, 214 can be the same size and shape and can be configured such that it is interchangeable in any housing.

The receptacle housing 210 includes a flange 229 having a first end 230 with a pair of notches 232 and a pair of mounting holes 234 and a second end 236 with a pair of notches 238 and a pair of mounting slots 240. The first grounding spring 216 can be mounted to the receptacle housing 210 by engaging the notches 232 at the first end 230. The second grounding spring 218 can be mounted to the receptacle housing by engaging the notches 238 at the second end 236. The grounding springs 216, 218 can be mounted to the receptacle housing 210 at either end 230, 236.

The receptacle housing 210 includes a first polarity cavity 250, a second polarity cavity 252, and a third polarity cavity 254. Each of the male polarizing keys 220, 222, 224 can be mounted to the receptacle housing 210 in any one of the polarity cavities 250, 252, 254 in any of a plurality of orientations.

The plug assembly 204 includes a "size 2 plug" housing assembly 260, a first pin insert 262, a second pin insert, 264, a first female polarizing key 270, a second female polarizing key 272, and a third female polarizing key 274. The plug housing assembly 260 includes a first cavity 276 and a second cavity 278. The first pin insert 262 can be mounted to the plug housing assembly 260 in either the first cavity 276 or the second cavity 278. The second pin insert 264 can be mounted to the plug housing assembly 260 in either the first cavity 276 or the second cavity 278. Each pin insert 262, 264 can house a plurality of electrical contacts. The electrical contacts installed in the pin inserts 262, 264 can be configured to electrically interconnect with the electrical contacts installed in the socket inserts 212, 214. Each pin insert 262, 264 can be the same size and shape and can be configured such that it is interchangeable in any housing.

The plug housing assembly 260 includes a first polarity cavity 280, a second polarity cavity 282, and a third polarity cavity 284. Each of the female polarizing keys 270, 272, 274 can be mounted to the plug housing assembly 260 in any one of the polarity cavities 280, 282, 284 in any of a plurality of orientations.

Figure 2:
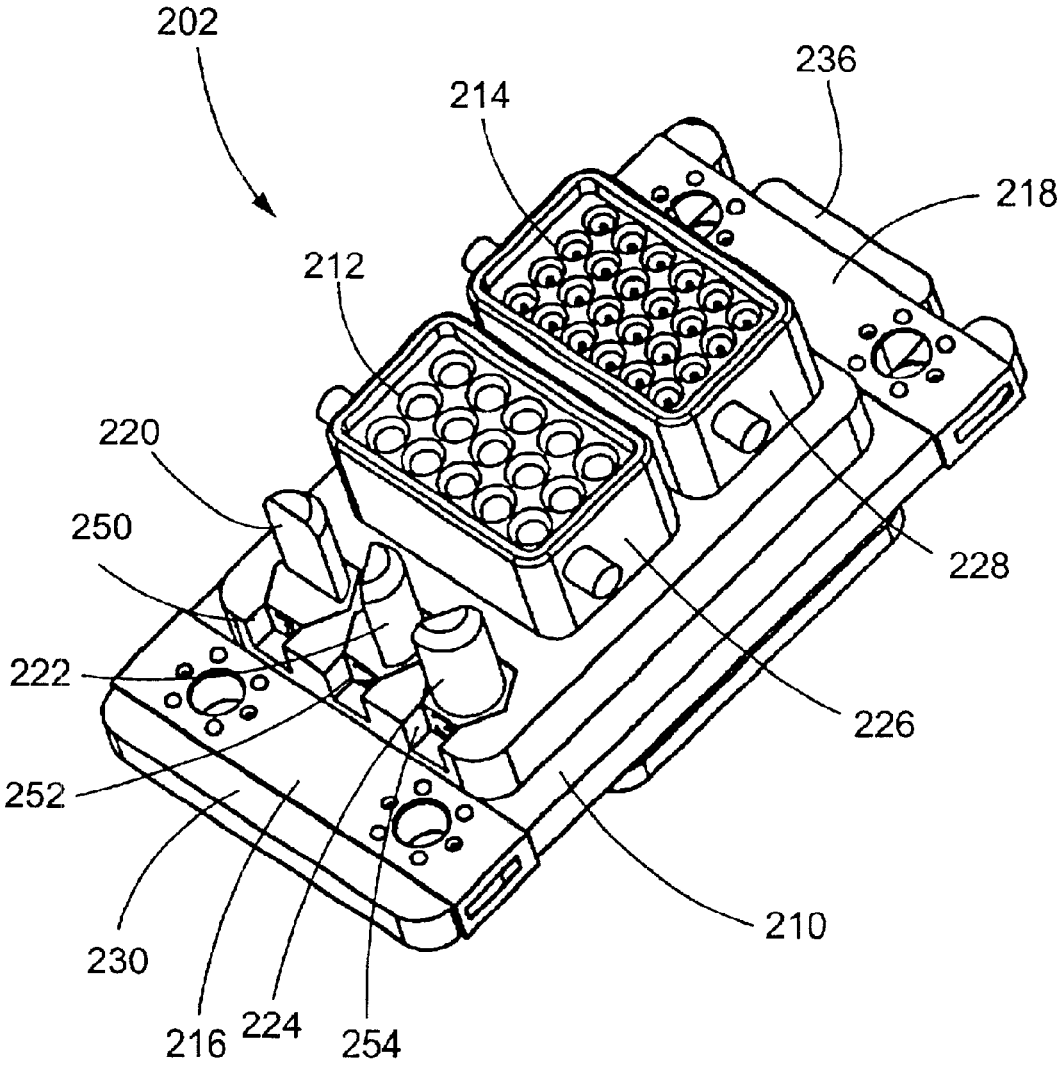
FIG. 2 is a perspective view of an illustrative receptacle assembly.

Referring to FIG. 2, the receptacle assembly 202 is assembled. The first socket insert 212 is mounted to the receptacle housing 210 in the first cavity 226. The second socket insert 214 is mounted to the receptacle housing 210 in the second cavity 228. Each insert 212, 214 can be removed from the housing 210 by using a simple tool. The inserts 212, 214 are sealed with the housing 210. The first grounding spring 216 is mounted to the receptacle housing 210 by engaging the notches at the first end 230. The second grounding spring 218 is mounted to the receptacle housing by engaging the notches at the second end 236. The first male polarizing key 220 is mounted to the receptacle housing 210 in the first polarity cavity 250. The second male polarizing key 222 is mounted to the receptacle housing 210 in the second polarity cavity 252. The third male polarizing key 224 is mounted to the receptacle housing 210 in the third polarity cavity 254.

Figure 3:
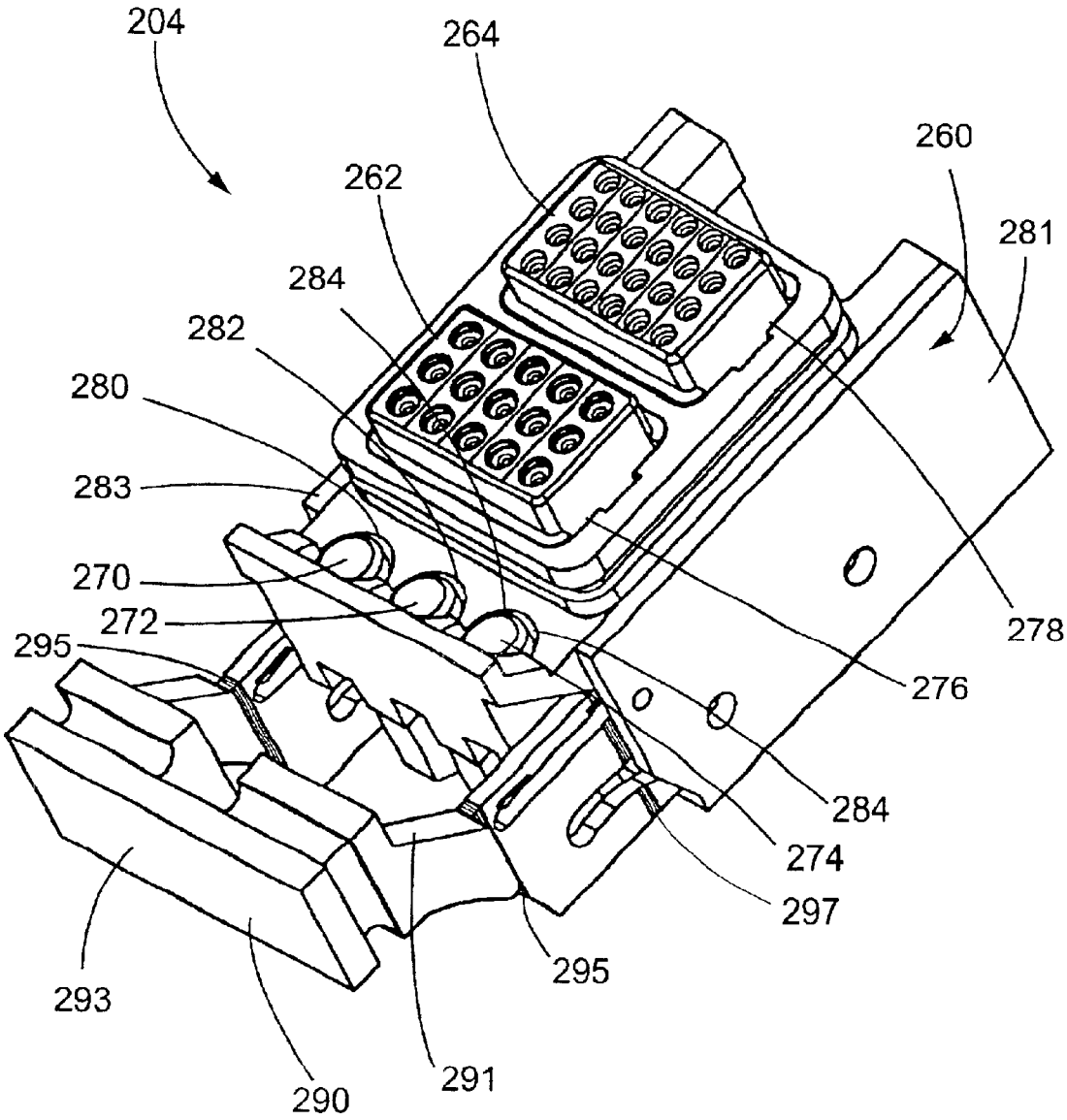
FIG. 3 is a perspective view of an illustrative plug assembly.

Referring to FIG. 3, the plug assembly 204 is assembled. The first pin insert 262 is mounted to the plug housing assembly 260 in the first cavity 276. The second pin insert 264 is mounted to the plug housing assembly 260 in the second cavity 278. Each insert 262, 264 can be removed from the housing assembly 260 by using a simple tool. The inserts 262, 264 are sealed with the housing assembly 260. The first female polarizing key 270 is mounted to the plug housing assembly 260 in the first polarity cavity 280. The second female polarizing key 272 is mounted to the plug housing assembly 260 in the second polarity cavity 282. The third female polarizing key 274 is mounted to the plug housing assembly 260 in the third polarity cavity 284.

The plug housing assembly 260 includes a coupler 290. The coupler 290 is provided to facilitate the interconnection of the plug assembly 204 with a receptacle assembly. The coupler 290 acts as a cam member. The coupler 290 can move between an open position and an engaged position. The coupler 290 is shown in FIG. 3 in an open position. Moving the coupler 290 from the open position to the engaged position interconnects the plug assembly 204 and a receptacle assembly.

Figure 4:
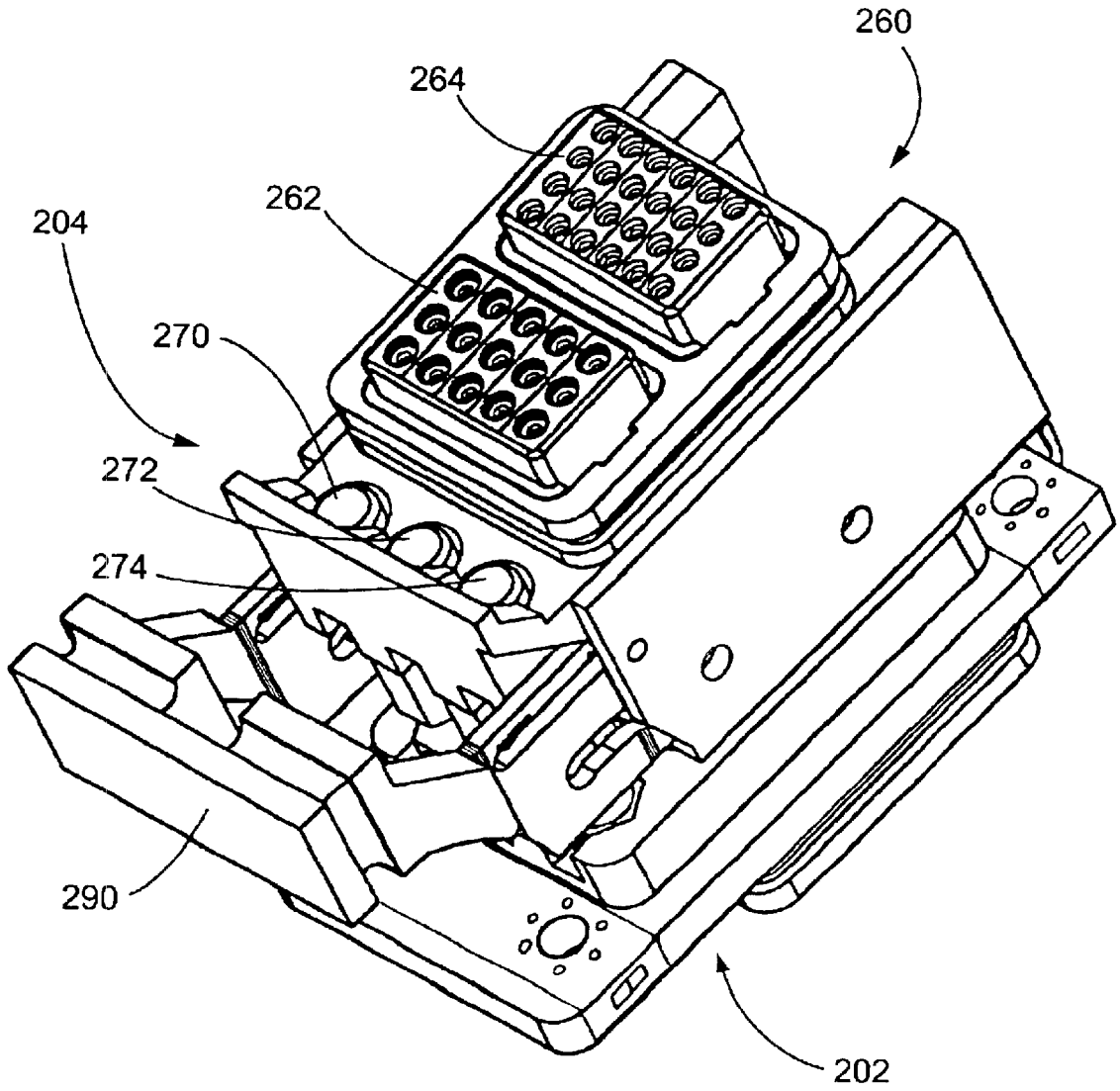
FIG. 4 is a perspective view of the plug assembly in FIG. 3 and the receptacle assembly in FIG. 2 illustrating the plug assembly in a pre-mounted position.

Referring to FIG. 4, the coupler 290 of the plug housing assembly 260 is in an intermediate position. The first and second pin inserts 262, 264 of the plug assembly 204 are aligned, respectively, with the first and second socket inserts of the receptacle assembly 202. The first, second, and third keys 270, 272, 274 of the plug assembly 204 are aligned, respectively, with the first, second, and third keys of the receptacle assembly 202. To interconnect the plug assembly 204 and the receptacle assembly 202, the coupler 290 can be moved to the engaged position.

Figure 5:
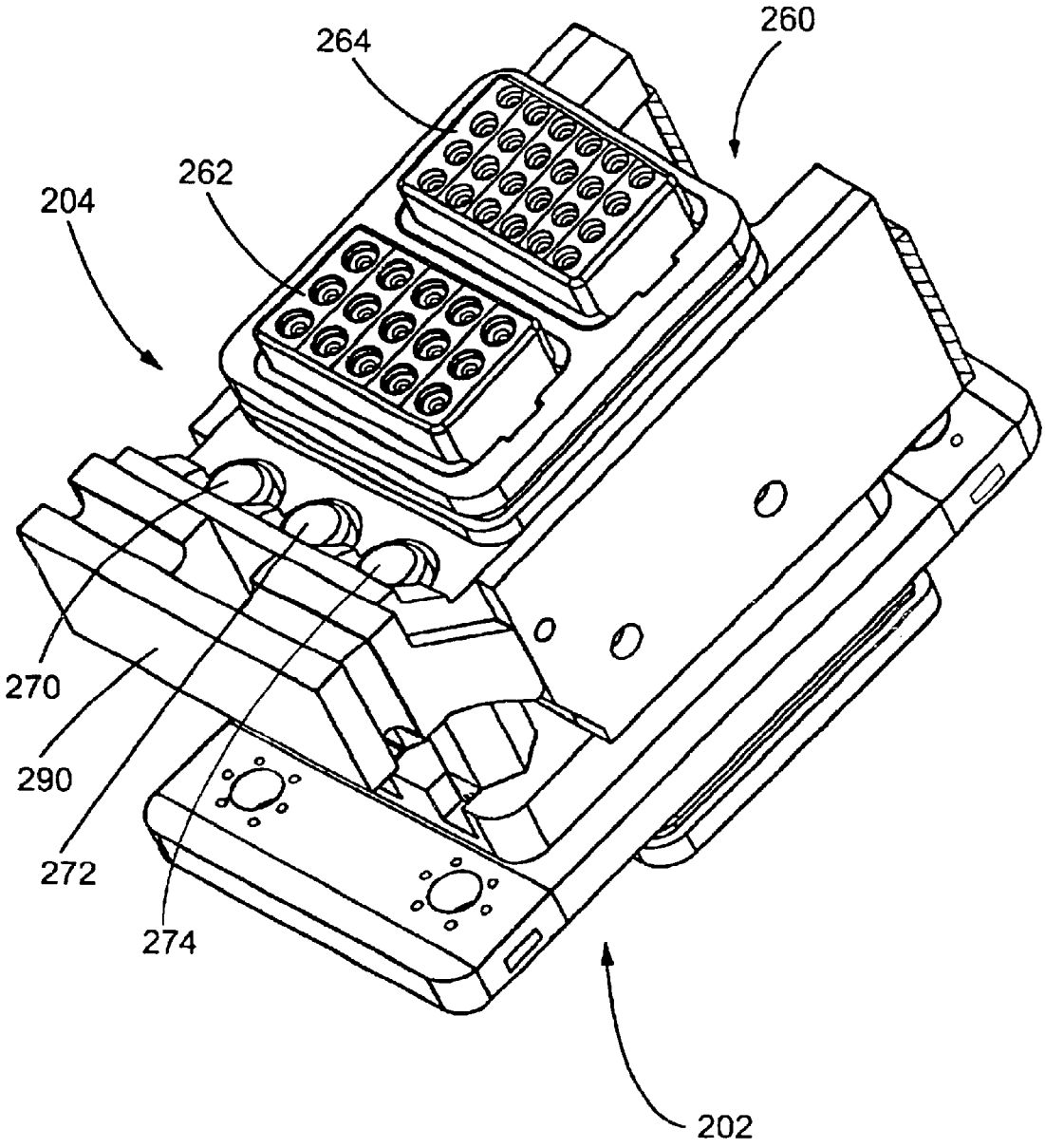
FIG. 5 is a perspective view of the plug assembly in FIG. 3 and the receptacle assembly in FIG. 2 illustrating the plug assembly mounted to the receptacle assembly.

Referring to FIG. 5, the plug assembly 204 is interconnected with the receptacle assembly 202. The coupler 290 of the plug housing assembly 260 is in the engaged position. The plug assembly 204 is fully seated on the receptacle assembly 202. Contacts installed in the first and second pin inserts 262, 264 of the plug assembly 204 are electrically interconnected, respectively, with contacts installed in the first and second socket inserts of the receptacle assembly 202. The first, second, and third keys 270, 272, 274 of the plug assembly 204 are mated, respectively, with the first, second, and third keys of the receptacle assembly 202.

Figure 6:
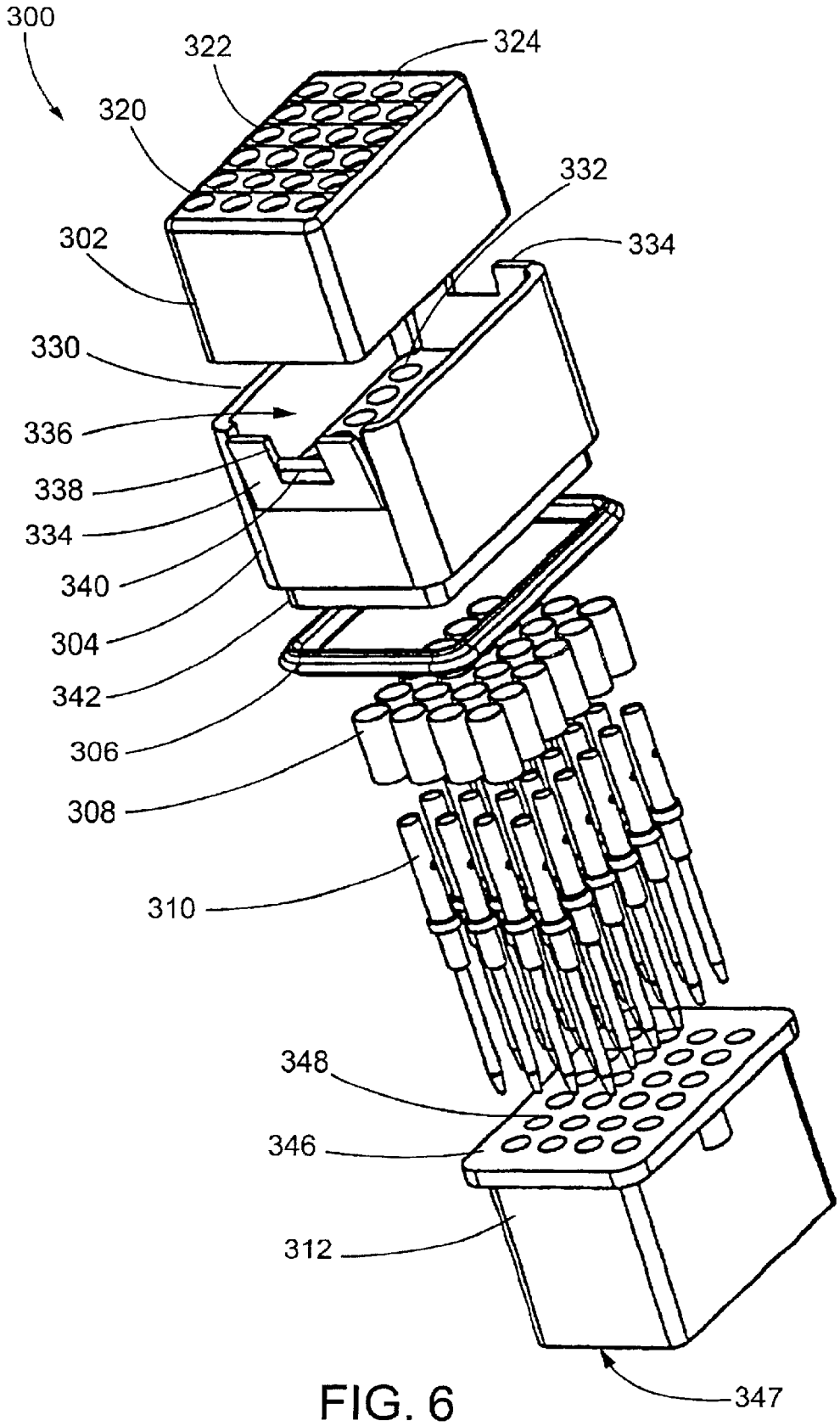
FIG. 6 is an exploded view of a pin insert.

Referring to FIG. 6, an illustrative pin insert 300 is shown. The pin insert 300 includes a grommet 302, a rear portion 304, a peripheral seal 306, a plurality of contact retaining clips 308, a plurality of pin electrical contacts 310, and a front portion 312.

The illustrative grommet 302 provides a seal between the wires connected to the contacts 310 and the environment. The grommet 302 includes twenty-four bores 320. The bores 320 are each sized to sealingly accommodate a 22 gauge pin contact and its associated wire. The bores 320 are arranged in a predetermined pattern or array of six columns 322 by four rows 324. The wire-sealing grommet 302 can be made from fluorosilicone rubber.

The rear portion 304 includes a shroud 330, twenty-four bores 332, and a pair of resiliently-flexible locking tabs 334. The shroud defines a cavity 336. The grommet 302 can be mounted to the rear portion 304 in the cavity 336 by a friction fit between the grommet 302 and the shroud 330 and by adhesive, for example. The bores 332 of the rear portion 304 are each sized to accommodate a 22 gauge pin contact. Each bore 332 of the rear portion 304 is arranged to align with a respective bore 320 of the grommet 302. Each bore 332 of the rear portion 304 can accommodate a respective contact retaining clip 308. The locking tabs 334 can removably retain the pin insert 300 in a plug or a receptacle housing assembly. Each locking tab 334 includes a notch 338 having a chamfered end 340. The locking tabs 334 can be configured to withstand high force, for example 100 pounds of force, and still remain operable. The rear portion 304 includes a rabbet 342 that extends around the entire perimeter of the rear portion 304. The peripheral seal 306 can be mounted to the rear portion 304 in the rabbet 342 and retained by a friction fit.

The peripheral seal 306 provides an environmental seal between the pin insert 300 and a housing assembly in which the pin insert 300 is installed.

The contact retaining clips 308 can be designed for rear-release/rear-removal contacts. The contact retaining clips 308 can be made from stamped beryllium copper.

The contacts 310 are 22 gauge pin electrical contacts. Any suitable contact known in the art, such as M39029/93 contacts or similar Boeing BACC47EF and BACC47EG contacts, can be used in the connector system. The contact can be various sizes, for example, ranging from 22 gauge through 8 gauge as well as co-axial and fiber optic types. Those of skill in the art are very familiar with such suitable contacts. Contact crimping, installation, and removal tools are standard and commonly available. Specific examples of types of suitable contacts in other embodiments include a 22 gauge signal type, a 20 gauge signal/power type, a 16 gauge signal/power type, a 12 gauge power type, an 8 gauge power type, a size 1 coaxial type, and a size 16 fiber optic type.

The front portion 312 includes a rear face 346, a mating face 347, and twenty-four bores 348. The front portion 312 is mounted to the rear portion 304, for example, by adhesive. The front portion 312 is made of reinforced epoxy or any other suitable dielectric material. The rear face 346 of the front portion 312 cooperates with the rabbet 342 of the rear portion 304 to define a groove 349. The groove 349 acts to retain the peripheral seal 306. The bores 348 of the front portion 312 are each sized to accommodate a 22 gauge pin contact from the rear face 346 and a socket contact from the mating face 347. Each bore 348 of the front portion 312 is arranged to align with a respective bore 332 of the rear portion 304.

Figure 8:
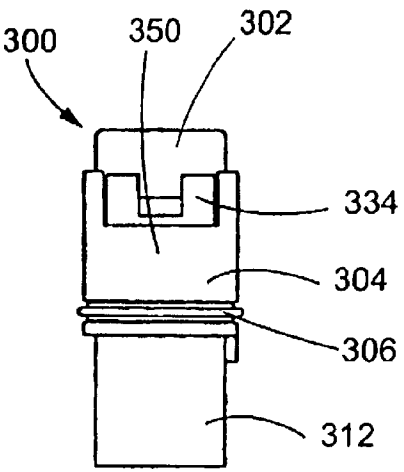
FIG. 8 is an end elevational view of the pin insert in FIG. 6.
Figure 7:
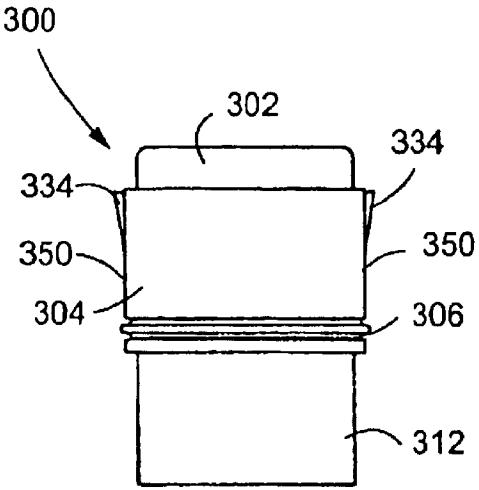
FIG. 7 is a side elevational view of the pin insert in FIG. 6.

Referring to FIGS. 7 and 8, the pin insert 300 is assembled. A portion of the grommet 302 extends above the rear portion 304. The locking tabs 334 project outward from respective end walls 350 of the rear portion 304. The peripheral seal 306 is disposed between the rear portion 304 and the front portion 312.

Figure 9:
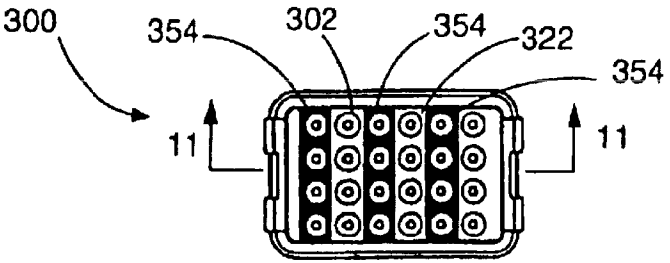
FIG. 9 is a top plan view of the pin insert in FIG. 6.

Referring to FIG. 9, the grommet 302 can include indicia 354, such as color-coding and numbering, to facilitate the user's identifying the different columns 322 of the bores 320. In the illustrative grommet 302, each alternate column 322 of the bores 320 includes the indicium 354. When a user wires the pin insert 300, the user can use the indicia 354 to locate quickly and accurately the proper column 322 by using the indicia 354 as a visual identifier and check.

In other embodiments the grommet can include an indicium, such as color-coding, to identify the contact size and/or type with which the pin insert is compatible. In those embodiments that use color-coding, the color can match the color used by the electrical contact industry to indicate the compatible contact type. The contact insertion and removal tools can also be the same color as the grommet and the contacts.

Figure 10:
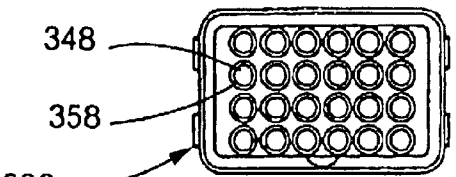
FIG. 10 is a bottom plan view of the pin insert in FIG. 6.

Referring to FIG. 10, each bore 348 of the front portion 312 includes a chamfer 358 to facilitate the insertion of a socket electrical contact into the bore 348.

Figure 11:
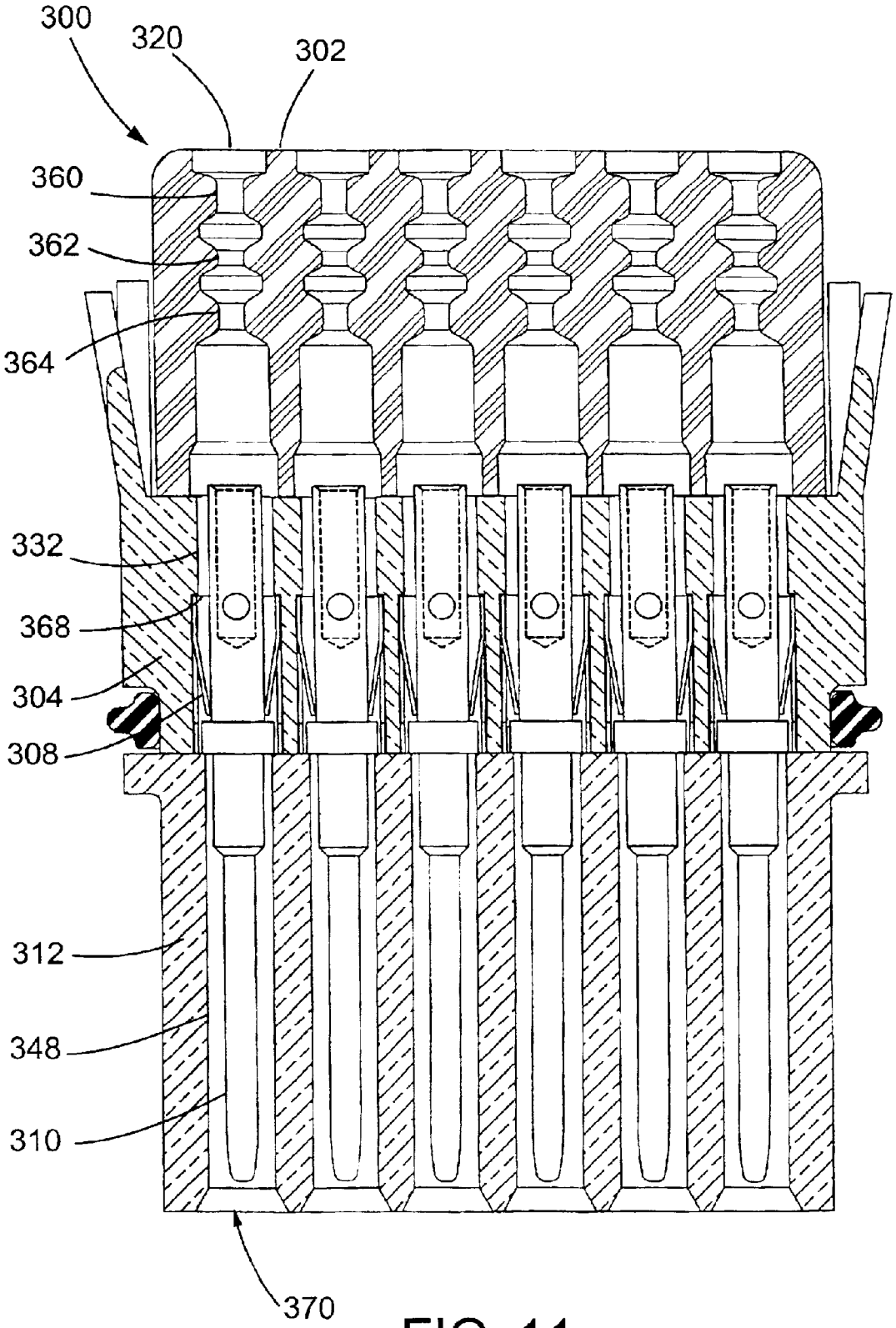
FIG. 11 is a cross-sectional view of the pin insert taken along line 11—11 in FIG. 9.

Referring to FIG. 11, each bore 320 of the grommet 302 can include a three-barrier wire seal. Each bore 320 includes three necked portions 360, 362, 364. The necked portions 360, 362, 364 engage an installed wire to provide three separate seals.

Each bore 332 of the rear portion 304 includes a stop 368 that engages the respective contact retaining clip 308 disposed in each bore 332.

Each bore 320 of the grommet 302 cooperates with a respective bore 332 of the rear portion 304 and a respective bore 348 of the front portion 312 to define a respective contact chamber 370. The pin insert 300 is contact reverse gender. In other words, the pin insert 300 has recessed contacts 310. The contacts 310 do not extend beyond the respective contact chamber 370 within which they are disposed. The reverse gender design protects the contacts 310 of the pin insert 300 from being bent or otherwise damaged and helps to prevent the contacts 300 from penetrating a mismatched socket insert.

Figure 12:
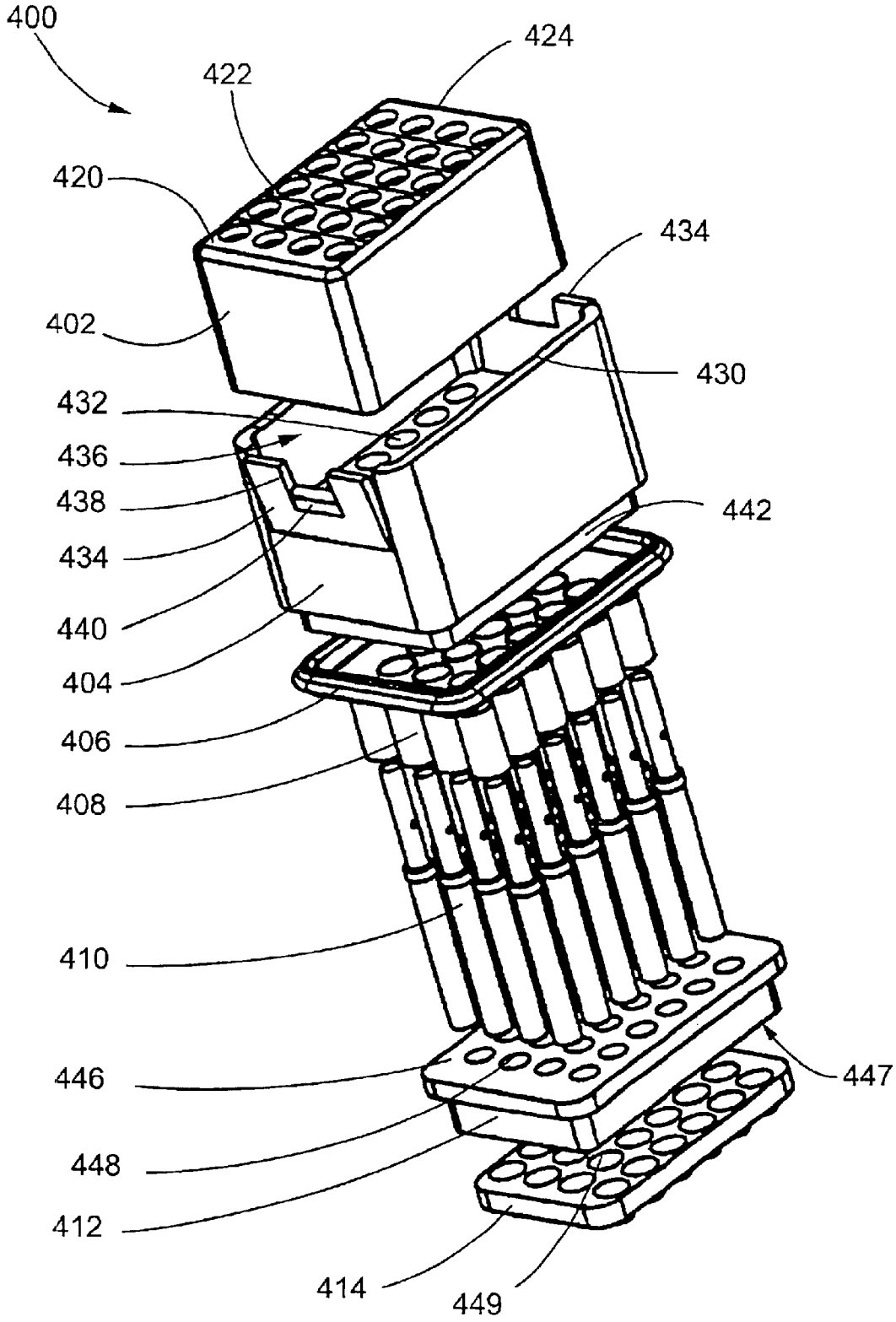
FIG. 12 is an exploded view of a socket insert.

Referring to FIG. 12, an illustrative socket insert 400 is shown. The socket insert 400 includes a grommet 402, a rear portion 404, a peripheral seal 406, a plurality of contact retaining clips 408, a plurality of socket electrical contacts 410, a front portion 412, and an interfacial seal 414.

The illustrative grommet 402 provides a seal between the wires connected to the contacts 410 and the environment. The grommet 402 includes twenty-four bores 420. The bores 420 are each sized to sealingly accommodate a 22 gauge socket contact and its associated wire. The bores 420 are arranged in a predetermined pattern or array of six columns 422 by four rows 424. The wire-sealing grommet 402 can be made from fluorosilicone rubber. The grommet 402 used in the socket insert 400 is similar in construction to a grommet used in a pin insert but with complementary indicia to identify the bores 420 for proper alignment of mating electrical contacts.

The rear portion 404 includes a shroud 430, twenty-four bores 432, and a pair of resiliently-flexible locking tabs 434. The shroud defines a cavity 436. The grommet 402 can be mounted to the rear portion 404 in the cavity 436 by a friction fit between the grommet 402 and the shroud 430 and by adhesive, for example. The bores 432 of the rear portion 404 are each sized to accommodate a 22 gauge socket contact. Each bore 432 of the rear portion 404 is arranged to align with a respective bore 420 of the grommet 402. Each bore 432 of the rear portion 404 can accommodate a respective contact retaining clip 408. The locking tabs 434 can removably retain the socket insert 400 in a receptacle or plug housing. Each locking tab 434 includes a notch 438 having a chamfered end 440. The locking tabs 434 can be configured to withstand high force, for example 100 pounds of force, and still remain operable. The rear portion 404 includes a rabbet 442 that extends around the entire perimeter of the rear portion 404. The peripheral seal 406 can be mounted to the rear portion 404 in the rabbet 442 and retained by a friction fit. The rear portion 404 used in the socket insert 400 is similar in construction to a rear portion used in a pin insert.

The peripheral seal 406 provides an environmental seal between the socket insert 400 and a receptacle housing in which the socket insert 400 is installed.

The contact retaining clips 408 can be designed for rear-release/rear-removal contacts. The contact retaining clips 408 can be made from stamped beryllium copper.

The contacts 410 are 22 gauge socket electrical contacts. Any suitable contact known in the art, such as M39029/93 contacts or similar Boeing BACC47EF and BACC47EG contacts, can be used in the connector system. The contact can be various sizes, for example, ranging from 22 gauge through 8 gauge as well as co-axial and fiber optic types. Those of skill in the art are very familiar with such suitable contacts. Contact crimping, installation, and removal tools are standard and commonly available. Specific examples of types of suitable contacts in other embodiments include a 22 gauge signal type, a 20 gauge signal/power type, a 16 gauge signal/power type, a 12 gauge power type, an 8 gauge power type, a size 1 coaxial type, and a size 16 fiber optic type.

The front portion 412 includes a rear face 446, a front face 447, and twenty-four bores 448. The front portion 412 is mounted to the rear portion 404, for example, by adhesive. The front portion 412 is made of reinforced epoxy or any other suitable dielectric material. The rear face 446 of the front portion 412 cooperates with the rabbet 442 of the rear portion 404 to retain the peripheral seal 406. The bores 448 of the front portion 412 are each sized to accommodate a 22 gauge socket contact. Each bore 448 of the front portion 412 is arranged to align with a respective bore 432 of the rear portion 404.

The interfacial seal 414 provides environmental sealing between the socket insert 400 and a mating pin insert. The interfacial seal 414 is mounted to the front portion 412, for example, by adhesive. The interfacial seal 414 includes twenty-four bores 449. The bores 449 of the interfacial seal 414 are each sized to sealingly accommodate a 22 gauge socket contact. Each bore 449 of the interfacial seal 414 is arranged to align with a respective bore 448 of the front portion 412.

Figure 13:
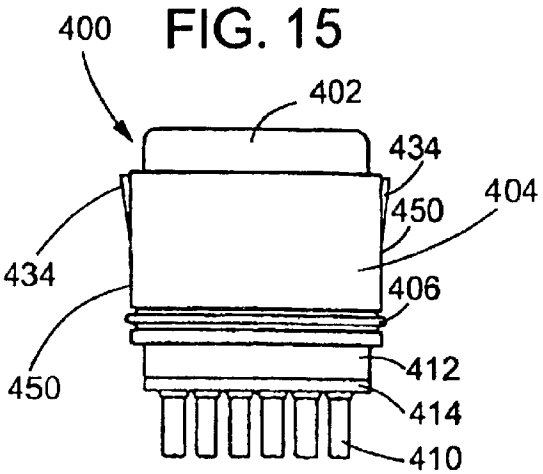
FIG. 13 is a side elevational view of the socket insert in FIG. 12.
Figure 14:
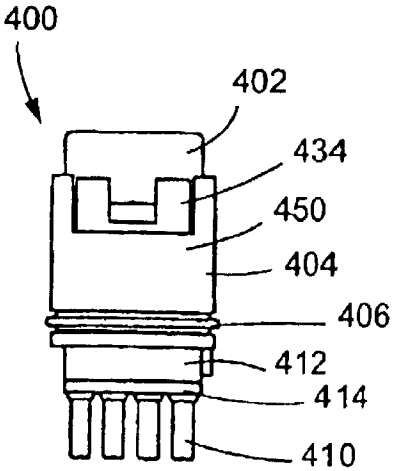
FIG. 14 is an end elevational view of the socket insert in FIG. 12.

Referring to FIGS. 13 and 14, the socket insert 400 is assembled. A portion of the grommet 402 extends above the rear portion 404. The locking tabs 434 project outward from respective end walls 450 of the rear portion 404. The peripheral seal 406 is disposed between the rear portion 404 and the front portion 412. The contacts 410 extend from the interfacial seal 414.

Figure 15:
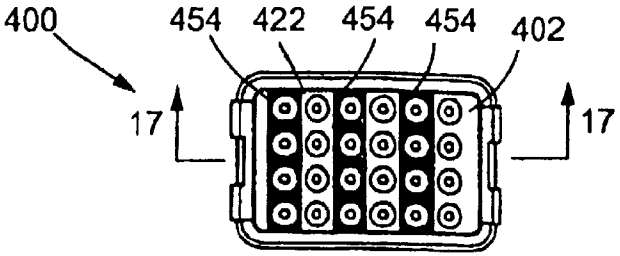
FIG. 15 is a top plan view of the socket insert in FIG. 12.

Referring to FIG. 15, the grommet 402 can include indicia 454, such as color-coding and numbers, to facilitate the user's identifying the different columns 422 of the bores 420. In the illustrative grommet 402, each alternate column 422 of the bores 420 includes the indicium 454. When a user wires the socket insert 400, the user can use the indicia 454 to locate quickly and accurately the proper column 422 by using the indicia 454 as a visual identifier and check.

In other embodiments the grommet can include an indicium, such as color-coding, to identify the contact size and/or type with which the socket insert is compatible. In those embodiments that use color-coding, the color can match the color used by the electrical contact industry to indicate the compatible contact type. The contact insertion and removal tools can also be the same color as the grommet and the contacts.

Figure 16:
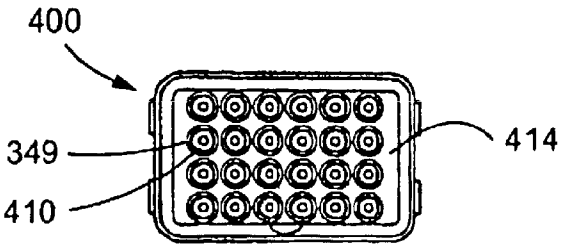
FIG. 16 is a bottom plan view of the socket insert in FIG. 12.

Referring to FIG. 16, each bore 449 of the interfacial seal 414 is in sealing contact with the respective socket electrical contact 410 installed within each bore 449.

Figure 17:
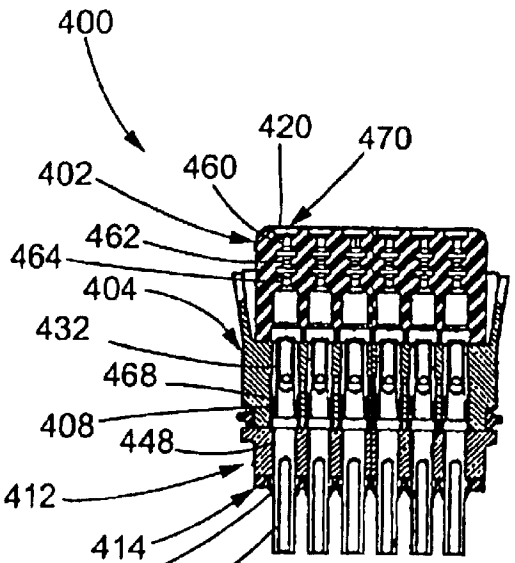
FIG. 17 is a cross-sectional view of the socket insert taken along line 17—17 in FIG. 15.
Figure 18:
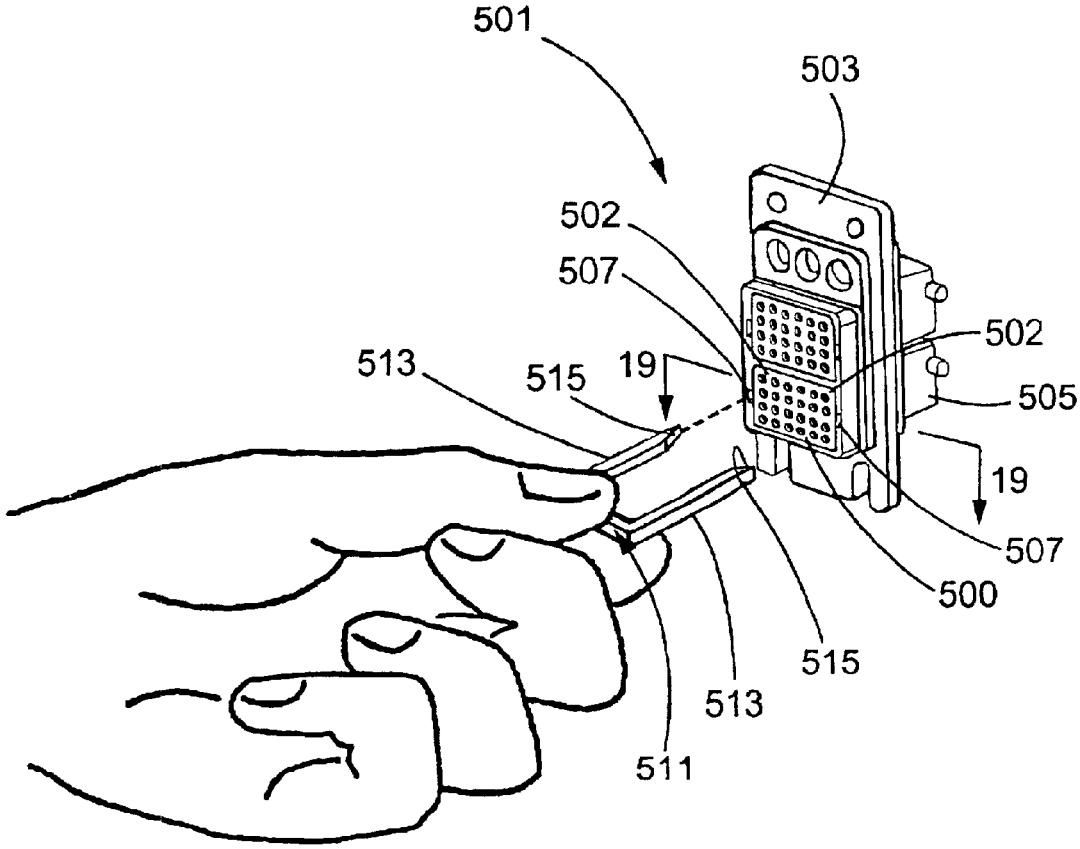
FIG. 18 is a perspective view of a receptacle assembly and a tool for removing an insert.

Referring to FIG. 17, each bore 420 of the grommet 402 can include a three-barrier wire seal. Each bore 420 includes three necked portions 460, 462, 464. The necked portions 460, 462, 464 engage an installed wire to provide three separate seals.

Each bore 432 of the rear portion 404 includes a stop 468 that engages the respective contact retaining clip 408 disposed in each bore 432.

Each bore 420 of the grommet 402 cooperates with a respective bore 432 of the rear portion 404, a respective bore 448 of the front portion 412, and a respective bore 449 of the interfacial seal 414 to define a respective contact chamber 470. The socket insert 400 is contact reverse gender. In other words, the socket insert 400 has protruding contacts 410. The contacts 410 extend beyond the respective contact chamber 470 within which they are disposed from the interfacial seal 414. The reverse gender allows the contacts 410 of the socket insert 400 to be inserted into the respective contact chambers of a mating pin insert to establish electrical continuity between the socket electrical contacts of the socket insert and the pin electrical contacts of the pin insert.

FIGS. 18–22 illustrate the removal of a socket insert 500 from a receptacle assembly 501. The socket insert 500 is removably mounted to a receptacle housing 503 inside a first cavity 505. The receptacle housing 503 and a grommet 502 of the socket insert 500 define a pair of gaps 507. A tool 511 for removing the socket insert 500 is shown. The tool 511 includes a pair of arms 513 having tapered ends 515. The arms 513 of the tool 511 can be inserted into the gaps 507 adjacent the socket insert 500 to facilitate the removal of the socket insert 500.

Figure 19:
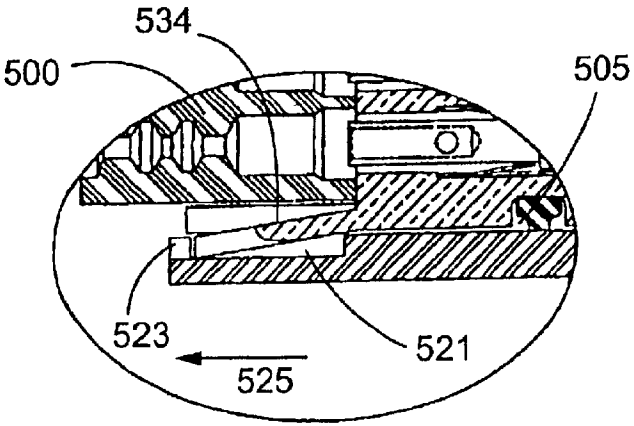
FIG. 19 is a fragmentary cross-sectional view of the receptacle assembly taken along line 19—19 in FIG. 18.

Referring to FIG. 19, a pair of flexible locking tabs 534 retains the socket insert 500 in the first cavity 505 of the receptacle housing 503. The first cavity 505 includes a pair of recesses 521. The recesses 521 define a pair of stops 523. During installation of the socket insert 500 into the first cavity 505, the locking tabs 534 deflect inward toward each other to allow the socket insert 500 to fit within the first cavity 505. Once the locking tabs 534 move past the stops 523, the locking tabs 534 deflect outward returning toward their normal position until the locking tabs contact the recesses 521. Each locking tab 534 is retentively engaged with the respective stop 523. The stops 523 prevent the socket insert 500 from being moved in a removal direction 525.

Figure 20:
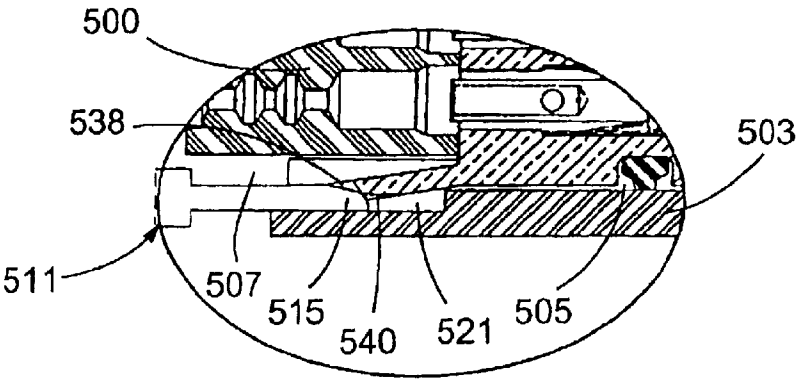
FIG. 20 is a fragmentary cross-sectional view as in FIG. 19 illustrating the tool partially inserted in the receptacle assembly.

FIG. 20 illustrates the tool 511 partially inserted into the first cavity 505. The tool 511 facilitates the removal of the socket insert 500 from the first cavity 505 of the receptacle housing 503 by inwardly moving the locking tabs 534 toward each other from the recesses 521 in the first cavity 505. The tapered ends 515 of each arm 513 of the tool 511 are disposed in the gaps 507. Each tapered end 515 engages the respective locking tab. The ends 515 of the tool 511 can fit within a notch 538 of each locking tab 534. The notches 538 each include a tapered end 540. The tapered ends 515 of tool 511 and the tapered ends 540 of the notches 538 of the locking tabs 534 are complementary to each other. The ends 515 of the tool 511 engage the ends 540 of the locking tabs 534.

Figure 21:
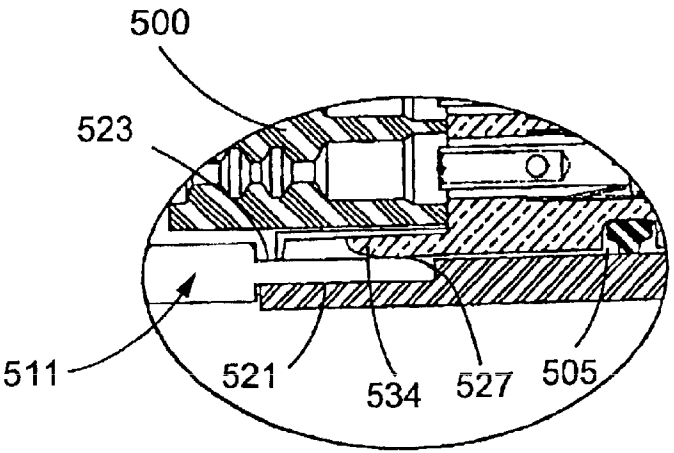
FIG. 21 is a fragmentary cross-sectional view as in FIG. 19 illustrating the tool fully inserted in the receptacle housing and a locking tab deflected toward the socket insert.

Referring to FIG. 21, continued insertion of the tool 511 into the first cavity 505 inwardly deflects the locking tabs toward each other. In FIG. 21, the tool 511 is fully inserted in the first cavity 505 such that the ends 515 of the tool 511 contact respective ends 527 of the recesses 521. The locking tabs 534 are deflected inwardly such that the locking tabs 534 are out of the recesses. The locking tabs 534 are no longer in retentively engaging relation with the stops of the recesses 521. The socket insert 500 can be removed from the first cavity 505.

Figure 22:
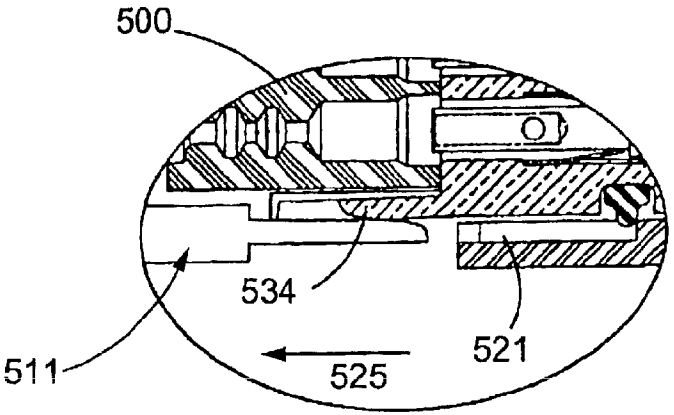
FIG. 22 is a fragmentary cross-sectional view as in FIG. 19 illustrating the socket insert partially withdrawn from the receptacle housing.

Referring to FIG. 22, the socket insert 500 is partially withdrawn from the first cavity 505. Once respective ends 529 of the locking tabs 534 are moved in the removal direction 525 past the recesses 521, the tool 511 can be removed and the locking tabs 534 can be allowed to return toward their normal positions.

Although the removal of an insert with the tool 511 was illustrated with the socket insert 500 installed in a receptacle assembly, it is understood that the tool 511 can be used to facilitate the removal of a pin insert from a receptacle assembly and a pin insert or a socket insert from a plug assembly.

FIGS. 23–29 illustrate other embodiments of a pin insert. Although pin inserts are illustrated it will be understood that the various features described herein can be included in embodiments of a socket insert as well. Accordingly, reference will be made herein to an insert. The number of contacts an insert can accommodate can be varied. An insert that can accommodate twenty-four 22 gauge contacts is advantageous because such an insert can be used in a majority of aviation applications. By matching the number of contacts in the insert to the number of contacts needed for a specific application, costs can be reduced by avoiding the need for installing sealing plugs in non-occupied contact positions. Although the cost of individual sealing plugs is not excessive, the cost of labor for installing the sealing plugs can be significant.

To facilitate modular interchangeability, each insert can be the same size and shape. Preferably the size of the insert is such that it can accommodate twenty-four 22 gauge contacts, fifteen 20 gauge contacts, six 16 gauge contacts, three 12 gauge contacts, or two 8 gauge contacts. To prevent operator error and cavity damage, each insert can be configured such that it has contact positions sized for the same size contact, for example 16 gauge. The insert can include an indicium, such as a color, to indicate the size of its contact cavities. Advantageously, the color-coding of the insert can correspond to the color-coding used in the contact field to indicate size. Contact insertion and removal tools can also bear similar indicia, such as color-coding, to match the appropriate tool to the corresponding contact size. The contact cavities can be disposed in an array having rows and columns. Every other column of contact cavities can be marked with white ink, for example. The row and column layout and the marking of alternate columns of contact cavities can facilitate assembly by providing a readily-grasped system to identify a specific contact cavity.

Figure 23:
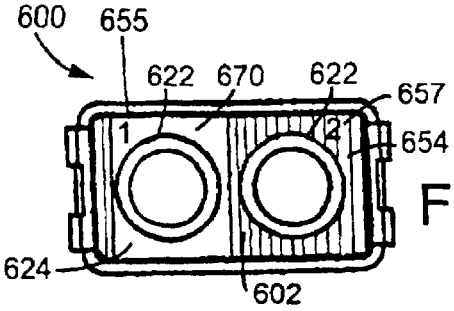
FIG. 23 is a top plan view of another embodiment of a pin insert.

For example, referring to FIG. 23, an embodiment of a pin insert 600 is shown. The insert 600 includes two contact chambers 670. The contact chambers 670 are each sized to accommodate an 8-gauge pin contact. The contact chambers 670 are arranged in a predetermined array of two columns 622 by one row 624.

The pin insert 600 includes a grommet 602 having a red-colored indicium 654 and numerical indicia 655, 657 to facilitate the user's identifying the different contact chambers 670. One of the two columns 622 of contact chambers 670 includes the color indicium 654. The numerical indicia 655, 657 include the numbers "1" and "2," respectively. The numerical indicia 655, 657 help to identify the particular contact chambers 670 by respectively associating the contact chambers 670 with the indicia 655, 657.

The red-colored indicium 654 can act to indicate that pin insert 600 can accommodate 8 gauge contacts that by industry standard also bear a red-colored indicium. In other words the red-colored indicium 654 on the pin insert 600 acts as an easy visual signal that the pin insert 600 is compatible with 8 gauge contacts because the same red-colored indicium is used for 8 gauge contacts. This color-coding system facilitates the user's identification of the properly compatible contacts to be used with the pin insert 600. The contact insertion and removal tools can also be the same color as the grommet and the contacts, i.e., red.

Figure 24:
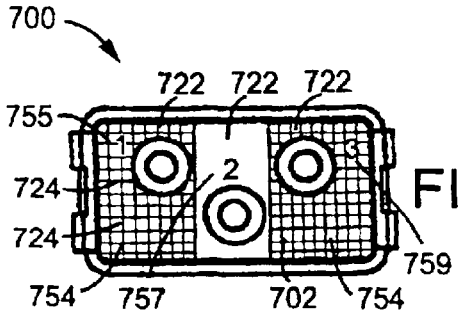
FIG. 24 is a top plan view of another embodiment of a pin insert.

Referring to FIG. 24, an embodiment of a pin insert 700 is shown. The insert 700 includes three contact chambers 770. The contact chambers 770 are each sized to accommodate a 12-gauge pin contact. The contact chambers 770 are arranged in a predetermined, staggered array of three columns 722 by two rows 724.

The pin insert 700 includes a grommet 702 having yellow-colored indicia 754 and numerical indicia 755, 757, 759 to facilitate the user's identifying the different contact chambers 770. Alternate columns 722 of contact chambers 770 include the yellow-colored indicia 754. The numerical indicia 755, 757, 759 include the numbers "1," "2," and "3," respectively. The numerical indicia 755, 757, 759 help to identify the particular contact chambers 770 by respectively associating the contact chambers 770 with the indicia 755, 757, 759.

The yellow-colored indicium 754 can act to indicate that pin insert 700 can accommodate 12 gauge contacts that by industry standard also bear a yellow-colored indicium. In other words the yellow-colored indicium 754 on the pin insert 700 acts as an easy visual signal that the pin insert 700 is compatible with 12 gauge contacts because the same yellow-colored indicium is used for 12 gauge contacts. This color-coding system facilitates the user's identification of the properly compatible contacts to be used with the pin insert 700. The contact insertion and removal tools can also be the same color as the grommet and the contacts, i.e., yellow.

Figure 25:
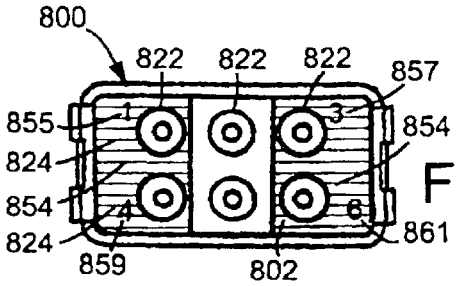
FIG. 25 is a top plan view of another embodiment of a pin insert.

Referring to FIG. 25, an embodiment of a pin insert 800 is shown. The insert 800 includes six contact chambers 870. The contact chambers 870 are each sized to accommodate a 16-gauge pin contact. The contact chambers 870 are arranged in a predetermined array of three columns 822 by two rows 824.

The pin insert 800 includes a grommet 802 having blue-colored indicia 854 and numerical indicia 855, 857, 859, 861 to facilitate the user's identifying the different contact chambers 870. Alternate columns 822 of contact chambers 870 include the blue-colored indicia 854. The numerical indicia 855, 857, 859, 861 include the numbers "1," "3," "4," and "6," respectively. The numerical indicia 855, 857, 859, 861 help to identify the selected contact chambers 870 by respectively associating the contact chambers 870 with the indicia 855, 857, 859, 861. For example, by placing the "1" indicium 855 at one end of the top row and the "3" indicium 857 at the other end of the top row, the indicia 855, 857 provide a ready system for the user to use to identify that contact chambers one through three are located in the top row. The "4" and "6" indicia 859, 861 operate in the same fashion for the bottom row.

The blue-colored indicia 854 can act to indicate that pin insert 800 can accommodate 16 gauge contacts that by industry standard also bear a blue-colored indicium. In other words the blue-colored indicia 854 on the pin insert 800 act as an easy visual signal that the pin insert 800 is compatible with 16 gauge contacts because the same blue-colored indicium is used for 16 gauge contacts. This color-coding system facilitates the user's identification of the properly compatible contacts to be used with the pin insert 800. The contact insertion and removal tools can also be the same color as the grommet and the contacts, i.e., blue.

Figure 26:
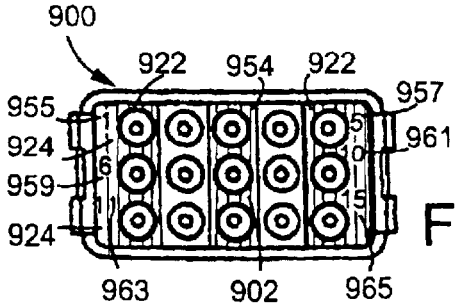
FIG. 26 is a top plan view of another embodiment of a pin insert.

Referring to FIG. 26, an embodiment of a pin insert 900 is shown. The insert 900 includes fifteen contact chambers 970. The contact chambers 970 are each sized to accommodate a 20-gauge pin contact. The contact chambers 970 are arranged in a predetermined array of five columns 922 by three rows 924.

The pin insert 900 includes a grommet 902 having red-colored indicia 954 and numerical indicia 955, 957, 959, 961, 963, 965 to facilitate the user's identifying the different contact chambers 970. Alternate columns 922 of contact chambers 970 include the red-colored indicia 954. The numerical indicia 955, 957, 959, 961, 963, 965 include the numbers "1," "5," "6," "10," "11," and "15," respectively. The numerical indicia 955, 957, 959, 961, 963, 965 help to identify the selected contact chambers 970 by respectively associating the contact chambers 970 with the indicia 955, 957, 959, 961, 963, 965. For example, by placing the "1" indicium 955 at one end of the top row and the "5" indicium 957 at the other end of the top row, the indicia 955, 957 provide a ready system for the user to use to identify that contact chambers one through five are located in the top row. The other indicia 959, 961, 963, 965 operate in the same fashion for the other rows.

The red-colored indicia 954 can act to indicate that pin insert 900 can accommodate 20 gauge contacts that by industry standard also bear a red-colored indicium. In other words the red-colored indicia 954 on the pin insert 900 act as an easy visual signal that the pin insert 900 is compatible with 20 gauge contacts because the same red-colored indicium is used for 20 gauge contacts. This color-coding system facilitates the user's identification of the properly compatible contacts to be used with the pin insert 900. The contact insertion and removal tools can also be the same color as the grommet and the contacts, i.e., red.

Figure 27:
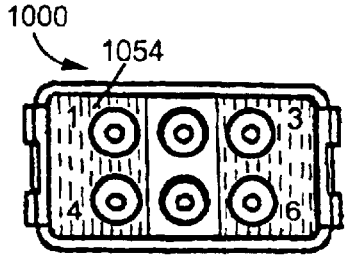
FIG. 27 is a top plan view of another embodiment of a pin insert.

Referring to FIG. 27, an embodiment of a pin insert 1000 is shown. The insert 1000 is similar to the pin insert 800 depicted in FIG. 25 except that the pin insert 1000 in FIG. 27 includes violet-colored indicia 1054 to indicate that the pin insert 1000 is compatible with optical fiber contacts. The pin insert 1000 is similar to the pin insert 800 in FIG. 25 in other respects.

Figure 28:
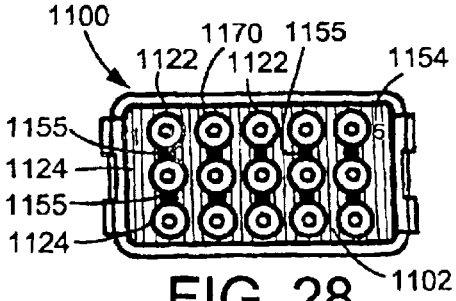
FIG. 28 is a top plan view of another embodiment of a bussed pin insert.

FIG. 28 depicts an embodiment of a bussed pin insert 1100. The bussed insert 1100 includes fifteen contact chambers 1170. The contact chambers 1170 are each sized to accommodate a 20-gauge pin contact. The contact chambers 1170 are arranged in a predetermined array of five columns 1122 by three rows 1124. The contact chambers 1170 in each column 1122 are electrically interconnected to each other, or bussed together.

The pin insert 1100 includes a grommet 1102 having a red-colored indicium 1154 and a plurality of linear indicia 1155. The red-colored indicium 1154 can act to indicate that pin insert 1100 can accommodate 20 gauge contacts that by industry standard also bear a red-colored indicium. In other words the red-colored indicium 1154 on the pin insert 1100 acts as an easy visual signal that the pin insert 1100 is compatible with 20 gauge contacts because the same red-colored indicium is used for 20 gauge contacts. This color-coding system facilitates the user's identification of the properly compatible contacts to be used with the pin insert 1100. The contact insertion and removal tools can also be the same color as the grommet and the contacts, i.e., red.

The linear indicia 1155, such as solid black lines, can be disposed such that linear indicia 1155 connect each contact chamber 1170 in a particular bussed column 1122 to indicate which contact chambers 1170 are electrically connected together. For example, the left most column includes two linear indicia 1155 connecting the three contact chambers 1170 in the column together to indicate the leftmost column 1122 is bussed.

Figure 29:
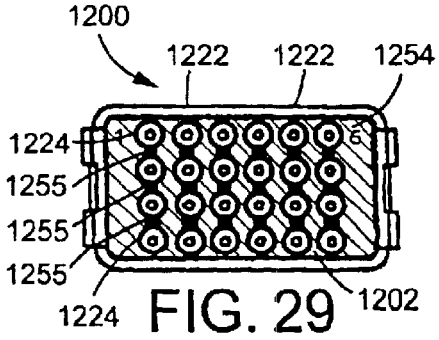
FIG. 29 is a top plan view of another embodiment of a bussed pin insert.

FIG. 29 depicts another embodiment of a bussed pin insert 1200. The bussed insert 1200 includes twenty-four contact chambers 1270. The contact chambers 1270 are each sized to accommodate a 22 gauge pin contact. The contact chambers 1270 are arranged in a predetermined array of six columns 1222 by four rows 1224. The contact chambers 1270 in each column 1222 are electrically interconnected to each other, or bussed together.

The pin insert 1200 includes a grommet 1202 having a green-colored indicium 1254 and a plurality of linear indicia 1255. The green-colored indicium 1254 can act to indicate that pin insert 1200 can accommodate 22 gauge contacts that by industry standard also bear a green-colored indicium. In other words the green-colored indicium 1254 on the pin insert 1200 acts as an easy visual signal that the pin insert 1200 is compatible with 22 gauge contacts because the same green-colored indicium is used for 22 gauge contacts. This color-coding system facilitates the user's identification of the properly compatible contacts to be used with the pin insert 1200. The contact insertion and removal tools can also be the same color as the grommet and the contacts, i.e., green.

The linear indicia 1255, such as solid black lines, can be disposed such that linear indicia 1255 connect each contact chamber 1270 in a particular bussed column 1222 to indicate which contact chambers 1270 are electrically connected together. For example, the left-most column includes three linear indicia 1255 connecting the four contact chambers 1270 in the column together to indicate the left-most column 1222 is bussed.

Figure 30:
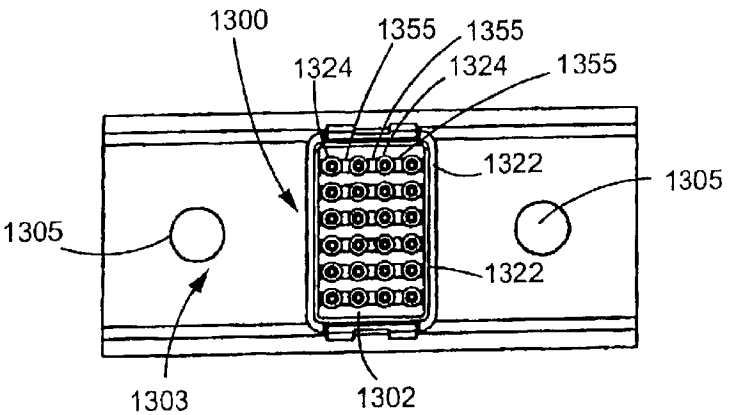
FIG. 30 is a top plan view of a bussed insert mounted to a track.

FIG. 30 shows a bussed pin insert 1300 individually mounted to a U-shaped track 1303. The track 1303 includes a plurality of mounting holes 1305 to allow the track to be mounted to a panel, for example. The illustrative bussed pin insert 1300 includes twenty-four contact chambers 1370 that can each accommodate a 22 gauge pin electrical contact. The contact chambers 1370 are arranged in a predetermined array of six columns 1322 by four rows 1324. The contact chambers 1370 in each column 1322 are electrically interconnected to each other, or bussed together. Linear indicia 1355 is disposed on the grommet 1302 such that linear indicia 1355 connect each contact chamber 1370 in a particular-bussed column 1322 to indicate which contact chambers 1370 are electrically connected together. The bussed insert 1300 can act as a terminal junction block.

Figure 31:
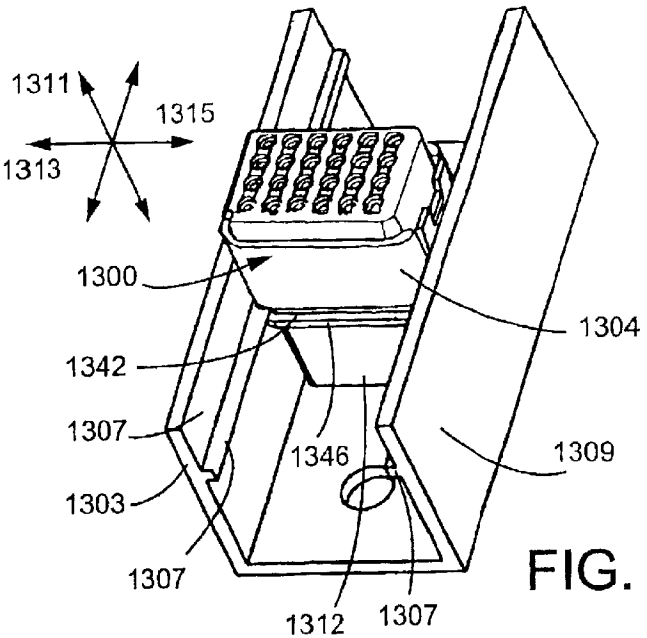
FIG. 31 is a perspective view of the bussed insert and the track in FIG. 30.

Referring to FIG. 31, the peripheral seal of the bussed insert 1300 has been removed to reveal a rabbet 1342 in a rear portion 1304 of the bussed insert 1300. The track 1303 includes a pair of ridges 1307 protruding inwardly toward each other from a pair of sidewalls 1309. The rabbet 1342 in cooperation with a face 1346 of a front portion 1312 of the bussed insert 1300 can be used to retentively engage the ridges 1307. The bussed insert 1300 is retained along both a vertical axis 1311 and a transverse axis 1313 but is free to translate along a longitudinal axis 1315.

Figure 32:
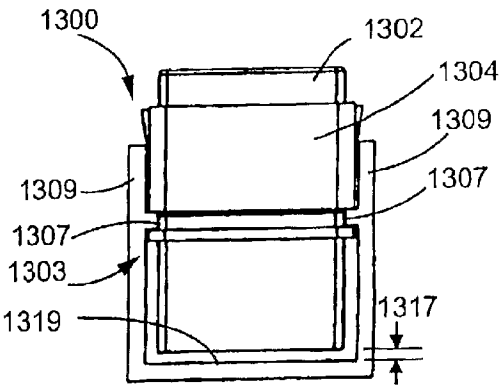
FIG. 32 is an end elevational view of the bussed insert and the track in FIG. 30.
Figure 32:
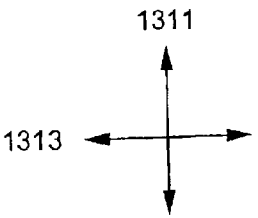

Referring to FIG. 32, the bussed insert 1300 and the track 1305 are configured such that the ridges 1307 suspend the bussed insert a predetermined distance 1317 from a bottom surface 1319 of the track 1303. Parts of a grommet 1302 and the rear portion 1304 of the bussed insert 1300 extend along the vertical axis 1311 above the sidewalls 1309 of the track 1303.

Figure 33:
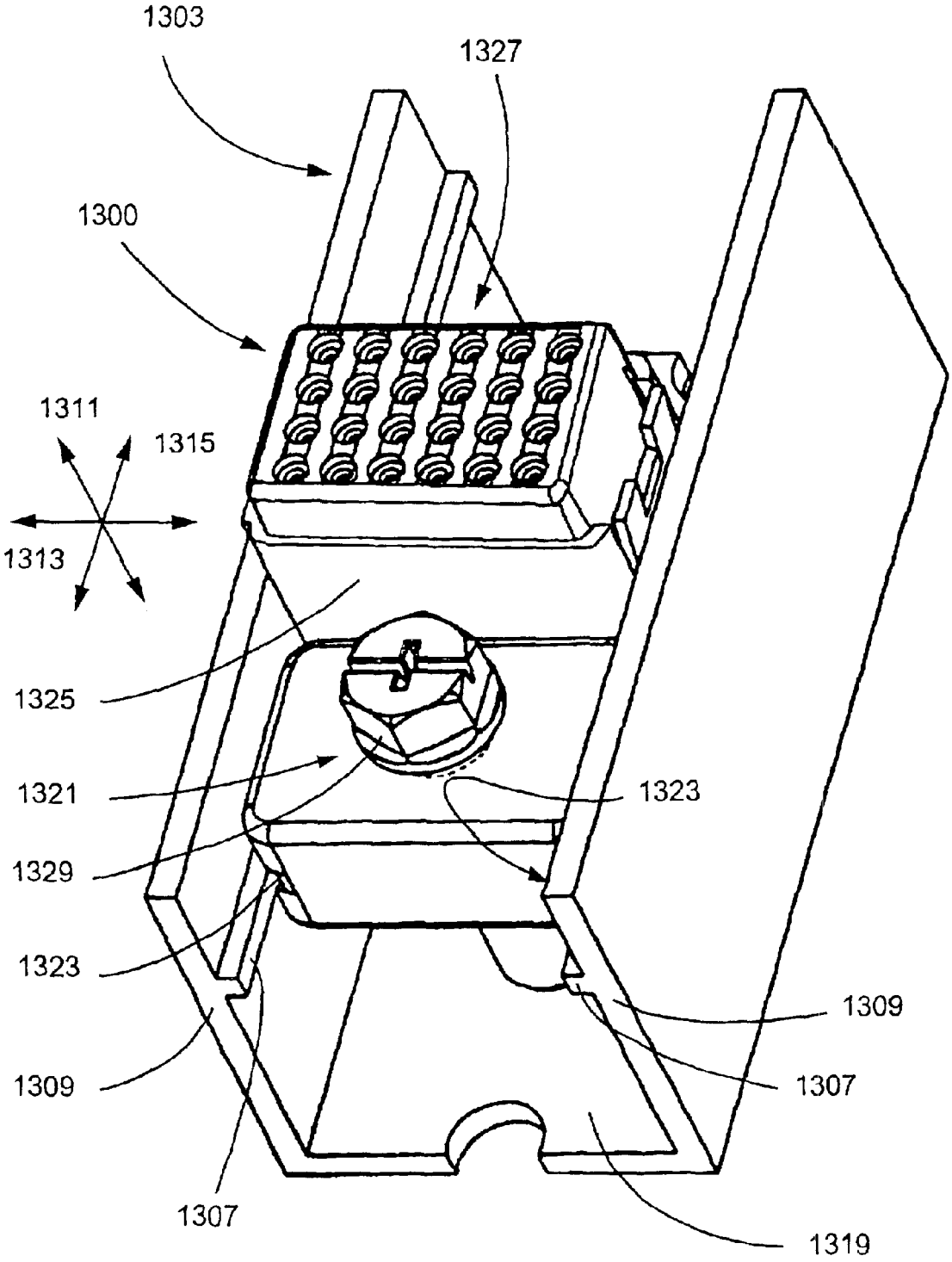
FIG. 33 is a perspective view of the bussed insert and the track in FIG. 30 and a mounting block.

Referring to FIG. 33, a mounting block 1321 is mounted to the track 1303 and is disposed adjacent the bussed insert 1300. The mounting block 1321 includes a pair of grooves 1323 that can retentively engage the ridges 1307 of the sidewalls 1309 to retain the mounting block in the vertical axis 1311 and the transverse axis 1313. A pair of mounting blocks can be mounted to the track 1303 at opposing sides 1325, 1327 of the bussed insert 1300 to retain the bussed insert 1300 along the longitudinal axis 1315. Each mounting block 1321 includes a set screw 1329 that is engageable with the bottom surface 1319 of the track to prevent the mounting block 1321 from translating along the track along the longitudinal axis 1315. By putting one mounting block 1321 in abutting relationship to the bussed insert 1300 on each side 1325, 1327, the pair of mounting blocks 1321 prevent the bussed insert from translating along the longitudinal axis 1315.

Alternatively, a pair of mounting blocks 1321 can retain a plurality of inserts that are ganged together by putting one mounting block at one end of the line of ganged inserts and another mounting block at the other end of the line of ganged inserts and engaging the set screws.

FIGS. 34–44 depict various embodiments of socket and receptacle housings. The illustrative connector system includes three different housing sizes: size "1" which can accept one insert, size "2" which can accept two inserts, and size "4" which can accept four inserts. It will be understood that the connector system can include other housing sizes. Each size will accept any insert. Although the illustrative connector system depicts using pin inserts having pin contacts in the plug housing and using socket inserts having socket contacts in the receptacle housing, a pin insert can fit into a receptacle housing and a socket insert can fit into a plug housing.

The connector system includes three different housing styles: a plastic housing, a nonconductive-finish metal housing, and a conductive-finish metal housing. Each style will accept any insert. The plastic housing style is especially suitable for low-cost applications. The nonconductive-finish metal housing style can be used for general purpose applications. The conductive-finish metal housing style is especially suited for applications requiring electrical grounding or shielding.

Figure 34:
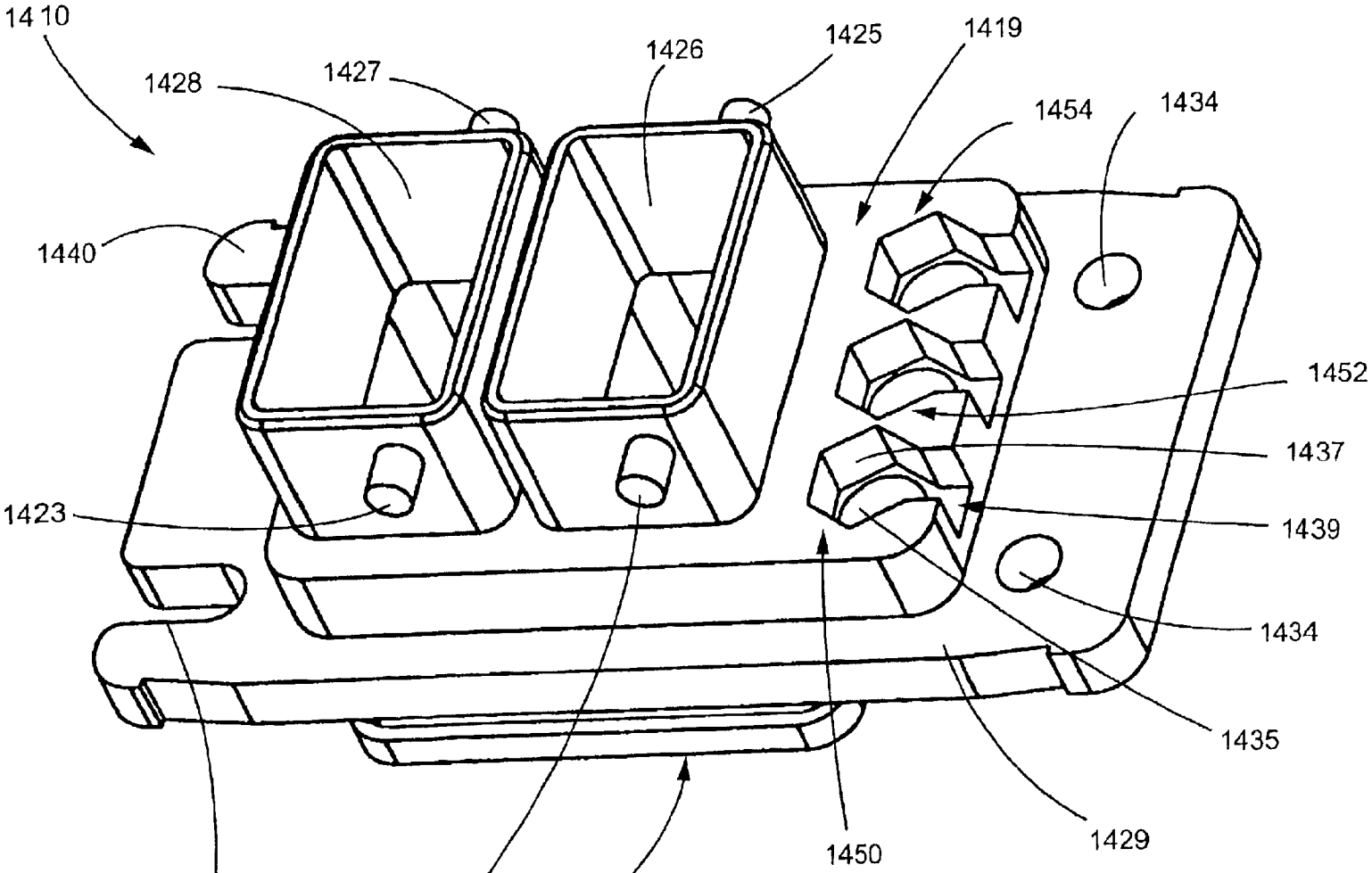
FIG. 34 is a top perspective view of a receptacle housing.

FIG. 34 depicts a size 2 receptacle housing 1410. The receptacle housing 1410 is similar to the receptacle housing 210 shown in FIG. 1. The size 2 receptacle housing is configured to accept two inserts, one insert in a first cavity 1426 and the second insert in a second cavity 1428. The size 2 receptacle housing 1410 can be interconnected to a size 2 plug housing. The receptacle housing 1410 includes a mating side 1419 and a wiring side 1441. When the receptacle housing 1410 is interconnected to a plug housing, the mating side 1419 is in close adjacency with the plug housing.

The receptacle housing 1410 includes a pair of mounting holes 1434 disposed on a flange 1429. The mounting holes 1434 can be various sizes. The illustrative mounting holes 1434 are both sized to receive a screw. The receptacle housing 1410 includes a pair of elongated mounting slots 1440. The mounting slots 1440 can be various sizes. The illustrative mounting slots 1440 are both sized to accept a screw. The mounting slots 1440 allow for the mounting of the receptacle housing 1410 even though there is hole-pattern misalignment on the mounting surface. The receptacle housing 1410 includes a plurality of bayonet pins 1421, 1423, 1425, 1427 for coupling the receptacle housing 1410 to a size 2 plug housing assembly. The bayonet pins 1421, 1423, 1425, 1427 act as cam follower members which engage the coupler to facilitate the interconnection of a receptacle and a plug.

The receptacle housing includes a plurality of polarity cavities 1450, 1452, 1454. Each polarity cavity is the same. Accordingly, only the first polarity cavity 1450 will be discussed. The polarity cavity 1450 includes a first opening 1435, a second opening 1437, and a window 1439. The first opening 1435 is configured to removably retain a polarizing key. The second opening 1437 is configured to approximately correspond to the shape of the polarizing key such that the second opening 1437 provides an interference fit with the polarizing key to prevent the installed polarizing key from rotating. The window 1439 is provided to allow the user to view a particular indicium located on the polarizing key to indicate a particular polarity.

Figure 35:
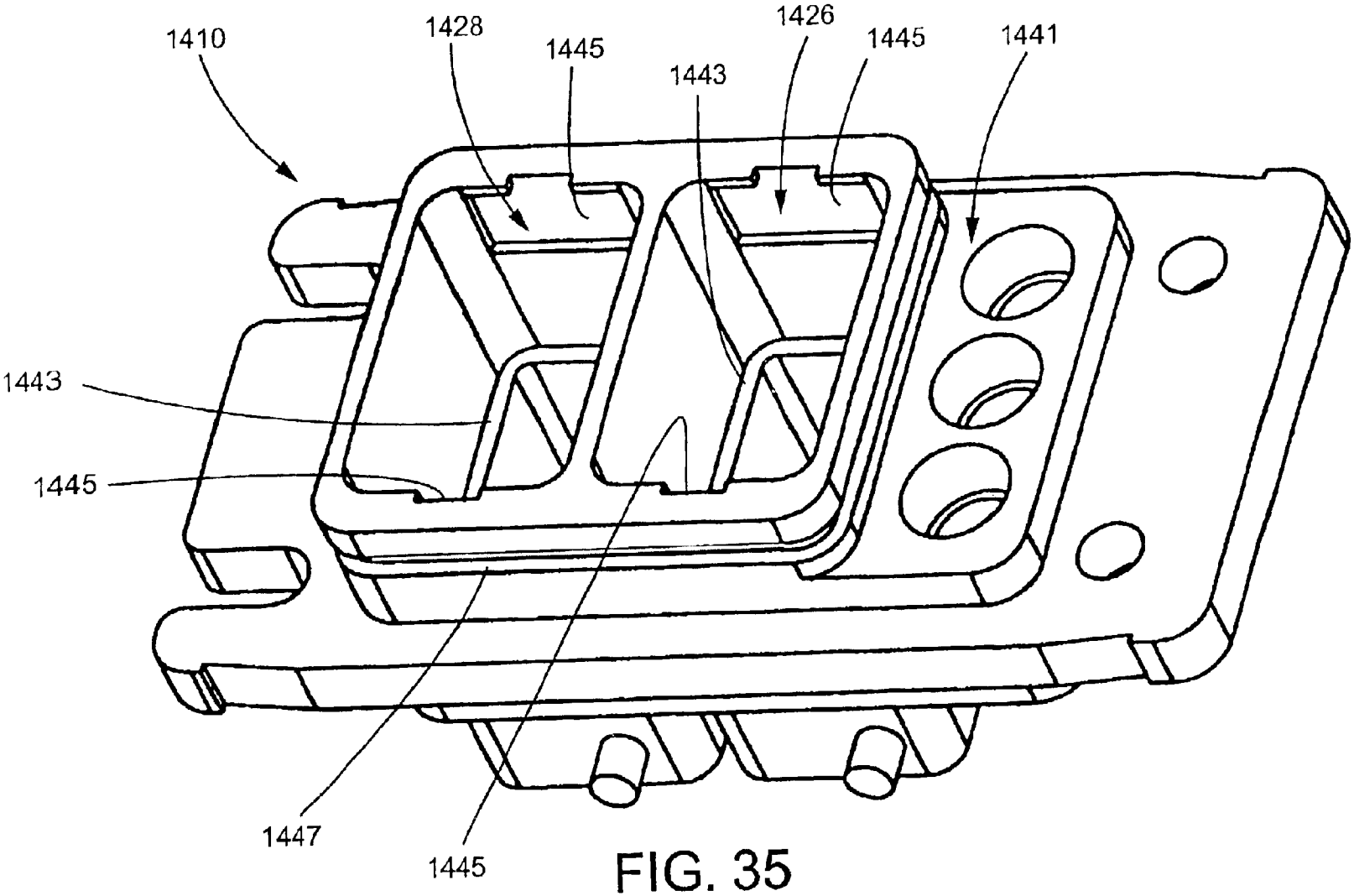
FIG. 35 is a bottom perspective view of the receptacle housing in FIG. 34.

FIG. 35 shows the wiring side 1441 of the receptacle housing 1410. Electrical wire can be connected from the wiring side 1441 of the receptacle housing 1410 to the plurality of contacts when the inserts are installed in the receptacle housing 1410. Each cavity 1426, 1428 of the receptacle housing 1410 includes an internal shoulder 1443 and a pair of recesses 1445. The shoulder 1443 and the recesses 1445 engage an insert to retain the insert in the respective cavity 1426, 1428. The receptacle housing includes an external groove 1447. The external groove 1447 can engage up to two backshells to retentively retain the backshell or pair of backshells in an installed position.

Figure 36:
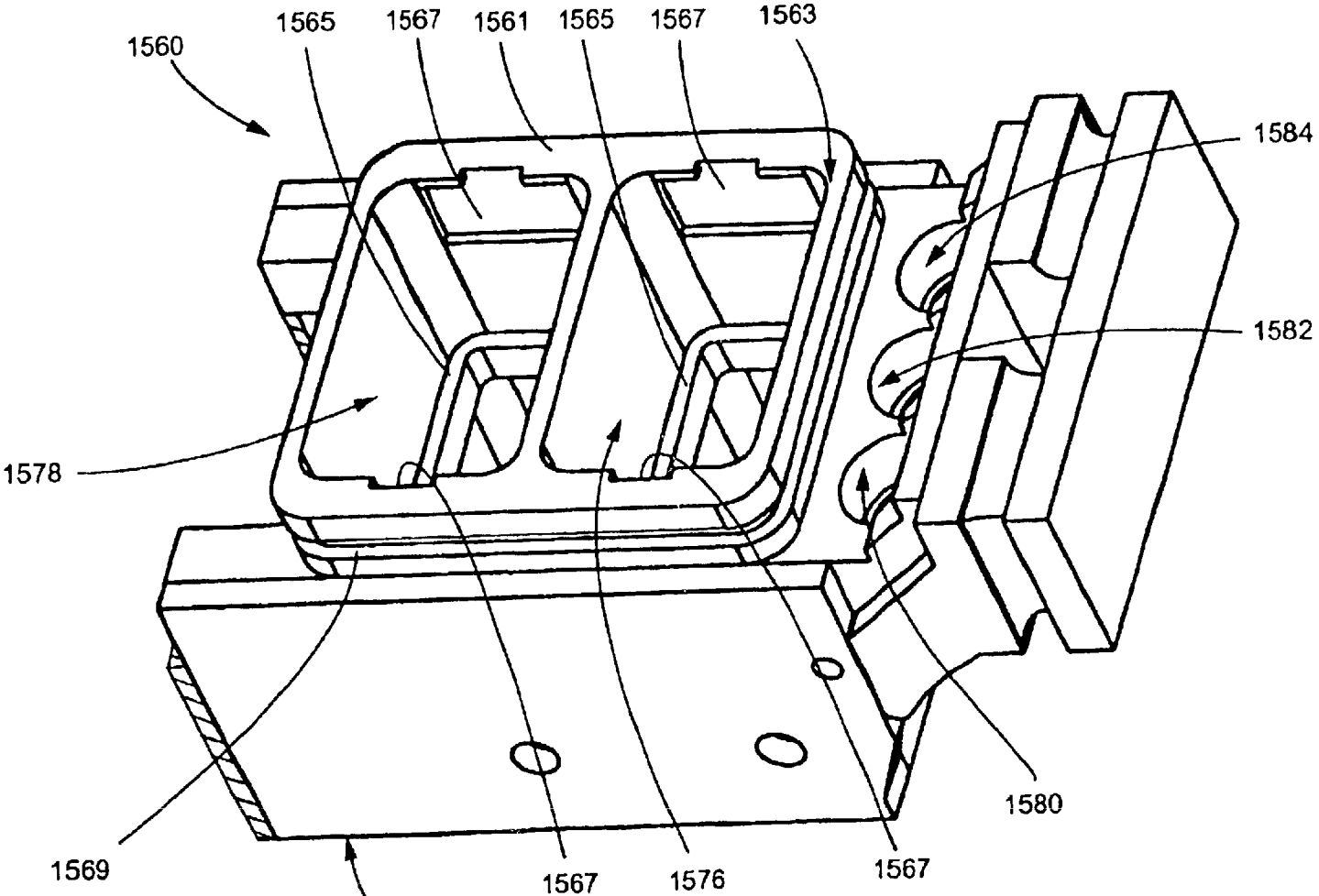
FIG. 36 is a top perspective view of a plug housing assembly.

FIG. 36 depicts a size 2 plug housing assembly 1560. The plug housing assembly 1560 is similar to the plug housing assembly 260 shown in FIG. 1. The size 2 plug housing assembly 1560 is configured to accept two inserts, one insert in a first cavity 1576 and the second insert in a second cavity 1578. The size 2 plug housing assembly 1560 can be interconnected to a size 2 receptacle housing. The plug housing assembly 1560 includes a wiring side 1563 and a mating side 1571.

Each cavity 1576, 1578 of the plug housing 1561 includes an internal shoulder 1565 and a pair of recesses 1567. The shoulder 1565 and the recesses 1567 engage an insert to retain the insert in the respective cavity 1576, 1578.

The plug housing 1561 includes a plurality of polarity cavities 1580, 1582, 1584. Each polarity cavity is the same as each other and the same as the polarity cavities described in the receptacle housing shown in FIGS. 34 and 35. The plug housing 1561 includes an external groove 1569. The external groove 1569 can engage up to two backshells to retentively retain the backshell or pair of backshells in an installed position.

Electrical wire can be connected from the wiring side 1563 of the plug housing assembly 1560 to the plurality of contacts found in the inserts installed in the plug housing assembly 1560. It should be understood that the contacts are each removable from the insert in which it is installed.

Figure 37:
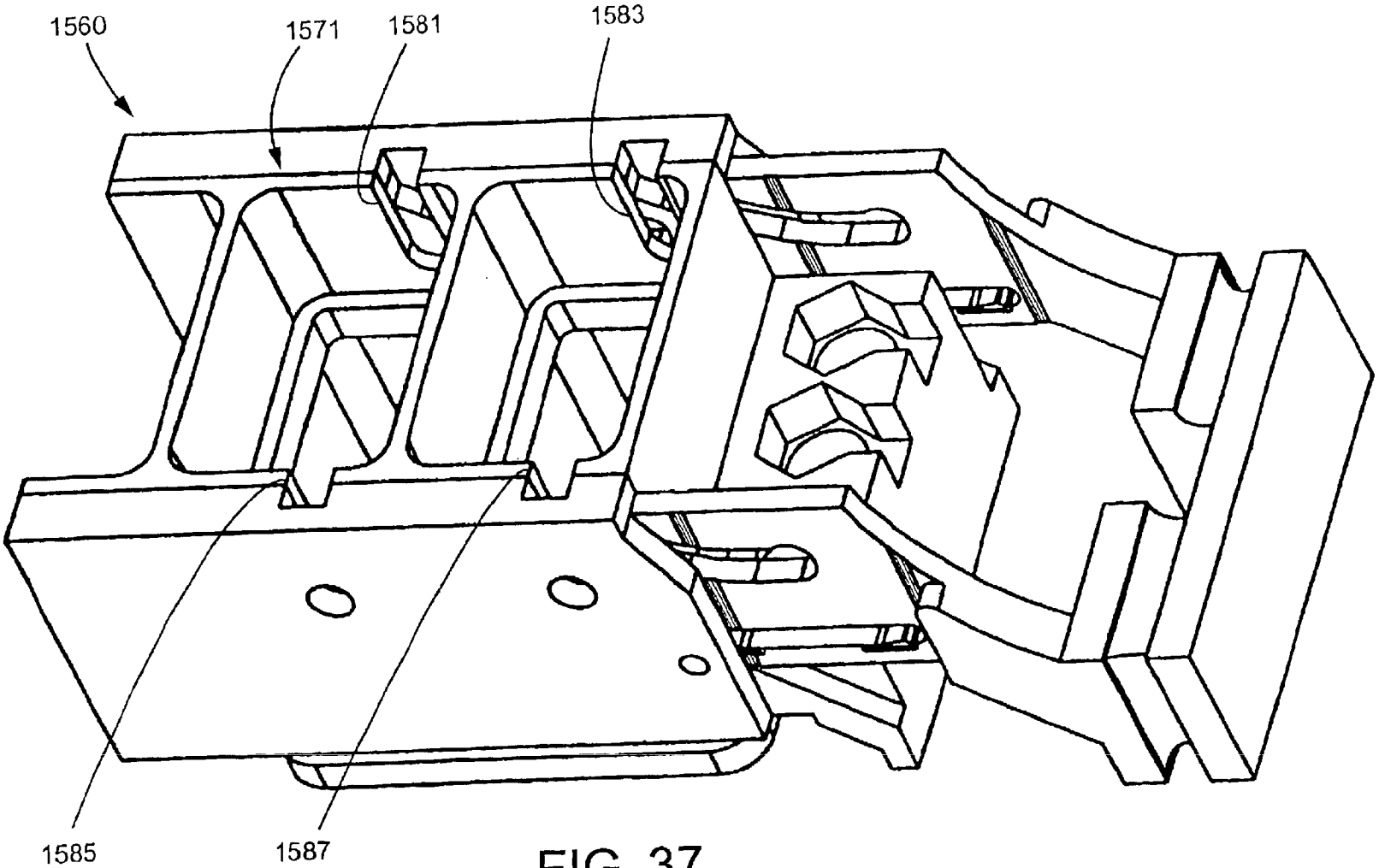
FIG. 37 is a bottom perspective view of the plug housing assembly in FIG. 36.

FIG. 37 shows the mating side 1571 of the plug housing assembly 1560. When the plug housing assembly 1560 is interconnected to a receptacle housing, the mating side 1571 is in close adjacency with the receptacle housing. The plug housing 1561 includes a plurality of notches 1581, 1583, 1585, 1587. The notches 1581, 1583, 1585, 1587 can accommodate the bayonet pins 1421, 1423, 1425, 1427, respectively, of the receptacle housing 1410 shown in FIG. 34 for coupling the receptacle housing 1410 to the plug housing assembly 1560.

Figure 38:
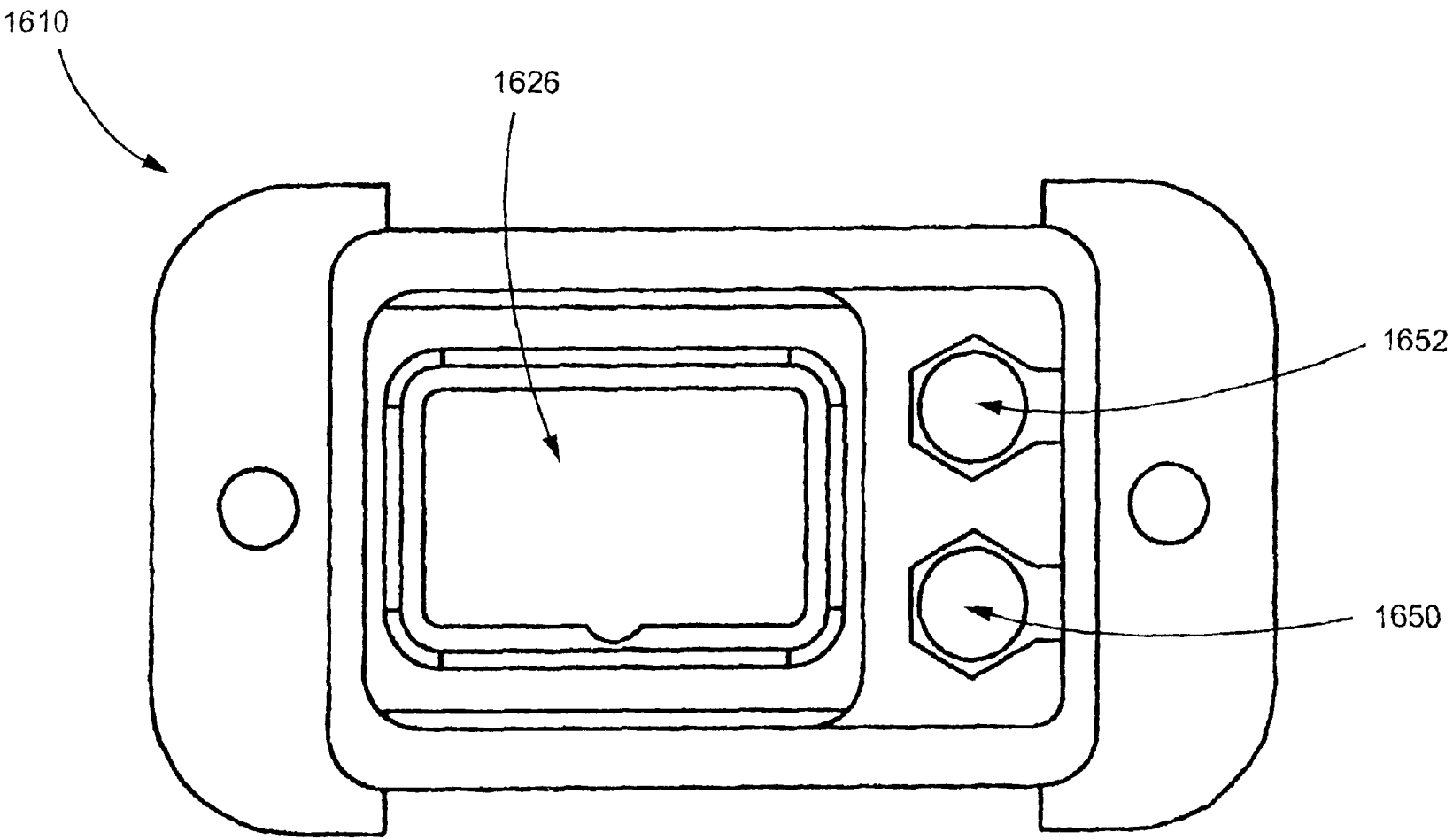
FIG. 38 is a top plan view of another embodiment of a receptacle housing.

FIG. 38 depicts a size 1 receptacle housing 1610. The size 1 receptacle housing 1610 is configured to accept one insert in a first cavity 1626. The size 1 receptacle housing 1610 can be interconnected to a size 1 plug housing. The receptacle housing 1610 includes a pair of polarity cavities 1650, 1652. Each polarity cavity is the same as each other and the same as the polarity cavities described in the receptacle housing 1410 shown in FIGS. 34 and 35. The receptacle housing 1610 is similar to the receptacle housing 1410 shown in FIG. 34 in other respects. The size 1 receptacle housing 1610 can be used for production breaks and for single harness applications.

Figure 39:
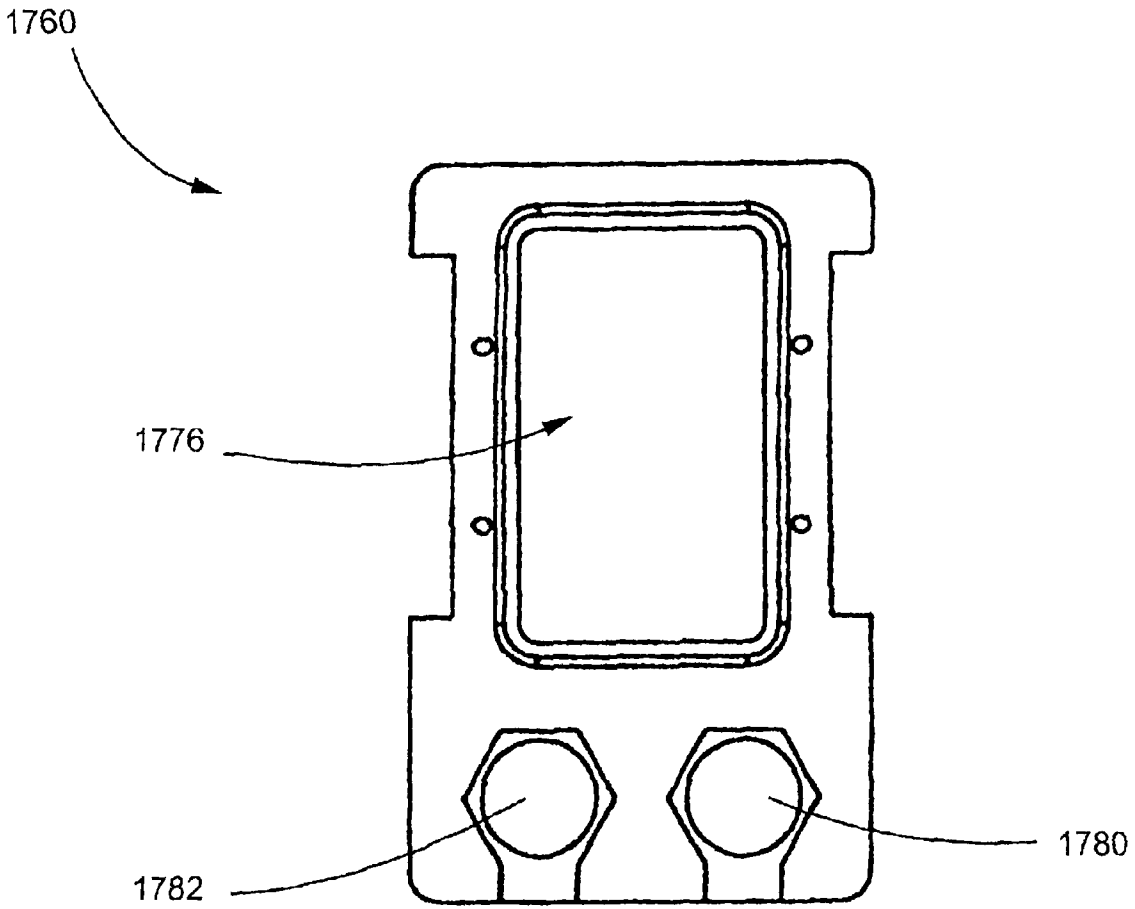
FIG. 39 is a top plan view of another embodiment of a plug housing.

FIG. 39 depicts a size 1 plug housing 1760. The size 1 plug housing 1760 is configured to accept one insert in a first cavity 1776. The size 1 plug housing 1760 can be interconnected to the size 1 receptacle housing 1610 shown in FIG. 38. The plug housing 1760 includes a pair of polarity cavities 1780, 1782. Each polarity cavity is the same as each other and the same as the polarity cavities described in the receptacle housing 1410 shown in FIGS. 34 and 35. The plug housing 1760 is similar to the plug housing 1561 of the plug housing assembly 1760 shown in FIG. 36 in other respects. The size 1 plug housing 1760 can be used for production breaks and for single harness applications.

Figure 40:
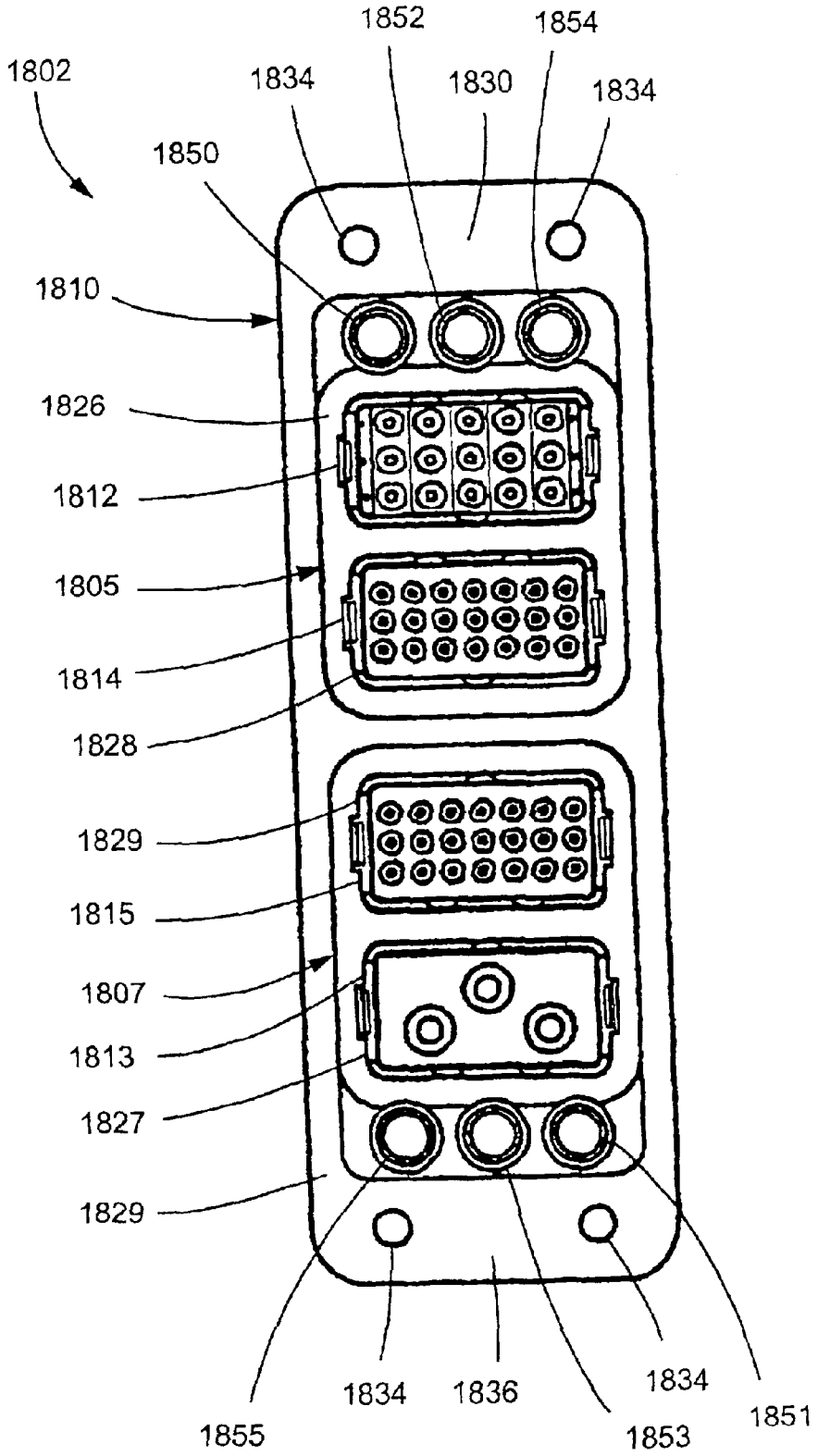
FIG. 40 is a bottom plan view of another embodiment of a receptacle housing.

FIG. 40 depicts a receptacle assembly 1802 including a size 4 receptacle housing 1810. The size 4 receptacle housing 1810 includes a first mating portion 1805 and a second mating portion 1807. The receptacle housing 1810 is configured to accept four inserts, a first and a second insert 1812, 1814 in the first mating portion 1805 and a third and a fourth insert 1813, 1815 in the second mating portion 1807. The first mating portion 1805 includes a first cavity 1826 and a second cavity 1828 for accommodating the first and second inserts 1812, 1814. The second mating portion 1807 includes a first cavity 1827 and a second cavity 1829 for accommodating the third and fourth inserts 1813, 1814. The size 4 receptacle housing 1810 can be interconnected to one size 4 plug housing or two size 2 plug housing assemblies. The receptacle housing 1810 includes four mounting holes 1834 with a pair disposed on each end 1830, 1836 of a flange 1829. The size 4 receptacle housing 1810 can be especially useful in areas having a higher harness density.

The first mating portion 1805 includes a plurality of polarity cavities 1850, 1852, 1854. The second mating portion 1807 includes a plurality of polarity cavities 1851, 1853, 1855. Each polarity cavity 1850, 1852, 1854, 1851, 1853, 1855 is the same as each other and the same as the polarity cavities described in the receptacle housing 1410 shown in FIGS. 34 and 35. Where the receptacle housing is to be connected to one size 4 plug housing, the plurality of polarity cavities 1851, 1853, 1855 of the second mating portion 1807 can be omitted.

Figure 41:
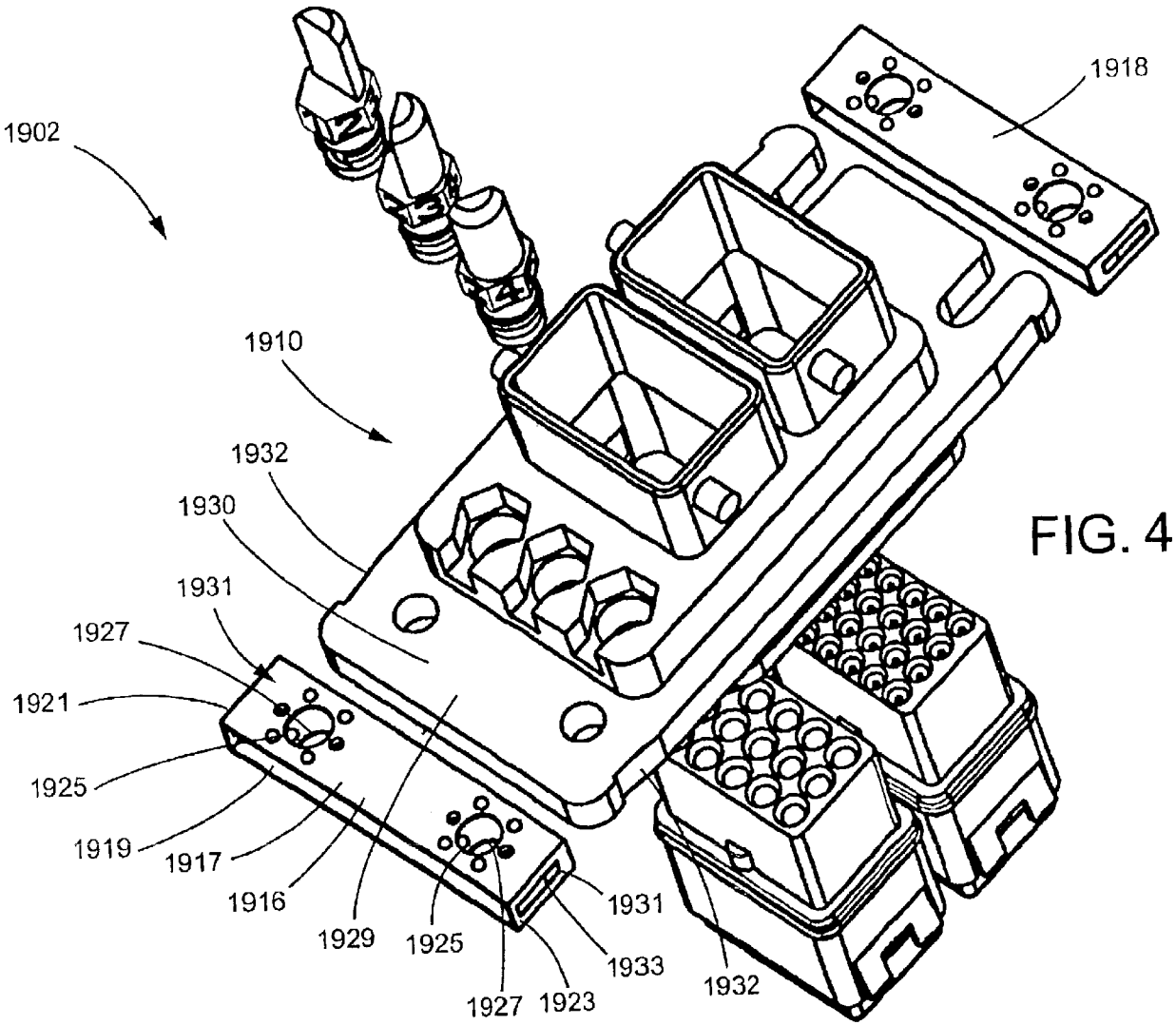
FIG. 41 is an exploded view of a receptacle assembly.

FIGS. 41–44 depict a receptacle assembly 1902 that includes a conductive-finish metal, size 2 receptacle housing 1910. Referring to FIG. 41, a first grounding spring 1916 and a second grounding spring 1918 are provided. The grounding springs 1916, 1918 provide electrical grounding between the receptacle housing 1910 and a mounting surface, such as a panel. The grounding springs 1916, 1918 are similar to the grounding springs 216, 218 discussed in FIGS. 1 and 2. The grounding springs 1916, 1918 are similar to each other. Accordingly, only the first grounding spring 1916 will be discussed.

The grounding spring 1916 includes a pair of faces 1917, 1919 and a pair of sides 1921, 1923. The grounding spring 1916 includes a pair of through holes 1925, 1927 on both faces 1917, 1919, respectively. Each side 1921, 1923 includes a resiliently flexible locking tab 1931 for engaging a respective notch 1932 of the flange 1929 to retain the grounding spring 1916 in a mounting relation to the flange 1929. Free ends 1933 of the locking tabs 1931 converge inwardly toward each other.

Figure 42:
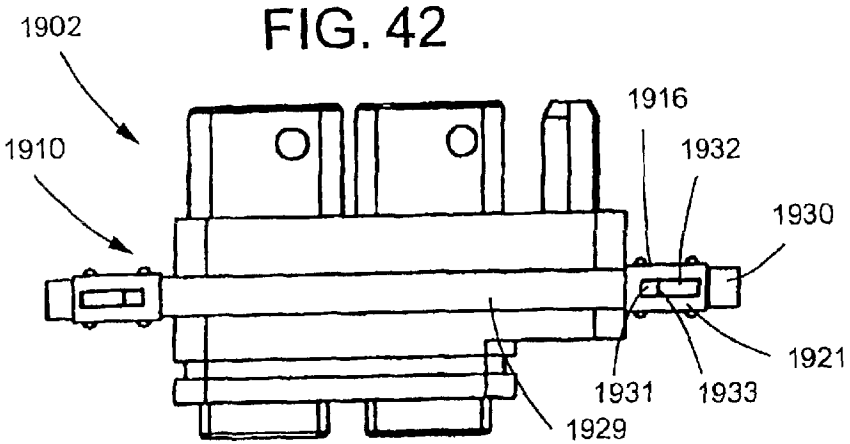
FIG. 42 is a side elevational view of the receptacle assembly in FIG. 41.

Referring to FIG. 42, the grounding spring 1916 is mounted to a first end 1930 of the flange 1929. During insertion of the grounding spring 1916, the locking tabs 1931 deflect outwardly to allow the grounding spring 1916 to slip onto the end 1930 of the flange 1929. When the free ends 1933 of the locking tabs 1931 align with the notches 1932, the locking tabs 1931 return inwardly toward their normal position thereby engaging the flange 1929 to retentively retain the grounding spring 1916.

Figure 43:
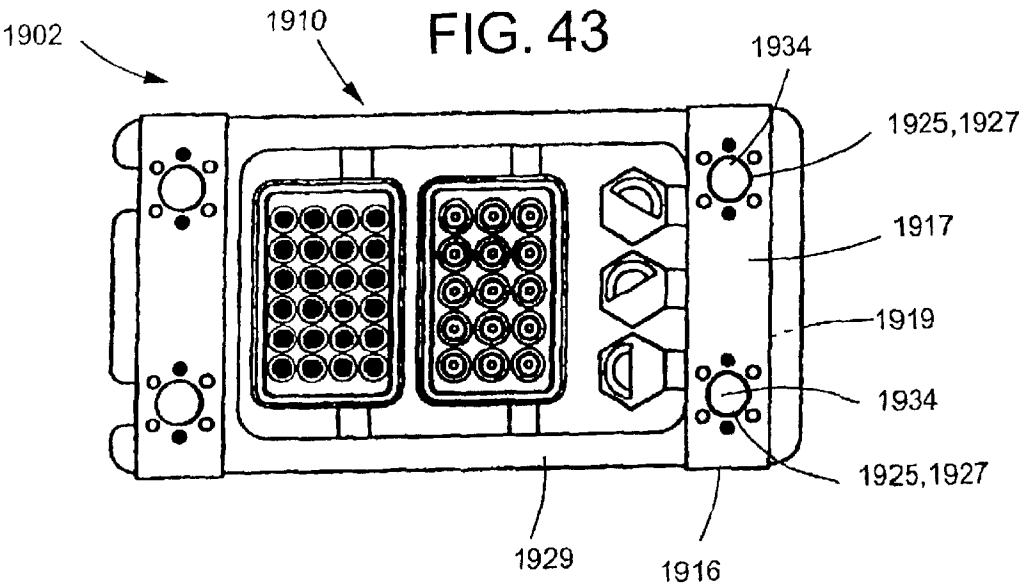
FIG. 43 is a top plan view of the receptacle assembly in FIG. 41.

Referring to FIG. 43, the grounding spring 1916 is mounted to the flange 1929 of the receptacle housing 1910. The grounding spring 1916 covers all sides of the flange 1929 and is disposed over the mounting holes 1934 of the flange 1929 such that the holes 1925, 1927 of both faces 1917, 1919 are aligned with the mounting holes 1934.

Figure 44:
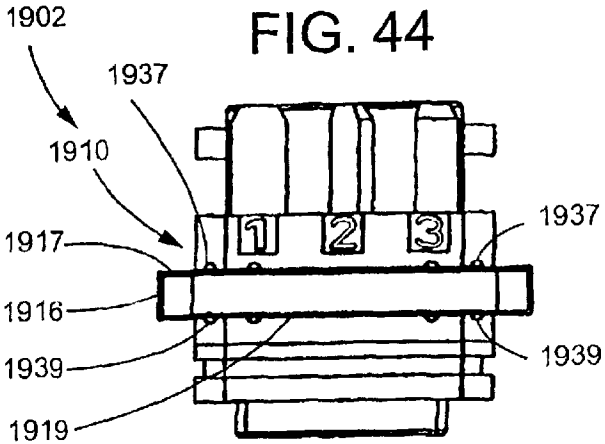
FIG. 44 is an end elevational view of the receptacle assembly in FIG. 41

Referring to FIG. 44, a plurality of alternating concave and convex hertzian bumps 1937, 1939 are disposed in spaced relation about each through hole 1925, 1927, respectively. The hertzian bumps 1937, 1939 provide high-force, low-resistance connections between the receptacle housing 1910 and a mounting surface. The presence of the hertzian bumps 1937, 1939 on both faces 1917, 1919 allows the receptacle housing 1910 to be front-panel mounted or rear-panel mounted, as will be discussed later.

The grounding spring 1916 can be made from any suitable material, such as gold-plated beryllium copper or beryllium nickel. The grounding spring 1916 can be made from a single sheet that is formed and attached at its edges by a weld, tabs, or other known means.

FIGS. 45–51 depict various mounting methods for the electrical connector system. The connector system is configured for use with various mounting methods. The receptacle housing can be front-panel mounted, rear-panel mounted, rail mounted, or "push" mounted.

Figure 45:
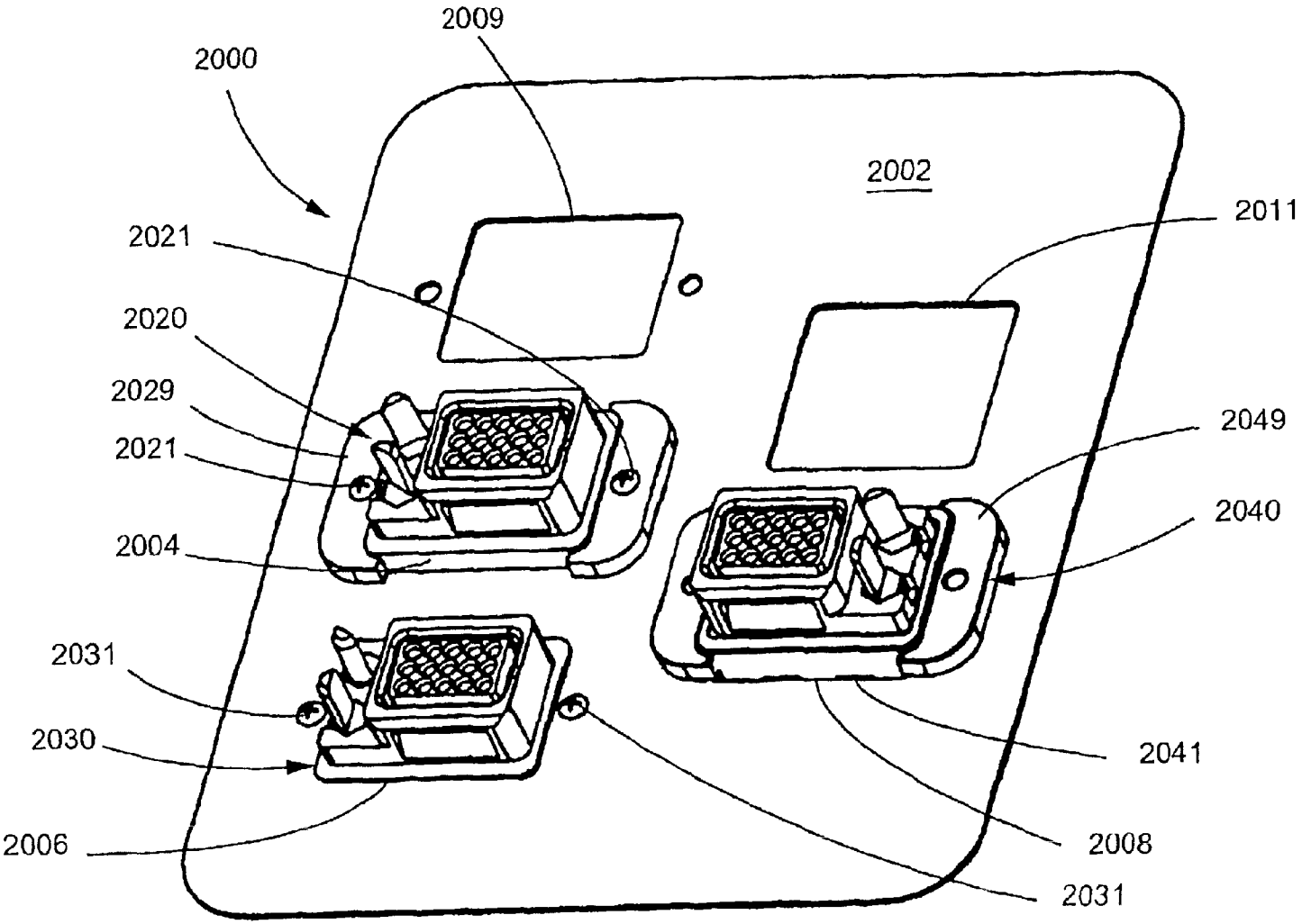
FIG. 45 is a perspective view of a mating side of a panel and a plurality of receptacle assemblies.

FIG. 45 shows a panel 2000 that includes a mating surface 2002. The panel 2000 includes a first cutout 2004, a second cutout 2006, and a third cutout 2008. A first receptacle assembly 2020 is disposed in the first cutout 2004 and is front mounted to the panel 2000 by a pair of bolts 2021. "Front mounting" is a mounting method wherein the receptacle assembly 2020 is attached to the panel 2000 from the mating surface 2002. In this embodiment, the first receptacle assembly 2020 is mounted to the panel 2000 such that a flange 2029 of the receptacle assembly 2020 is visible when viewing the mating surface 2002 of the panel 2000. Screws, nuts and bolts, or other techniques can be used to mount the first receptacle assembly 2020 to the panel 2000.

A second receptacle assembly 2030 is disposed in the second cutout 2006 of the panel 2000 and is rear mounted to the panel 2000 by a pair of screws 2031. "Rear mounting" refers to the mounting method wherein the receptacle assembly 2030 is attached to the panel 2000 from a wiring surface of the panel 2000. In this embodiment, the second receptacle assembly 2030 is mounted to the panel 2000 such that a flange of the receptacle assembly 2030 is visible when viewing the wiring surface of the panel 2000 and not visible when viewing the mating surface 2002 of the panel 2000. Screws, nuts and bolts, or other techniques can be used to mount the second receptacle assembly 2030 to the panel 2000. Front mounting and rear mounting can utilize the same cut out pattern for the panel. A fourth cutout 2009 is configured for front mounting or rear mounting.

A third receptacle assembly 2040 is disposed in the third cutout 2008 of the panel 2000 and is "push" mounted to the panel 2000 by a retaining clip 2041. "Push mounting" is a mounting method wherein the receptacle assembly 2040 is attached to the panel 2040 by a retaining clip or other technique without the use of bolts or screws. The flange 2049 of the receptacle assembly 2040 is visible when viewed from the mating surface 2002 of the panel 2000. To mount the third receptacle assembly 2040 to the panel 2000, the receptacle assembly 2040 is inserted into the retaining clip 2041. The third receptacle assembly 2040 and the retaining clip 2041 are inserted into the third cutout 2008 from the mating surface 2002. Screws or other fasteners are not necessary to secure the receptacle assembly 2040 to the retaining clip 2041. A fifth cutout 2011 is configured for push mounting.

Figure 46:
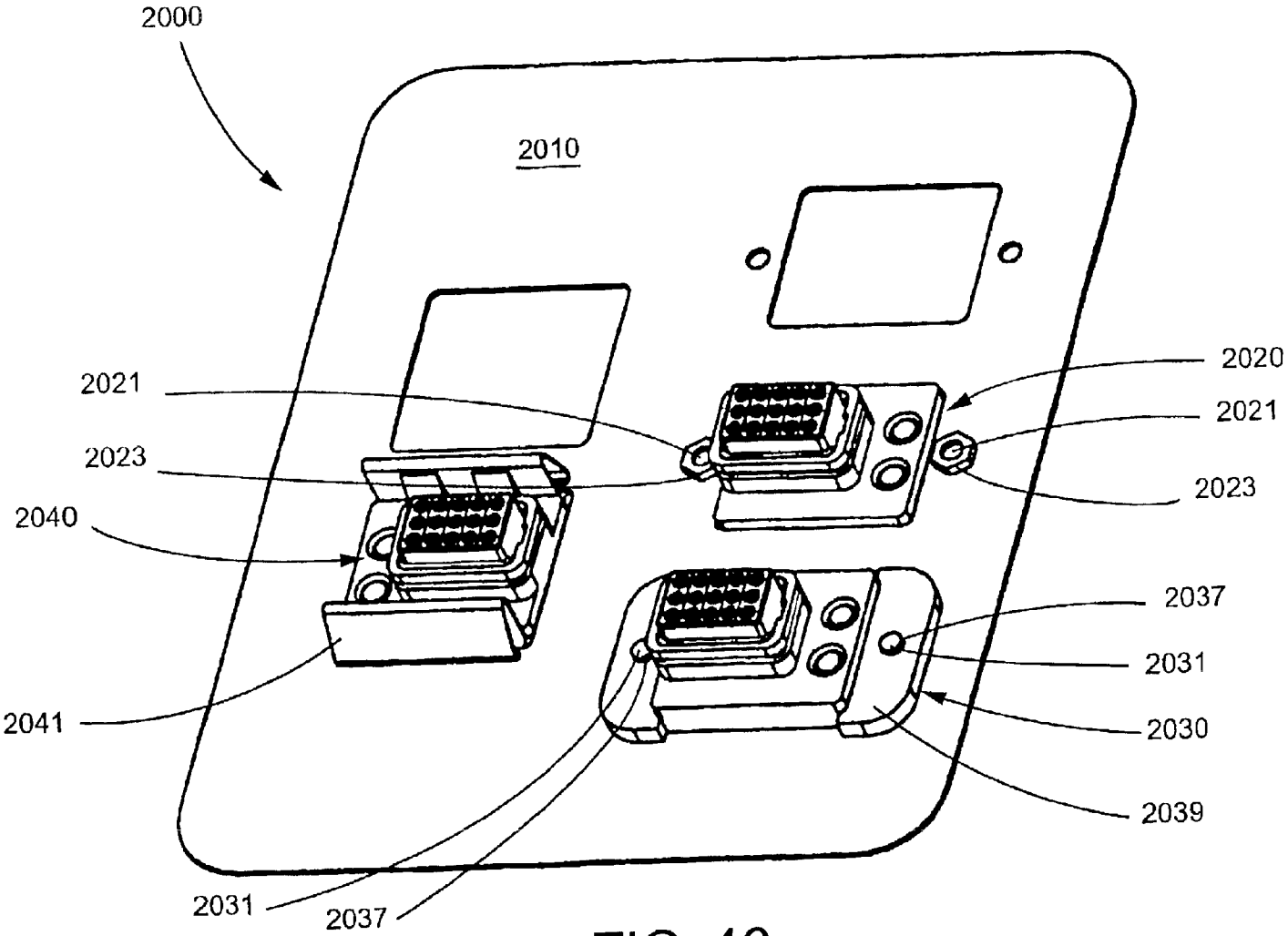
FIG. 46 is a perspective view of a wiring side of the panel and the plurality of receptacle assemblies in FIG. 45.

FIG. 46 shows the wiring surface 2010 of the panel 2000. The flange of the first receptacle assembly 2020 is not visible from the wiring surface 2010 of the panel 2000. A pair of nuts 2023 is threaded on the bolts 2021 to complete the mounting of the first receptacle assembly 2020 to the panel 2000 in one embodiment of mounting fasteners.

The flange 2039 of the second receptacle assembly 2030 is visible from the wiring surface 2010 of the panel 2000. The mounting holes 2037 of the flange 2039 are threaded to eliminate the need for nuts. The screws 2031 are threaded into the mounting holes 2037 in another embodiment of mounting fasteners.

The retaining clip 2041 is mounted to the panel 2000 and removably retains the third receptacle assembly 2040.

Figure 47:
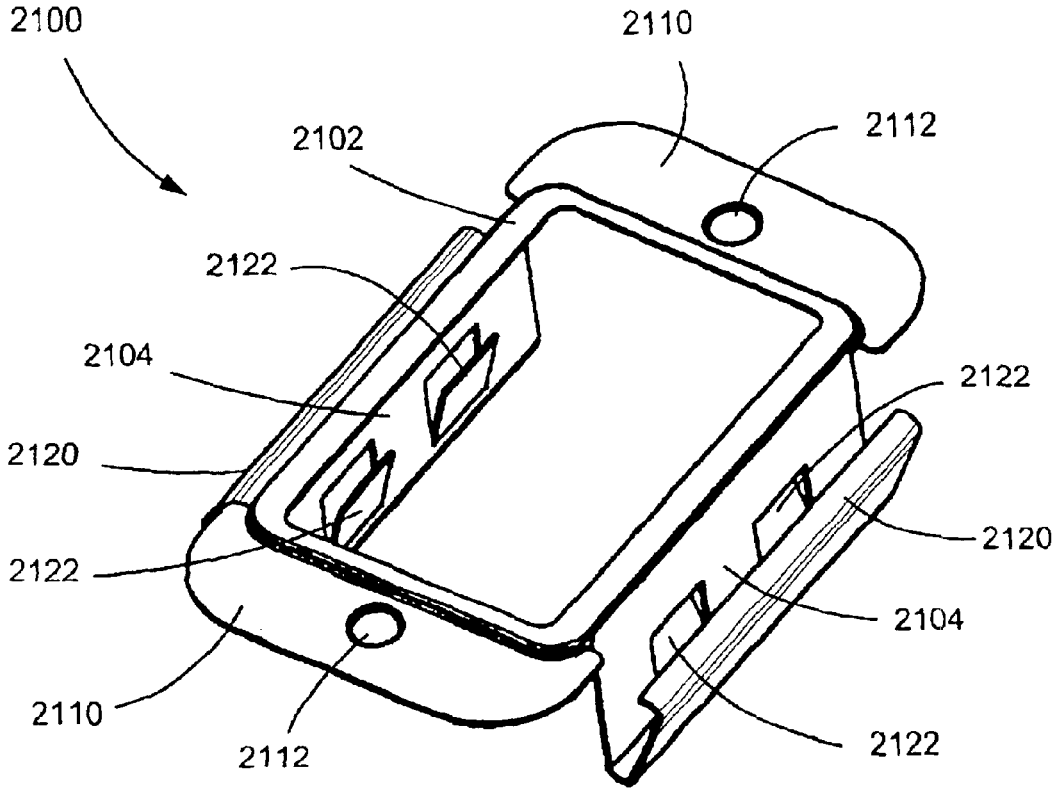
FIG. 47 is a perspective view of a retaining clip.

FIG. 47 depicts the retaining clip 2041. The retaining clip 2041 includes a frame 2102 and a pair of resiliently flexible sidewalls 2104 depending from the frame 2102. The frame 2102 includes a pair of mounting ears 2110. Each mounting ear 2110 includes a mounting dimple 2112. Each sidewall 2104 includes a panel latching member 2120 and a pair of receptacle supports 2122. The latching members 2120 allow the retaining clip 2041 to be removably attached to a mounting surface such as a panel. In addition, the receptacle supports 2122 allow the retaining clip 2041 to be removably attached to the receptacle housing. Once in place, the mounting dimple 2112 can position the retaining clip 2041 on the receptacle housing with respect to the mounting holes of the receptacle housing such that the mounting holes are covered by the retaining clip 2041, thereby providing an inspector a clear visual indication that the receptacle is push mounted.

Figure 48:
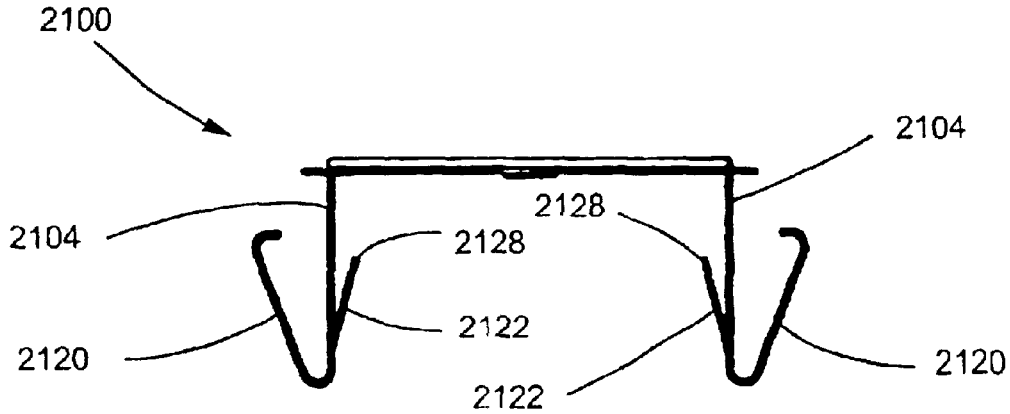
FIG. 48 is an end elevational view of the retaining clip in FIG. 47.

Referring to FIG. 48, the panel-latching members 2120 project away from each other. Free ends 2128 of the socket supports 2122 of each sidewall 2104 project inwardly toward the opposing sidewall 2104.

Figure 49:
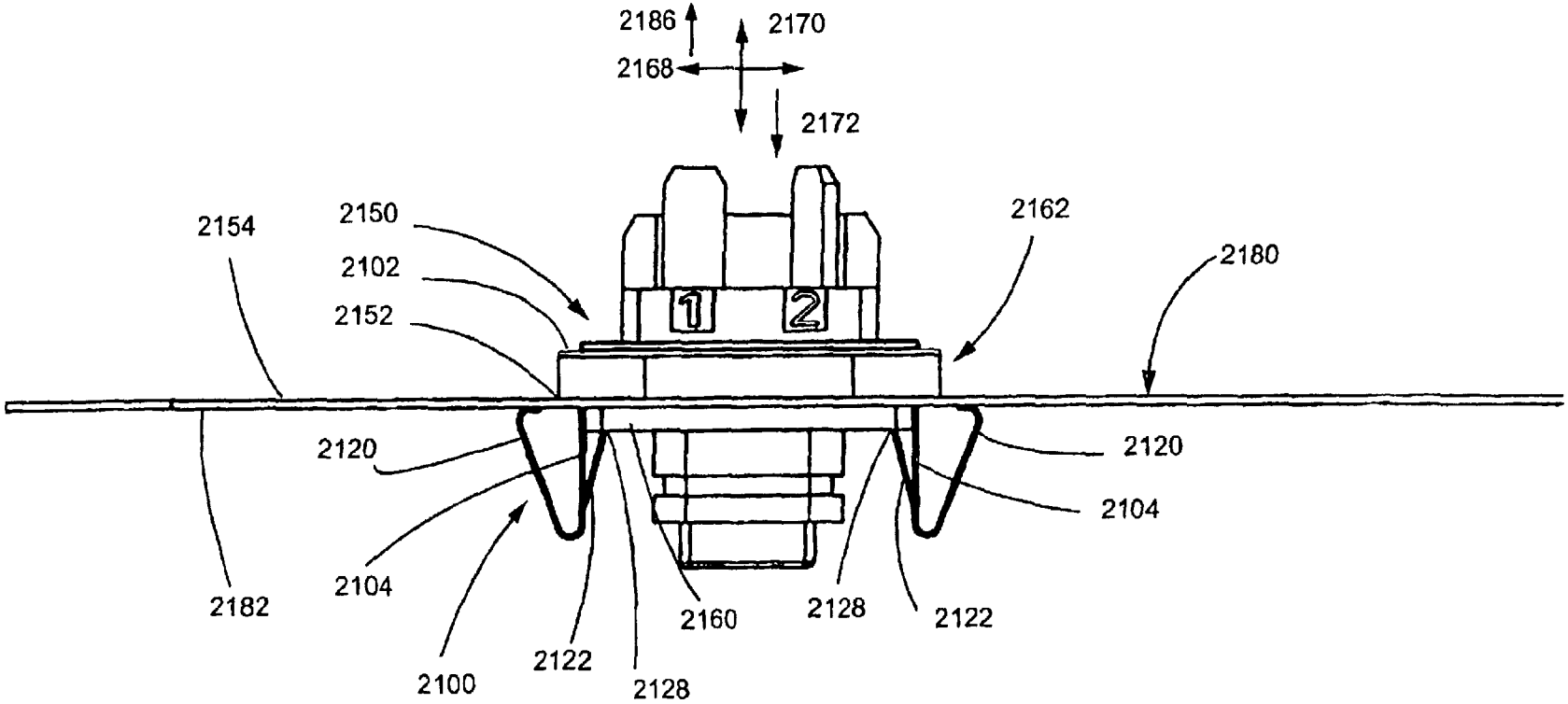
FIG. 49 is a side elevational view of a receptacle assembly mounted to a panel by the retaining clip in FIG. 47.

FIG. 49 shows a receptacle assembly 2150 push mounted to a panel by the retaining clip. The receptacle assembly 2150 is disposed in a cutout 2152 of a panel 2154 and is "push" mounted to the panel 2154 by the retaining clip 2041. The retaining clip 2041 engages a flange 2160 of a receptacle housing 2162 of the receptacle assembly 2150 to removably retain the receptacle assembly 2150. The receptacle supports 2122 deflect while mounting the receptacle assembly to the retaining clip 2041 and return to their normal position once the flange of the receptacle housing is clear of the receptacle supports 2122. The receptacle supports 2122 provide support for the receptacle assembly 2150 along a vertical axis 2170 and prevent the receptacle assembly 2150 from moving in a downward direction 2172. The frame 2102 of the retaining clip 2041 is disposed above the flange 2160 of the receptacle housing 2162 of the receptacle assembly 2150. The frame 2102 and the receptacle supports 2122 trap the flange 2160 of the receptacle housing 2162 to retain the receptacle assembly 2150 and to prevent the receptacle assembly 2150 from moving in a removal direction 2186.

The retaining clip 2041 can be removably attached to the panel 2154 by pushing the retaining clip 2041 through the cutout 2152 in the panel 2154 from a mating surface 2180 of the panel 2154 in the downward direction 2172. The panel-latching members 2120 deflect inwardly toward each other to allow the retaining clip 2041 to be inserted into the cutout 2152. Once the panel-latching members 2120 move past the cutout 2154 in the downward direction 2172, they return toward their normal position. The panel-latching members 2120 are placed in interfering arrangement with a wiring surface 2182 of the panel 2154 to removably retain the retaining clip 2041 with respect to the panel 2154. The panel 2154 supports the receptacle assembly 2150 along a vertical axis 2170 and prevents the receptacle assembly 2150 from moving in the downward direction 2172.

The frame 2102 of the retaining clip 2041 is disposed above the flange 2160 of the receptacle housing 2162 of the receptacle assembly 2150. The frame 2102 and the panel-latching members 2120 trap the panel 2154 to retain the receptacle assembly 2150 and to prevent the receptacle assembly 2150 from moving in a removal direction 2186. To remove the retaining clip 2041 the sidewalls 2104 can be moved inwardly to allow the retaining clip 2041 to moved in the removal direction 2186 along the vertical axis 2170.

Figure 50:
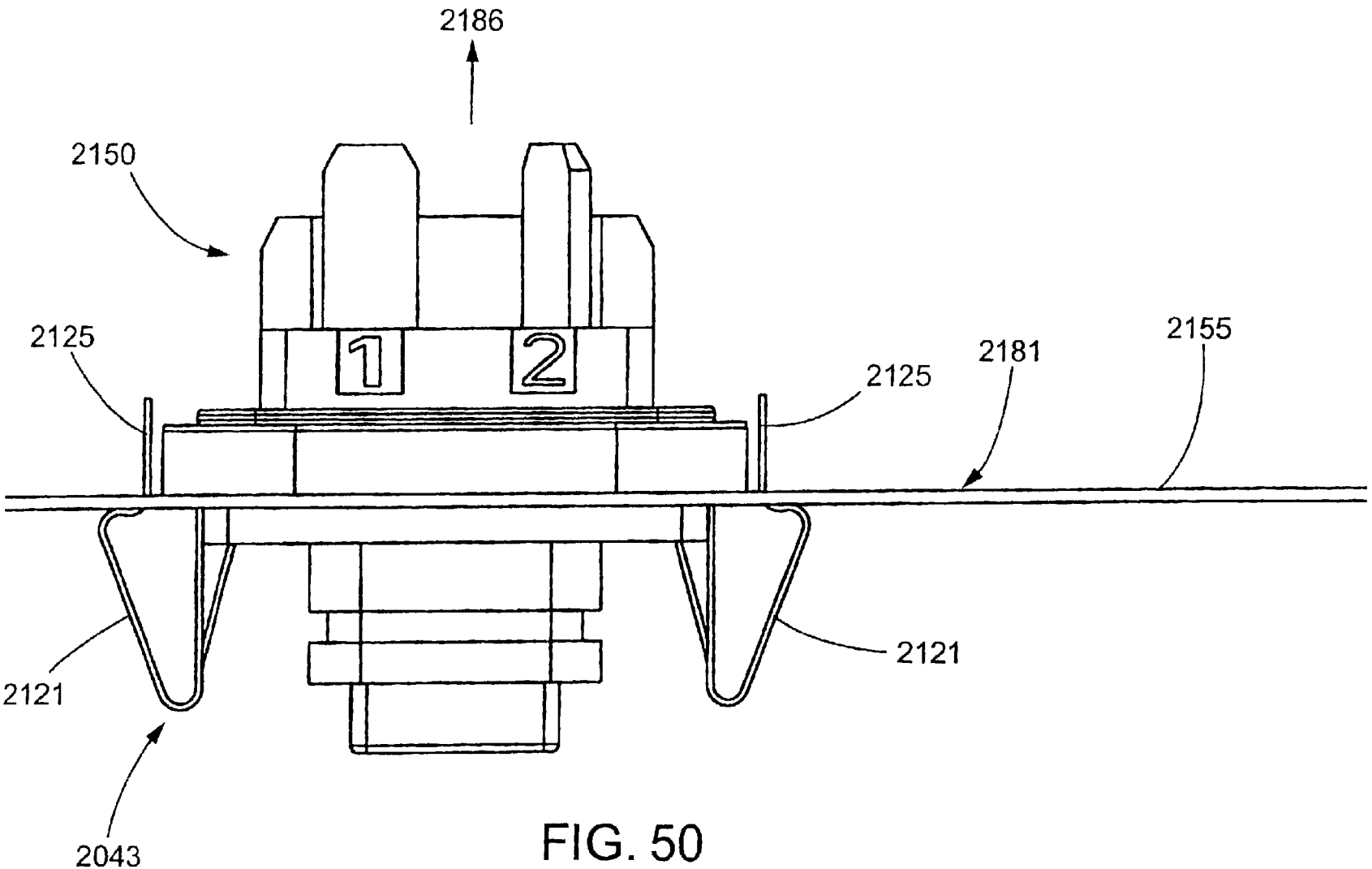
FIG. 50 is a side elevational view of another embodiment of a retaining clip shown in use retaining a receptacle assembly and mounted to a panel.

Referring to FIG. 50, another embodiment of a retaining clip 2043 is shown. The panel-latching members 2121 include a pair of tabs 2125 projecting in the removal direction 2186. The tabs 2125 extend from a mating surface 2181 of a panel 2155 when the retaining clip 2043 is removably attached to the panel 2155. The tabs 2125 can be operated from the mating surface 2181 of the panel 2155 to facilitate the removal of the receptacle assembly 2150 and the retaining clip 2043 from the panel 2155.

Figure 51:
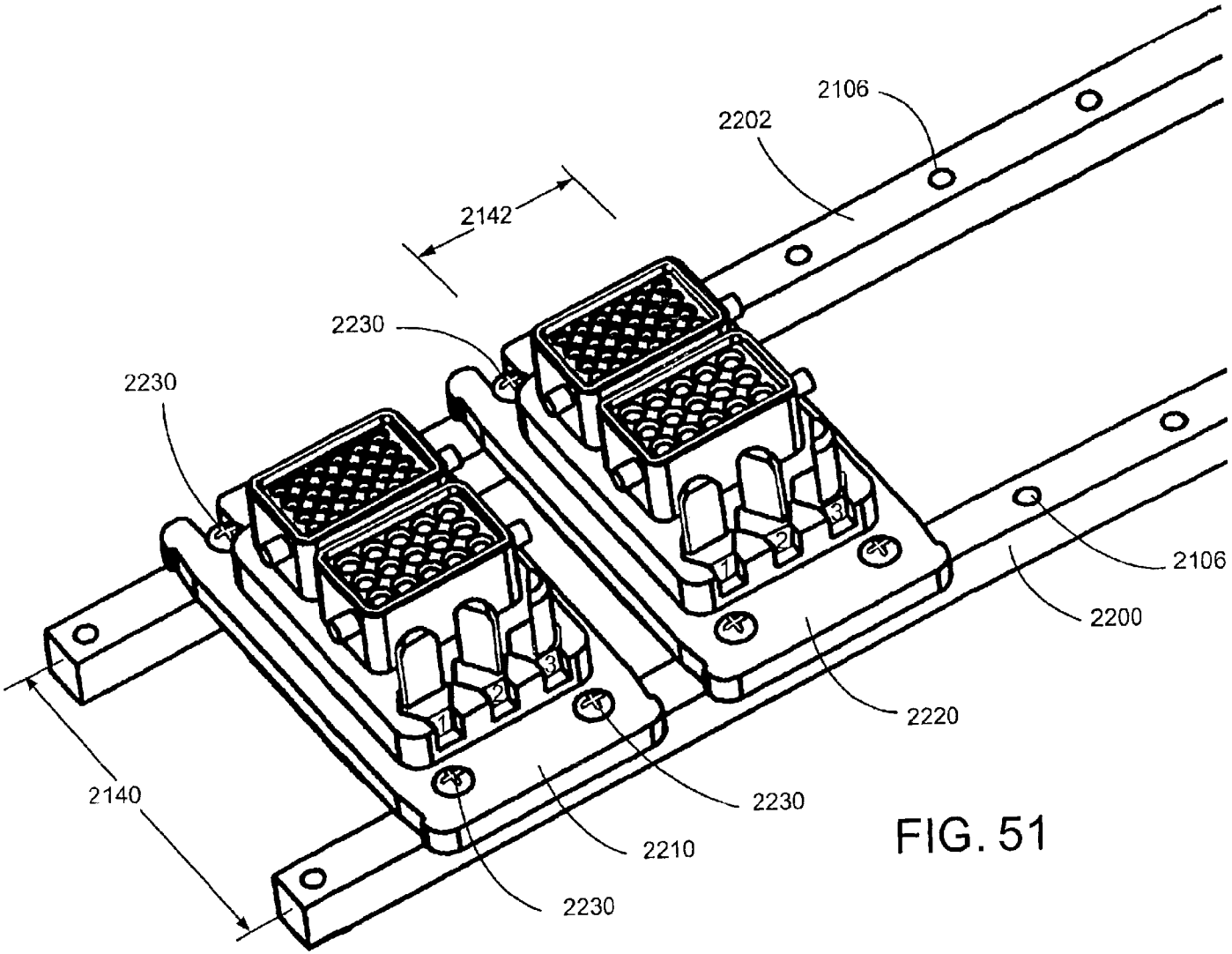
FIG. 51 is a perspective view of a plurality of receptacle assemblies mounted to a pair of rails.

Referring to FIG. 51, one embodiment of rail mounting, i.e., mounting the receptacle assembly on a pair of rails, is depicted. Two parallel rails 2200, 2202 are in substantially parallel spaced relation to each other. The rails 2200, 2202 can be mounted to another mounting surface, such as a panel. Each rail 2200, 2202 includes a plurality of mounting holes 2106. Each mounting hole is arranged in spaced-apart relationship to any adjacent mounting hole along its rail. A first receptacle assembly 2210 and a second receptacle assembly 2220 are mounted to the rails 2200, 220 by a plurality of screws 2230. The rails 2200, 2202 are spaced a distance apart from each other a first distance 2140 and the mounting holes of the rails 2200, 2202 are in spaced relationship to each other a second distance 2142 so that the mounting holes and the mounting slots of the socket assemblies can align with the mounting holes 2106 of the rails 2200, 2202. Rail mounting can reduce costs by eliminating the need for custom panels.

Figure 52:
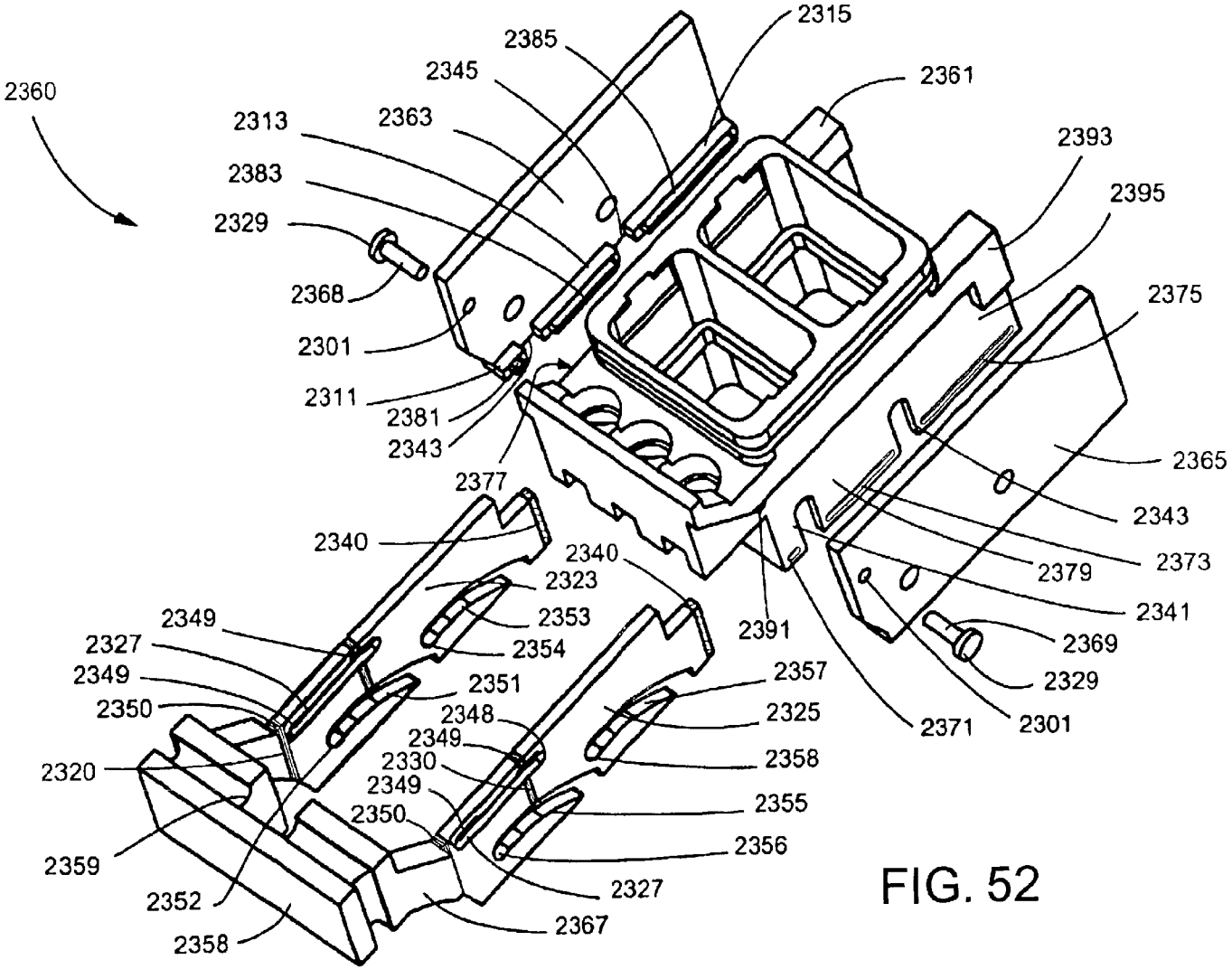
FIG. 52 is an exploded view of a plug housing assembly.

FIG. 52 depicts a plug housing assembly 2360. The plug housing assembly 2360 includes a plug housing 2361, a pair of cover plates 2363, 2365, a coupler 2367, and a pair of retaining pins 2368, 2369. The plug housing assembly 2360 can be pre-assembled by the manufacture with the user installing the appropriate number of inserts, contacts, and polarizing keys. In this embodiment, the cover plates 2363, 2365 can be snap-fit to the plug housing 2361. The plug housing 2361 includes a plurality of apertures 2371, 2373, 2375 on opposing side walls 2377, 2379. Each cover plate 2363, 2365 includes a plurality of tabs 2381, 2383, 2385 that are configured to snap, respectively, into the apertures 2371, 2373, 2375 on the opposing side walls 2377, 2379. In other embodiments, the apertures can serve as an indices to align the cover plates. The cover plates can be mounted to the housing using mechanical fasteners or other techniques.

The side walls 2377, 2379 of the plug housing. 2361 each include a retaining pin aperture 2391, a lip 2393, and a recess 2395. The cover plates 2363, 2365 each include a retaining pin opening 2301. The tabs 2381, 2383, 2385 of each cover plate 2363, 2365 extend from a respective plurality of standoffs 2311, 2313, 2315.

The coupler 2367 acts as a cam member. The coupler 2367 includes a pair of arms 2323, 2325. Each arm 2323, 2325 includes a slot 2327. Each retaining pin 2368, 2369 can be mounted to the plug housing 2361 to movably mount the coupler 2367 to the plug housing 2361.

The first retaining pin 2368 can extend through the retaining pin opening 2301 of the first cover plate 2363, the slot 2327 of the first arm 2323 of the coupler 2367 and the retaining pin aperture of the first side wall 2377 of the plug housing 2361. The standoffs 2311, 2313, 2315 of the first cover plate 2363 contact the first side wall 2377 of the plug housing 2361. The lip of the first side wall 2377 contacts the first cover plate 2363. A channel is defined between the first cover plate 2363 and the first side wall 2377 in which the first arm 2323 of the coupler 2367 is disposed. A head 2329 of the first retaining pin 2368 is larger than the retaining pin opening 2301 of the first cover plate 2363. The first pin 2368 is retained by a plurality of crush ribs, for example. The pin 2368 helps to secure the cover plate 2363 to the plug housing 2361.

The second retaining pin 2369 can extend through the retaining pin opening 2301 of the second cover plate 2365, the slot 2327 of the second arm 2325 of the coupler 2367 and the retaining pin aperture 2391 of the second side wall 2379 of the plug housing 2361. The standoffs of the second cover plate 2363 contact the second side wall 2379 of the plug housing 2361. The lip 2393 of the second side wall 2379 contacts the second cover plate 2365. A channel is defined between the second cover plate 2365 and the second side wall 2379 in which the second arm 2325 of the coupler 2367 is disposed. A head 2329 of the first retaining pin 2368 is larger than the retaining pin opening 2301 of the second cover plate 2365. The second pin 2369 is retained by a plurality of crush ribs, for example. The second pin 2369 helps to secure the cover plate 2365 to the plug housing 2361.

Each side wall 2377, 2379 of the plug housing 2361 includes a pair of notches 2341, 2343. The notches 2341, 2343 can accommodate bayonet pins of the receptacle housing 1410 shown in FIG. 34 for coupling the receptacle housing 1410 to the plug housing assembly 2360. The standoffs 2311, 2313, 2315 of each cover plate 2363, 2365 define a pair of gaps 2345, 2347. The gaps 2345, 2347 of each cover plate 2363, 2365 align respectively with the notches 2341, 2343 of each side wall 2377, 2379 of the plug housing 2361 to define an area through which the bayonet pins of the receptacle housing can travel.

The coupler 2367 of the plug housing assembly 2360 can move between an open position and an engaged position. The retaining pins 2368, 2369 respectively engage the slot 2327 of each arm 2323, 2325 to limit the travel of the coupler 2367. When the retaining pins 2368, 2369 respectively contact a first end 2348 of the slot 2327 of each arm 2323, 2325, the coupler is in the open position. When the retaining pins 2368 respectively contact a second end 2350 of the slot 2327 of each arm 2323, 2325, the coupler is in the engaged position. Each slot 2327 includes a detent 2349 at each end 2348, 2350 for locking the coupler 2367 in the open position and the engaged position, respectively.

Figure 54:
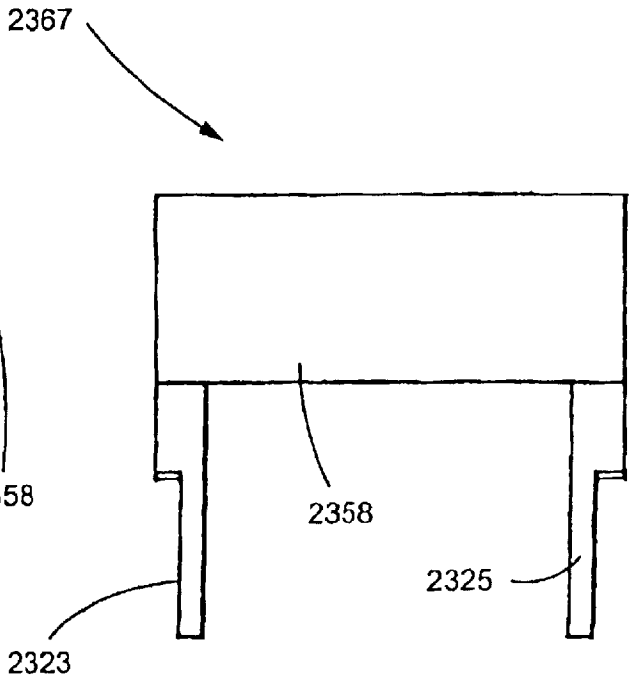
FIG. 54 is an end elevational view of the coupler in FIG. 53.
Figure 53:
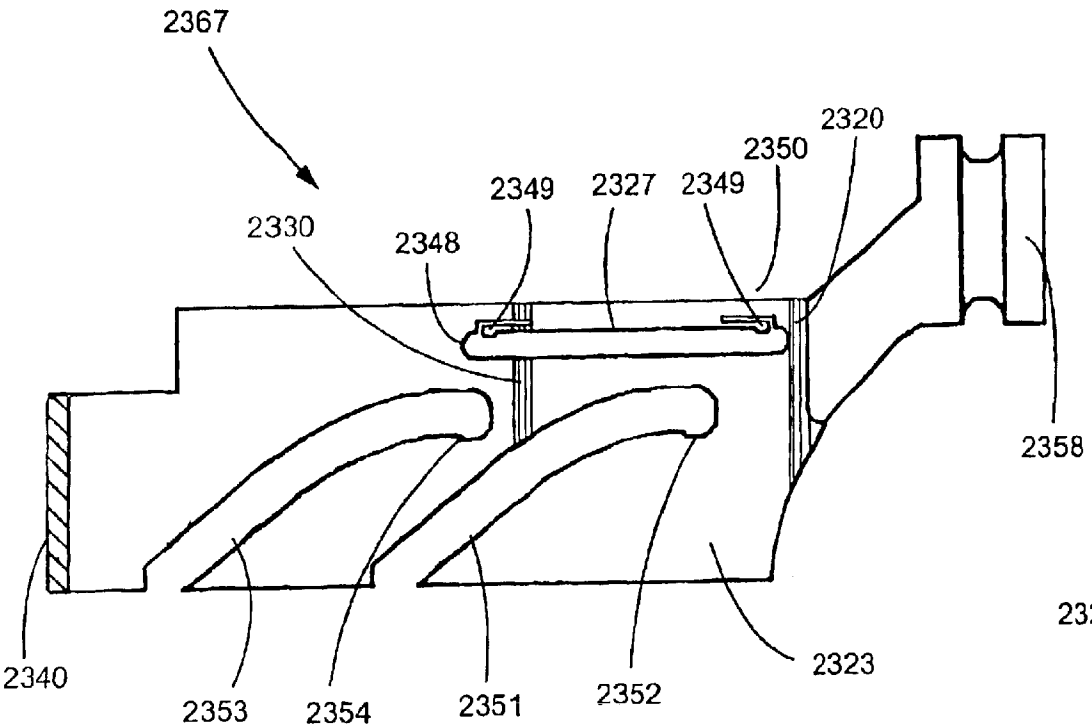
FIG. 53 is a side elevational view of a coupler.

Referring to FIGS. 52–54, the coupler 2367 can be operated to interconnect the plug housing assembly 2360 and a receptacle housing, such as the receptacle housing 1410 shown in FIG. 34. Each arm 2323, 2325 of the coupler 2367 includes a pair of cam grooves 2351, 2353, 2355, 2357 for engaging the bayonet pins 1421, 1423, 1425, 1427, respectively, to couple the receptacle housing 1410 shown in FIG. 34 to the plug housing assembly 2360 shown in FIG. 52. Each cam groove 2351, 2353, 2355, 2357 includes a recessed end 2352, 2354, 2356, 2358, respectively, for retaining the bayonet pins 1421, 1423, 1425, 1427, respectively, when the coupler 2367 is in the engaged position. The coupler 2367 includes a handle 2358 with a groove 2359. To move the coupler 2367, the user can operate the handle 2358.

The arms 2323,2325 each include first, second, and third indicator strips 2320, 2330, 2340 to signal the position of the coupler in order to provide a visual indication to identify when the coupler is in the open position, the engaged position, or a "near-engaged" position. The illustrative first and second indicator strips 2320, 2330 are both the color red. The third indicator strip 2340 is the color green. As will be discussed further herein, the first indicator strip 2320 can be used to notify the user that the coupler 2367 is in a "near-engaged" position. The second indicator strip 2330 can be used to notify the user that the coupler is in the open position. The third indicator strip 2340 can be used to notify the user that the coupler is in the engaged position.

Each of the indicator strips 2320, 2330, 2340 wrap around the respective arm 2323, 2325 such that they can be visible when viewed from multiple perspectives. It will be understood that the colors of the two strips can be varied. Also different indicia, other than color, such as letters, can be used to provide the visual signal.

Figure 55:
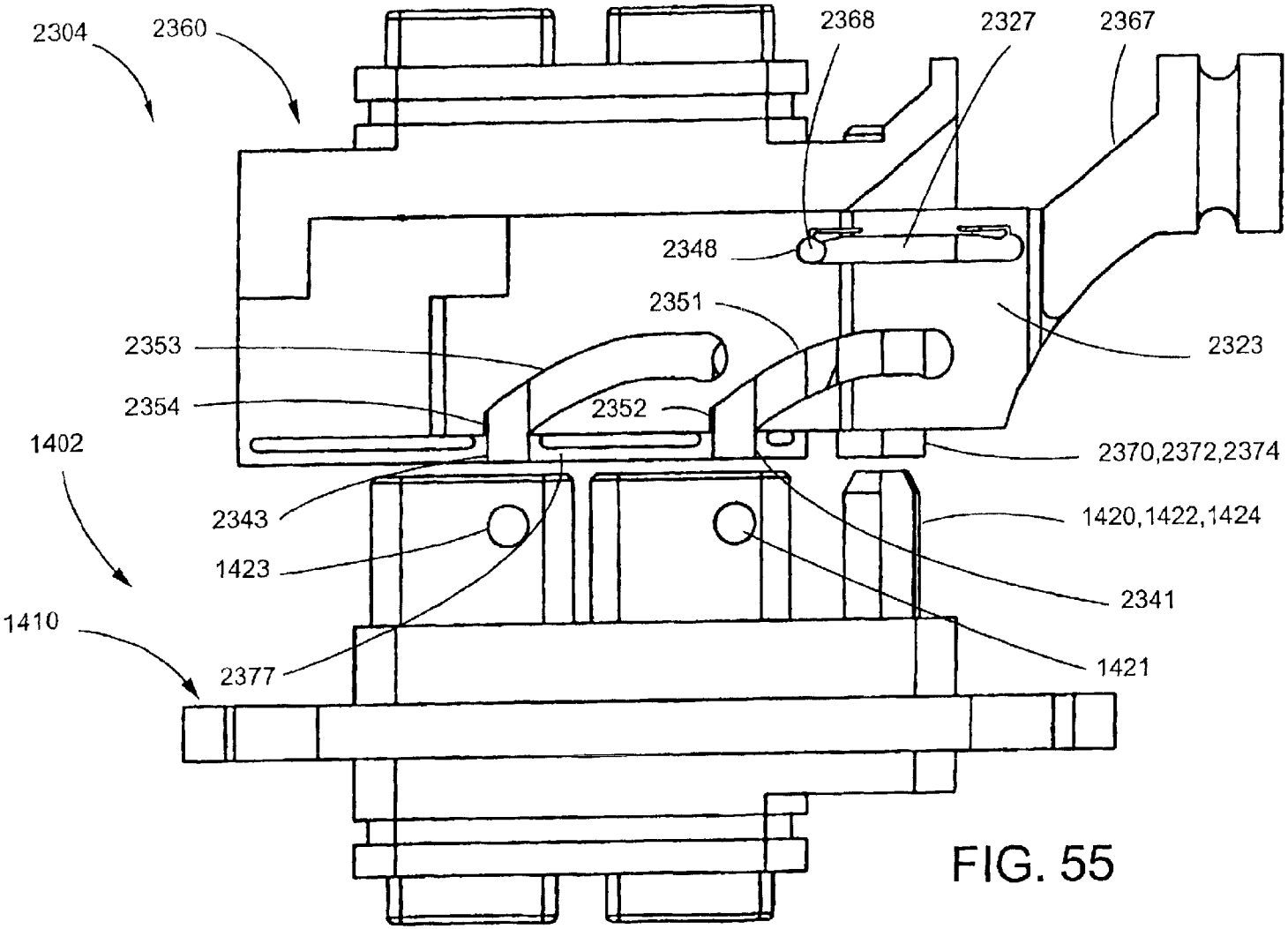
FIG. 55 is a side elevational view of a plug assembly with the covers removed for illustrative purposes and a receptacle assembly.

FIGS. 55–59 illustrate an interconnection sequence between a plug assembly 2304 including the plug housing assembly 2360 of FIG. 52 and a receptacle assembly 1402 including the receptacle housing 1410 as shown in FIG. 34. Referring to FIG. 55, the cover plates have been removed from the plug housing 2361 for illustrative purposes. The interconnection sequence will be described by specific reference to one side of the plug housing assembly 2360 and the receptacle housing 1410. It will be understood that the description of the one side is applicable to the other side as well. The first retaining pin 2368 is disposed at the first end 2348 of the slot 2327. The coupler 2367 is in the open position. The notches 2341, 2343 of the first side wall 2377 of the plug housing 2361 are aligned, respectively, with a pair of openings 2352, 2354 of the cam grooves 2351, 2353 of the first arm 2323 of the coupler 2367. The bayonet pins 1421, 1423 are aligned respectively with the notches 2341, 2343 of the plug housing 2361 and the openings 2352, 2354 of the coupler 2367.

A plurality of female polarizing keys 2370, 2372, 2374 of the plug housing assembly 2360 are aligned with, and are oriented to be mated with, respectively, a plurality of male polarizing keys 1420, 1422, 1424 of the receptacle housing 1410.

Figure 56:
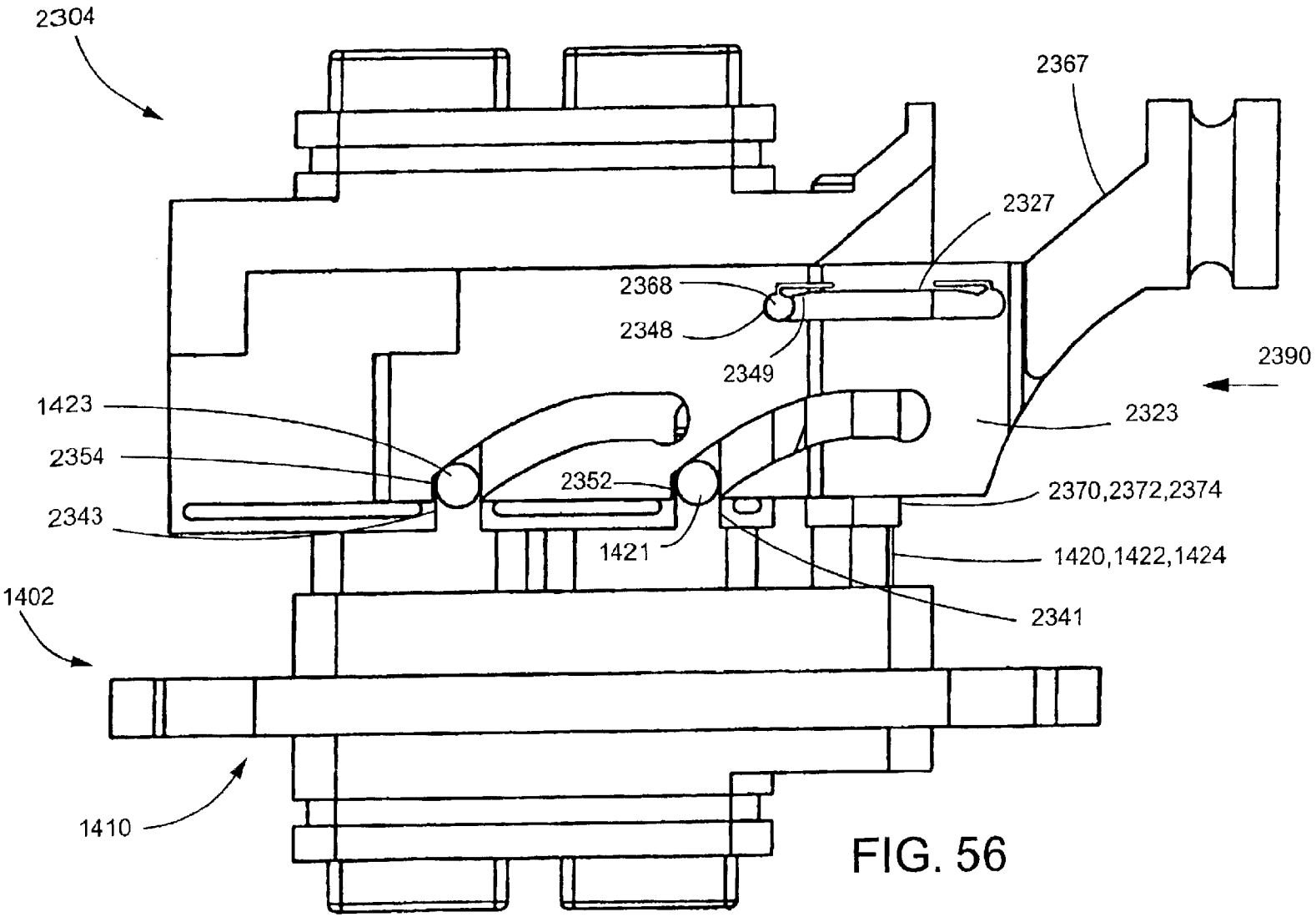
FIG. 56 is a side elevational view as in FIG. 55 showing the plug assembly in a pre-mounted position on the receptacle assembly.

Referring to FIG. 56, the plug assembly 2304 is in a pre-mounted position on the receptacle assembly 1402. The first retaining pin 2368 is disposed at the first end 2348 of the slot 2327. The coupler 2367 is in the open position. The retaining pin 23368 is engaged by the detent 2349 at the first end 2348. The detent 2349 acts to retain the coupler 2367 in the open position until a sufficient force is applied in a closing direction 2390.

The bayonet pins 1421, 1423 of the receptacle housing 1410 are disposed within the notches 2341, 2343 of the plug housing 2361 and the openings 2352, 2354 of the coupler 2367, respectively. The polarizing keys 1420, 1422, 1424 of the receptacle housing 1410 are partially inserted into, respectively, the polarizing keys 2370, 2372, 2374 of the plug housing assembly 2360.

Figure 57:
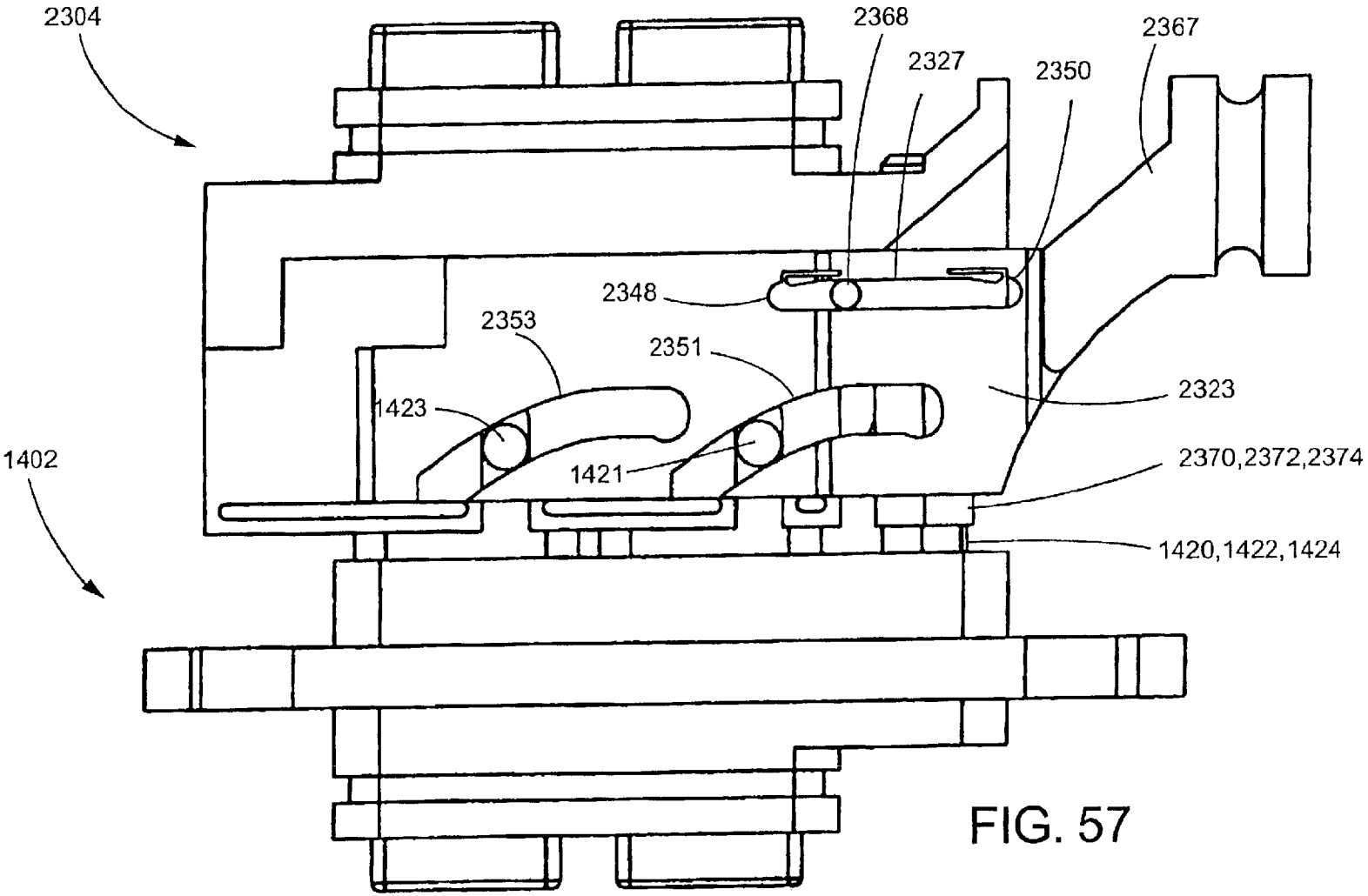
FIG. 57 is a side elevational view as in FIG. 55 illustrating the plug assembly in an intermediate position.

Referring to FIG. 57, the plug assembly 2304 is in an intermediate position on the receptacle assembly 1402. The first retaining pin 2368 is disposed at a position intermediate between the first end 2348 and the second end 2350 of the slot 2327 of the first arm 2323 of the coupler 2367. The coupler 2367 is in an intermediate position between the open position and the engaged position. The bayonet pins 1421, 1423 of the receptacle housing 1410 are disposed within the grooves 2351, 2353 of the coupler 2367, respectively. The grooves 2351, 2352 engage the bayonet pins 1421, 1423 to drive the plug assembly 2304 closer toward the receptacle assembly 1402 as the coupler 2367 is moved from the open position to the engaged position. The polarizing keys 1420, 1422, 1424 of the receptacle housing 1410 are further partially inserted into, respectively, the polarizing keys 2370, 2372, 2374 of the plug housing assembly 2360.

Figure 58:
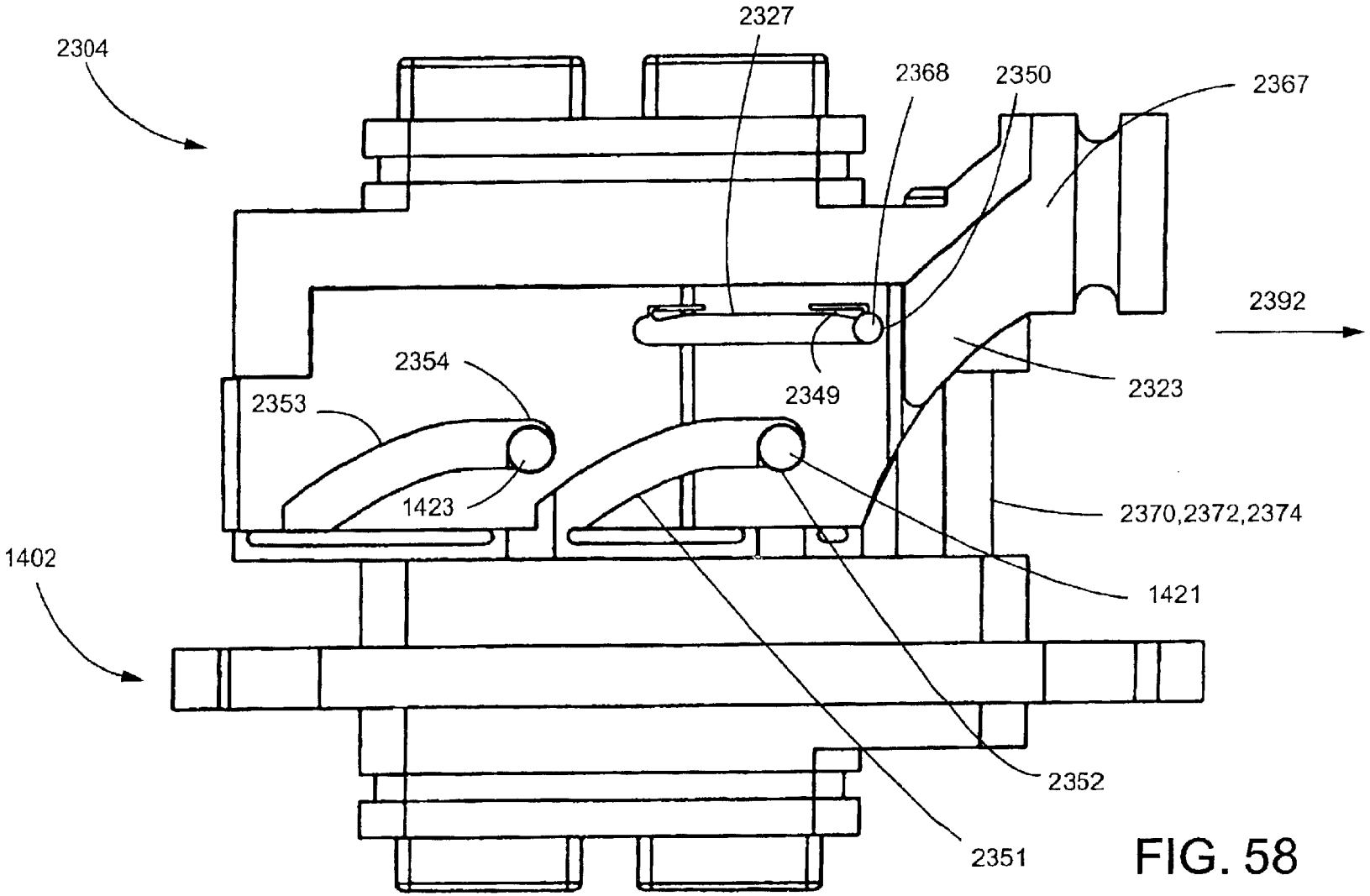
FIG. 58 is a side elevational view as in FIG. 55 illustrating the plug assembly in a fully seated position.

Referring to FIG. 58, the plug assembly 2304 is in an engaged position on the receptacle assembly 1402. The first retaining pin 2368 is disposed at the second end 2350 of the slot 2327 of the first arm 2323 of the coupler 2367. The coupler 2367 is in the engaged position. The retaining pin 2368 is engaged by the detent 2349 at the second end 2350. The detent 2349 acts to retain the coupler 2367 in the engaged position until a sufficient force is applied in an opening direction 2392.

The bayonet pins 1421, 1423 of the receptacle housing 1410 are disposed respectively within the recessed ends 2352, 2354 of the grooves 2351, 2353. The engagement between the recessed ends 2352, 2354 and the bayonet pins 1421, 1423, respectively provides another positive locking feature when the coupler 2367 is in the engaged position. The engagement of the detents 2349 and the bayonet pins 1421, 1423 provides a tactile signal to the user that the coupler is in the engaged position. The polarizing keys of the receptacle housing 1410 are fully seated in the polarizing keys 2370, 2372, 2374, respectively, of the plug housing assembly 2360. The plug assembly 2304 is interconnected to the receptacle assembly 1402. The contacts of the plug assembly 2304 are in respective electrical connection with the contacts of the receptacle assembly 1402.

Figure 59:
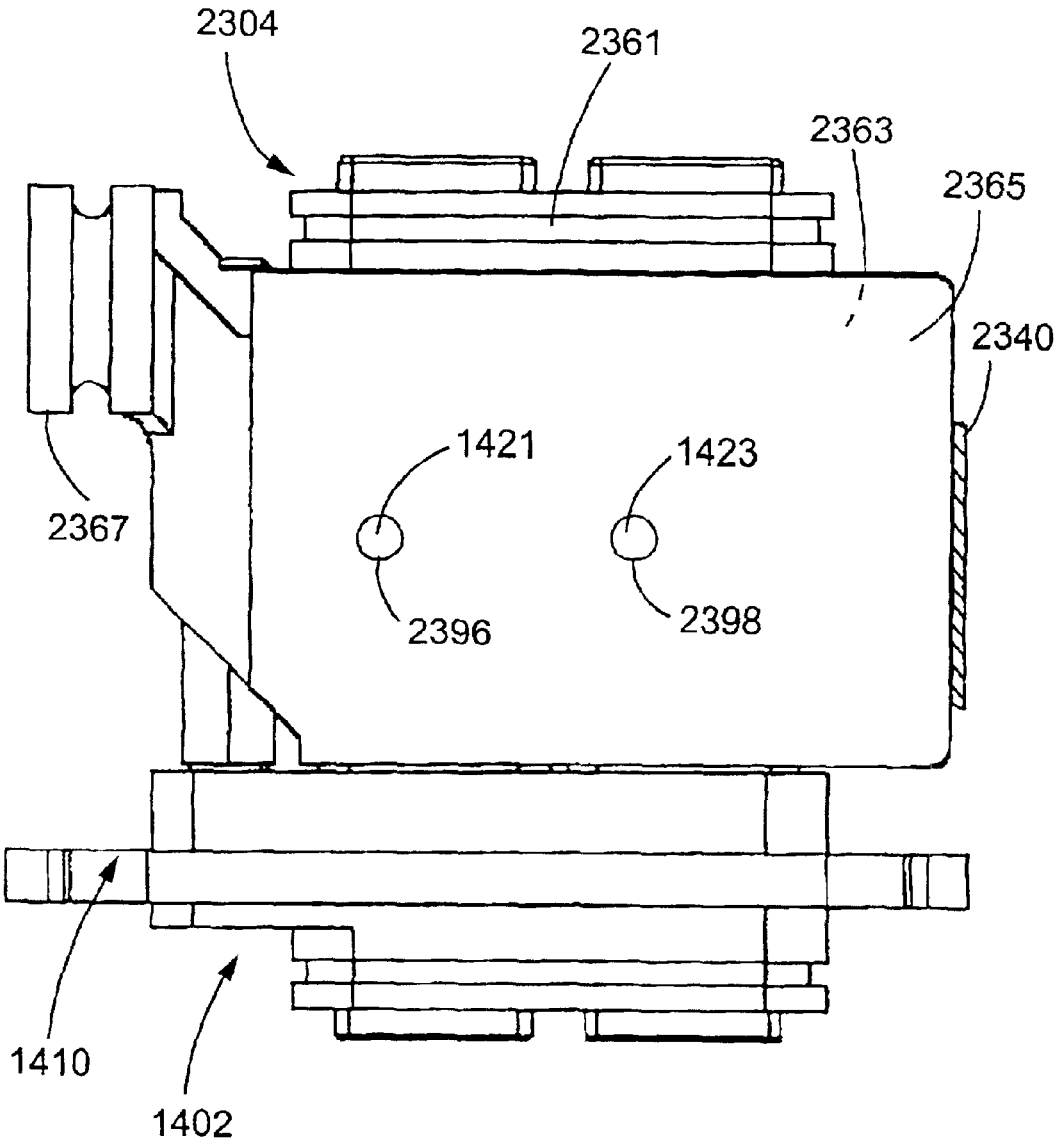
FIG. 59 is a side elevational view of the plug assembly interconnected to the receptacle assembly.

FIG. 59 depicts the plug assembly 2304 interconnected to the receptacle assembly 1402. The cover plates 2363, 2365 are shown in FIG. 59 mounted to the plug housing 2361. Each cover plate 2363, 2365 includes a pair of windows 2396, 2398 that are provided to display the bayonet pins 1421, 1423 of the receptacle housing 1410 when the plug assembly 2304 and the receptacle assembly 1402 are interconnected. The appearance of the bayonet pins 1421, 1423 in the windows 2396, 2398 of each cover plate 2363, 2365 provides a visual signal that there is a secure connection between the plug assembly 2304 the receptacle assembly 1402.

When the coupler 2367 is in the engaged position, the third indicator strip 2340 protrude from the cover plates 2363, 2365, respectively such that the third indicator strips are visible to a user. The first and second indicator strips are obscured by the respective cover plates 2363, 2365 such that they are not visible to a user. The visibility of only the third indicator strips 2340 can be used as a visual signal to confirm that the coupler 2367 is in the engaged position.

Figure 60:
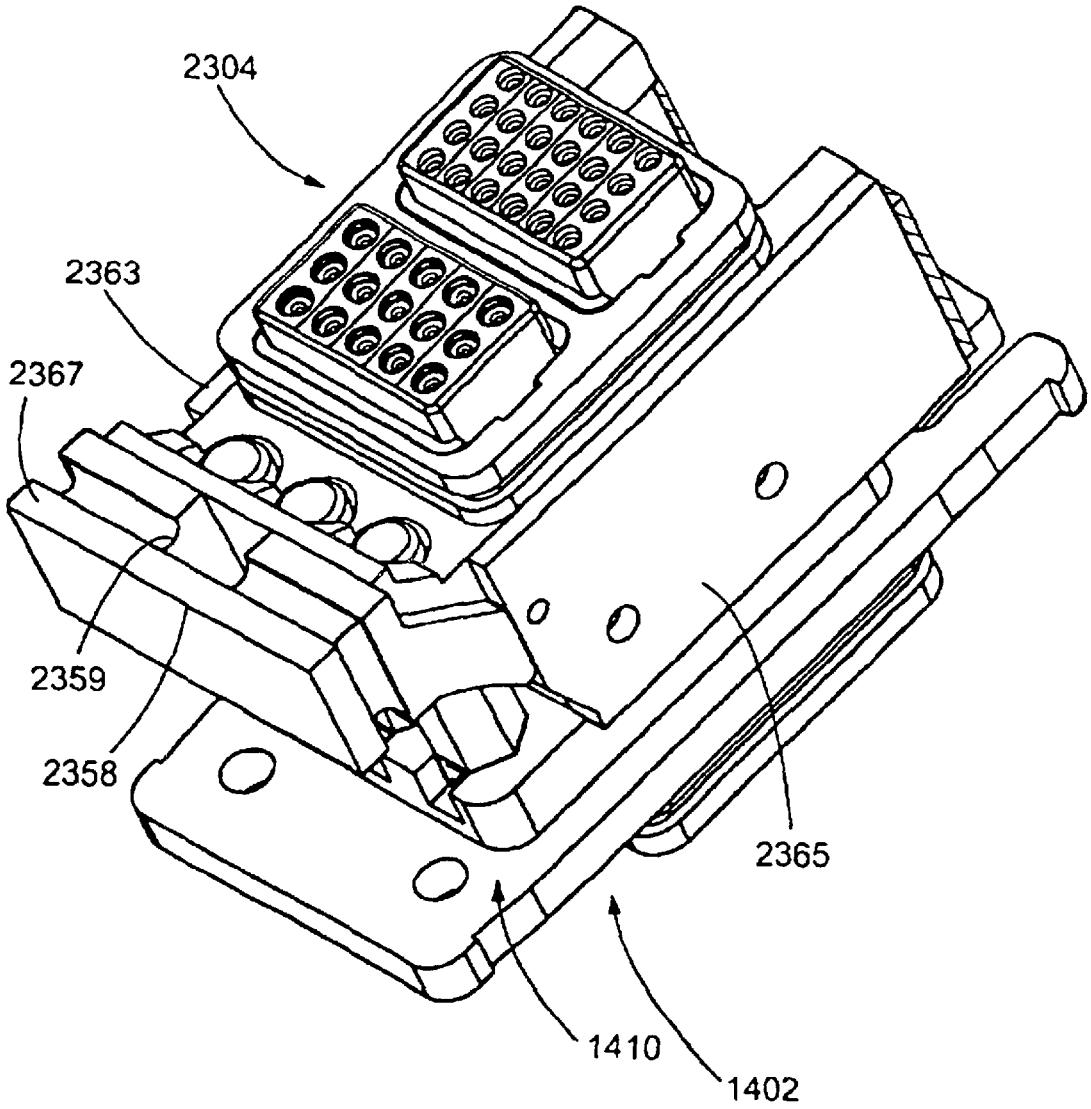
FIG. 60 is a perspective view of the plug assembly interconnected to the receptacle assembly.

Referring to FIG. 60, the coupler 2367 can be moved from the engaged position to the open position by hand or with common tools, such as a screwdriver. A screwdriver can be inserted in the groove 2359 of the handle 2358 and used as a pry bar to move the coupler from the engaged position toward the open position.

Figure 61:
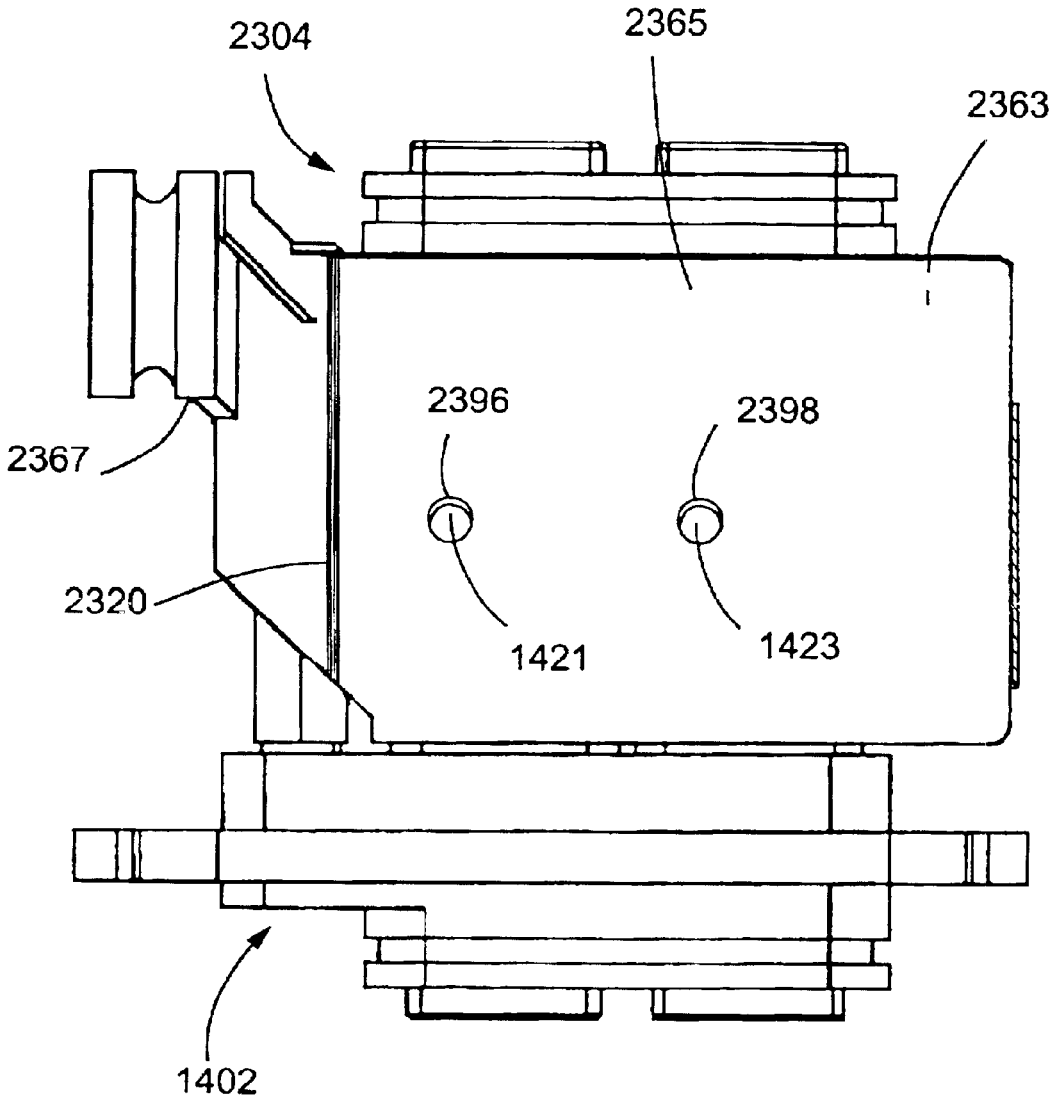
FIG. 61 is a side elevational view of the plug assembly mounted to the receptacle assembly with the coupler shown in a "near-engaged" position.

Referring to FIG. 61, the coupler 2367 is in a "near-engaged" position. In such a position, the plug assembly 2304 is slightly separated from being fully seated on the receptacle assembly 1402. The bayonet pins 1421, 1423 are partially obscured by the cover plates 2363, 2365 with only a portion of the pins 1421, 1423 visible through the respective apertures 2396, 2398. The first indicator strips 2320 protrude from the cover plates 2363, 2365 such that the first indicator strips 2320 are visible to a user. The visibility of the first indicator strips 2320 can be used as a visual signal to indicate that the coupler 2367 is in a "near-engaged" position.

Referring to FIG. 3, the coupler 290 of the plug assembly 204 is similar to construction to the coupler 2367 of the plug assembly 2302, shown in FIG. 61. The coupler 290 in FIG. 3 includes a pair of arms 291, 293. Each arm 291, 293 includes a first indicator strip 295, a second indicator strip 297, and a third indicator strip. The second indicator strip 297 protrudes from the cover plates 281, 283 such that the second indicator strips 297 are visible to a user. The visibility of the second indicator strips 297 can be used as a visual signal to indicate that the coupler 290 is in the open position.

Referring to FIGS. 62–75, the polarization system includes a hexagonal-shaped male polarizing key 2400, as shown in FIGS. 62–66, and a hexagonal-shaped female polarizing key 2500, as shown in FIGS. 67–71. The polarization system provides an electrical component with a variable polarization code that is visible upon selecting the code by manipulating the keys of the polarizing assembly. The polarization system eliminates the secondary step of marking by the user. The polarization system is configured to provide a large number of polarizing options that can be easily set and/or changed by a user with minimal effort and cost. The polarizing keys 2400, 2500 can be installed in any housing by hand and can be removed in seconds by a standard tool. Windows provided in the housings allow the indicia providing the keying code to be readily visible.

By being easily removable and bearing a plurality of indicia with each indicium corresponding to a different polarity of the respective polarizing key, the polarizing system allows the user to change the polarity to a different keying code that is easily visible through the respective windows of the housings without requiring the user to re-mark the housings with the new keying code.

Figure 72:
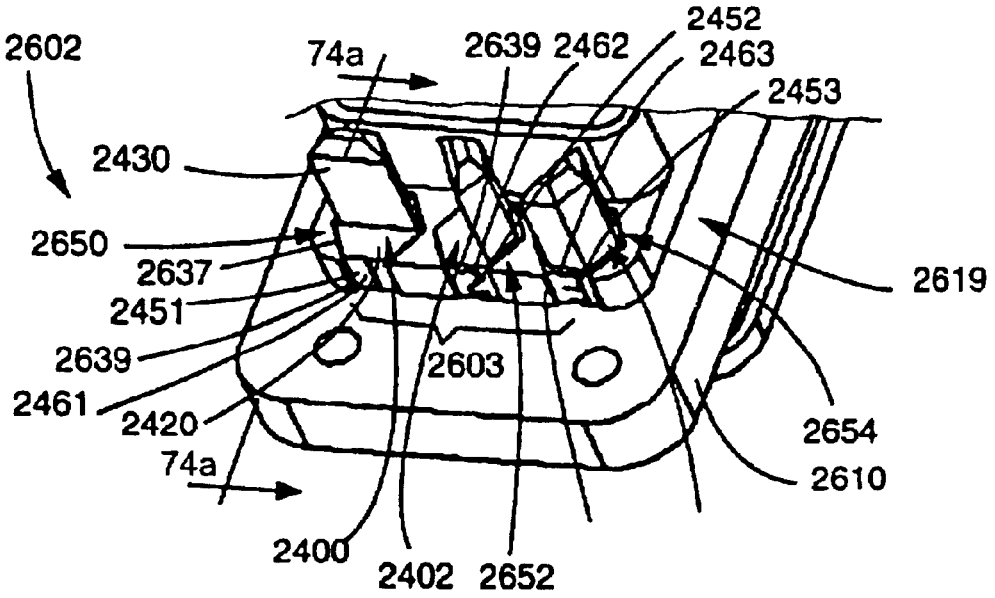
FIG. 72 is a perspective view of a receptacle assembly having a plurality of male polarizing keys.
Figure 73:
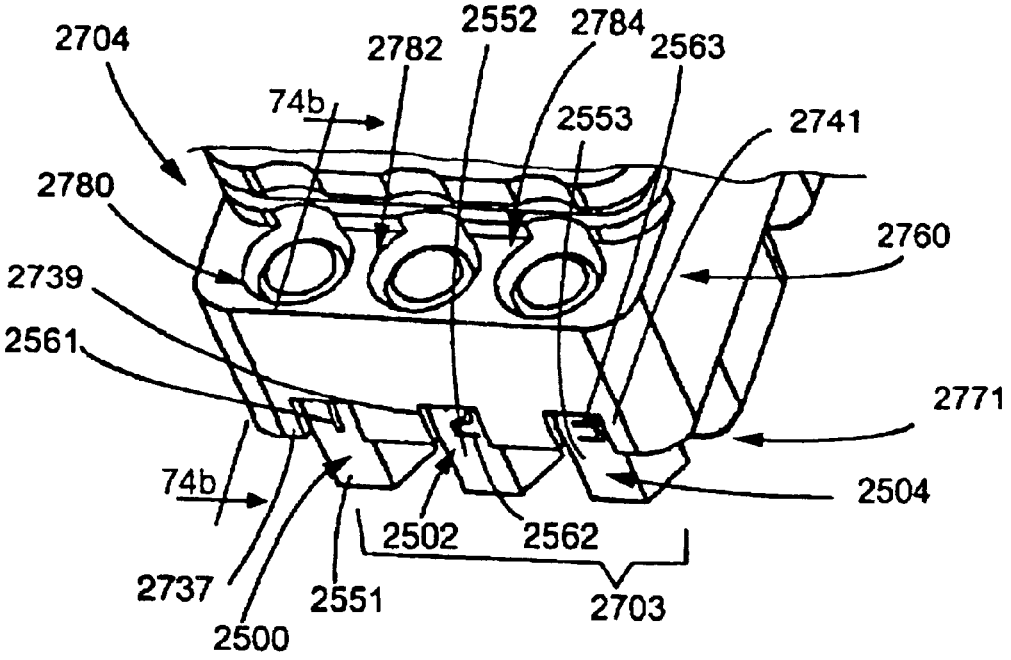
FIG. 73 is a perspective view of a plug assembly having a plurality of female polarizing keys.

In use, as shown in FIGS. 72–75, the polarizing keys can be ganged together to provide polarizing assemblies. Referring to FIG. 72, a receptacle assembly 2602 can include a receptacle housing 2610 and a male polarizing assembly 2603 that includes three male polarizing keys 2400, 2402, 2404. Referring to FIG. 73, a plug assembly 2704 can include a plug housing 2760 and a female polarizing assembly 2703 that includes three female polarizing keys 2500, 2502, 2504. An embodiment of a polarizing key with n faces will have n polarities. A polarizing assembly with 2 n-faced keys will have $n^2$ polarities. A polarizing assembly with 3 n-faced keys will have $n^3$ polarities. And in general, a polarizing assembly with m n-faced keys will have $n^m$ polarities. Three hexagonal-shaped keys for each assembly 2603, 2703 provide 216 possible polarized mating combinations. The number of polarizing keys in a respective assembly can be varied.

Referring to FIGS. 62–66, the illustrative male polarizing key 2400 is shown. The male polarizing key 2400 is representative of the male polarizing keys used in the polarizing system. The male polarizing key 2400 includes a base 2410, an indicia portion 2420, and a polarizing portion 2430.

Figure 64:
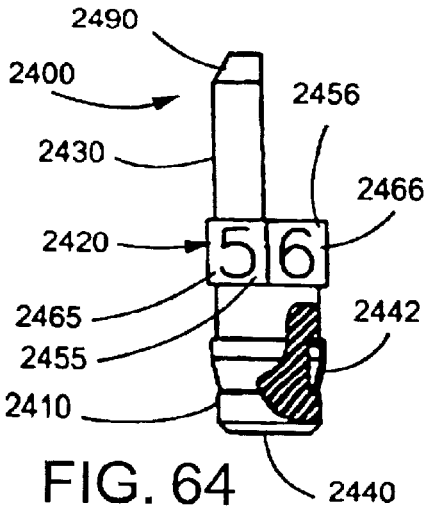
FIG. 64 is a side elevational view of the male polarizing key in FIG. 62.
Figure 63:
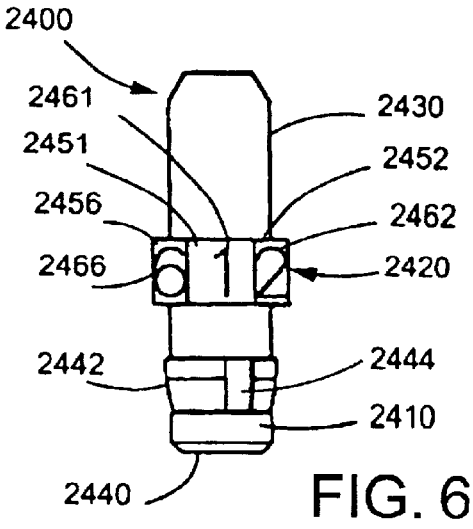
FIG. 63 is a front elevational view of the male polarizing key in FIG. 62.
Figure 66:
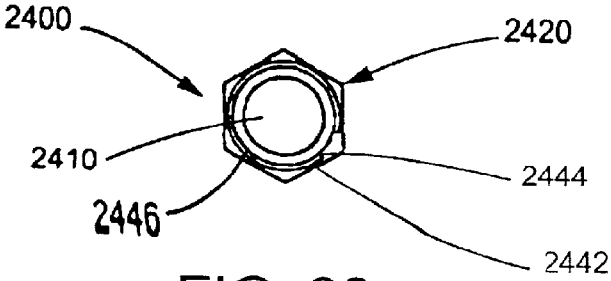
FIG. 66 is a bottom plan view of the male polarizing key in FIG. 62.

Referring to FIGS. 63, 64, and 66, the base 2410 includes a chamfered end 2440 and a resiliently flexible tapered collar 2442. The end 2440 is chamfered to facilitate installation of the key 2400 in a polarity chamber of a receptacle housing, for example. The tapered collar 2442 is in longitudinal spaced relation to the indicia portion 2420. The tapered collar 2442 includes a slit 2444. The slit 2444 allows the collar 2442 to deflect inwardly to reduce its transverse perimeter 2446, as shown in FIG. 66, during installation of the key 2400 into a polarity chamber of a receptacle housing.

Figure 65:
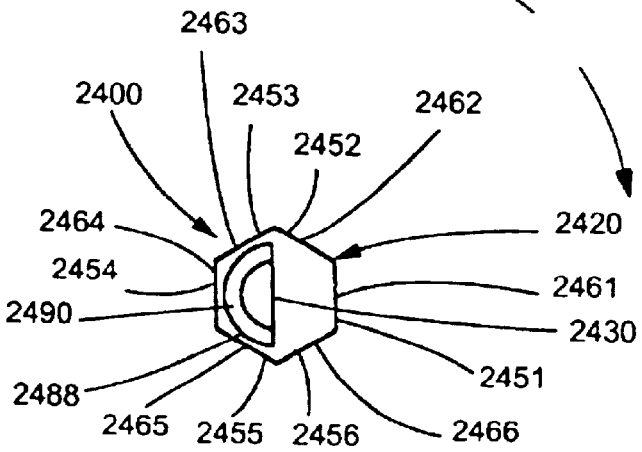
FIG. 65 is a top plan view of the male polarizing key in FIG. 62.
Figure 62:
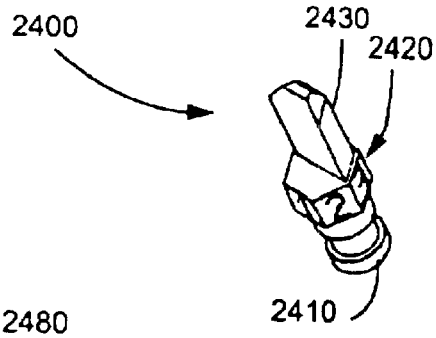
FIG. 62 is a perspective view of a male polarizing key.

Referring to FIGS. 63–65, the indicia portion 2420 can have a plurality of faces 2451, 2452, 2453, 2454, 2455, 2456. Each face 2451, 2452, 2453, 2454, 2455, 2456 has an indicium 2461, 2462, 2463, 2464, 2465, 2466, respectively. The illustrative key 2400 includes six faces 2451, 2452, 2453, 2454, 2455, 2456 providing the indicia portion 2420 with a hexagonal-shaped transverse perimeter 2470, as shown in FIG. 65. In other embodiments, the number of faces can be varied. For example, the number of faces could be two, three, four, five, seven, or more. The indicium can be any suitable unique identifier, such as, a number, a letter, a shape, or other identifying mark. Each indicium 2461, 2462, 2463, 2464, 2465, 2466 is different than the other indicia 2461, 2462, 2463, 2464, 2465, 2466 of the other faces 2451, 2452, 2453, 2454, 2455, 2456 of the polarizing key 2400.

In the illustrative key 2400, the six faces 2451, 2452, 2453, 2454, 2455, 2456 each include a different number as the indicium 2461, 2462, 2463, 2464, 2465, 2466, respectively. For convenient use, the first face 2451 includes the number "1" indicium 2461. Each successive adjacent face 2452, 2453, 2454, 2455, 2456, moving in a counter clockwise direction 2472 as shown in FIG. 65, includes a number indicium 2462, 2463, 2464, 2465, 2466, respectively, that increases by an integer of 1. The sixth face 2456 includes the number "6" indicium 2466. Non-sequential numbering or lettering can be used in other embodiments.

Referring to FIG. 72, the indicia are oriented such that the indicia are in an upright position to be easily read by a user from a mating side 2619 of the receptacle housing 2610 when the polarizing key 2400 is installed in the receptacle housing 2610.

Referring to FIGS. 63–65, the polarizing portion 2430 is a shaft that extends from the indicia portion 2420 to provide a male configuration for the key 2400. Referring to FIG. 65, the polarizing portion 2430 is disposed asymmetrically relative to the indicia portion 2420 such that rotating the key 2400 about its longitudinal axis, either in the counter clockwise direction 2472 or a clockwise direction 2480, changes the orientation, i.e., polarity, of the polarizing portion 2430.

The polarizing portion 2430 includes a perimeter 2488. The perimeter 2488 is generally semi-circular in shape. The perimeter 2488 of the key 2400 can be different shapes in other embodiments, such as trapezoidal-shaped, triangular-shaped, or ellipsoid-shaped. The polarizing portion 2430 includes a chamfered end 2490 to facilitate the mating of the male polarizing key 2400 and the female polarizing key 2500, which is shown in FIGS. 67–71.

Referring to FIGS. 67–71, the illustrative female polarizing key 2500 is shown. The female polarizing key 2500 is representative of the female polarizing keys used in the polarizing system. The female polarizing key 2500 includes a base 2510, an indicia portion 2520, and a polarizing portion 2530.

Referring to FIGS. 68, 69, and 71, the base 2510 includes a chamfered end 2540 and a resiliently flexible tapered collar 2542. The end 2540 is chamfered to facilitate installation of the key 2500 in a polarity chamber of a plug housing, for example. The tapered collar 2542 is in longitudinal spaced relation to the indicia portion 2520. The tapered collar 2542 is similar to, and of common construction as, the tapered collar 2442 as shown in FIGS. 62–66.

Referring to FIGS. 68–70, the indicia portion 2520 can have a plurality of faces 2551, 2552, 2553, 2554, 2555, 2556. Each face 2551, 2552, 2553, 2554, 2555, 2556 has an indicium 2561, 2562, 2563, 2564, 2565, 2566, respectively. The illustrative key 2500 includes six faces 2551, 2552, 2553, 2554, 2555, 2556 providing the indicia portion 2520 with a hexagonal-shaped transverse perimeter 2570, as shown in FIG. 70. In other embodiments, the number of faces can be varied. For example, the number of faces could be two, three, four, five, seven, or more. The indicium can be any suitable unique identifier, such as, a number, a letter, a shape, or other identifying mark. Each indicium 2561, 2562, 2563, 2564, 2565, 2566 is different than the other indicia 2561, 2562, 2563, 2564, 2565, 2566 of the other faces 2551, 2552, 2553, 2554, 2555, 2556 of the polarizing key 2500.

In the illustrative key 2500, the six faces 2551, 2552, 2553, 2554, 2555, 2556 each include a different number as the indicium 2561, 2562, 2563, 2564, 2565, 2566, respectively. For convenient use, the first face 2551 includes the number "1" indicium 2561. Each successive adjacent face 2552, 2553, 2554, 2555, 2556, moving in a counter clockwise direction 2572 as shown in FIG. 70, includes a number indicium 2562, 2563, 2564, 2565, 2566, respectively, that increases by an integer of 1. The sixth face 2556 includes the number "6" indicium 2566. Non-sequential numbering or lettering can be used in other embodiments.

The different numbered indicium 2561, 2562, 2563, 2564, 2565, 2566 of the six faces 2551, 2552, 2553, 2554, 2555, 2556, respectively of the female polarizing key 2500 can correspond respectively to the numbered indicium 2461, 2462, 2463, 2464, 2465, 2466 of the six faces 2451, 2452, 2453, 2454, 2455, 2456, respectively, of the male polarizing key 2400.

Referring to FIG. 73, the indicia are oriented such that the indicia are in an upright position to be easily read by a user from a mating side 2771 of the plug housing 2760 when the polarizing key 2500 is installed in the plug housing 2760.

Figure 75:
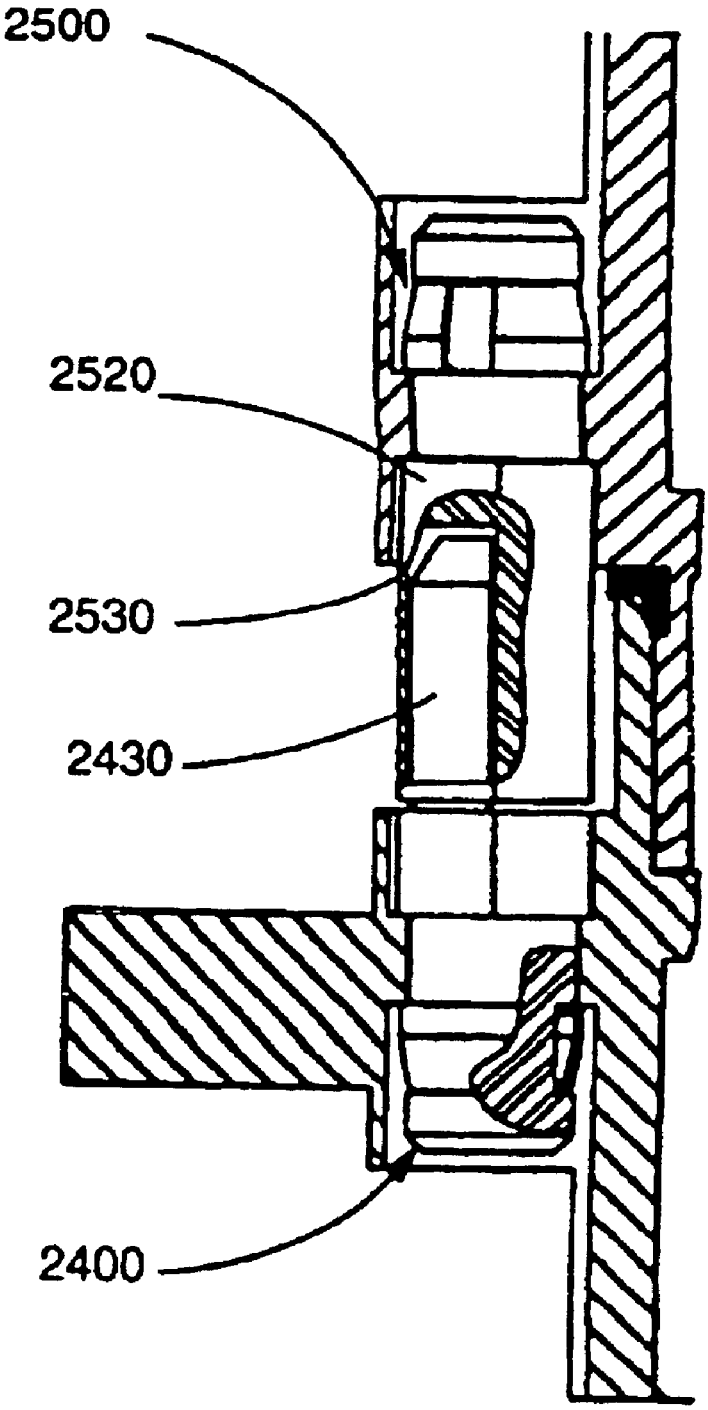
FIG. 75 is a fragmentary cross-sectional view of the receptacle assembly in FIG. 72 and the plug assembly in FIG. 73 illustrating the male polarizing key inserted in the female polarizing key.

Referring to FIGS. 68–70, the polarizing portion 2530 is a cavity that extends longitudinally from an end surface 2591 of the indicia portion 2520 a predetermined distance toward the end 2540 to provide a female configuration for the key 2500. The polarizing portion 2530 of the female polarizing key 2500 extends longitudinally a distance sufficient to accommodate substantially all of the polarizing portion 2430 of the male polarizing key 2400, as shown in FIG. 75.

Referring to FIG. 70, the polarizing portion 2530 is disposed asymmetrically relative to the indicia portion 2520 such that rotating the key 2500 about its longitudinal axis, either in the counter clockwise direction 2572 or a clockwise direction 2580, changes the orientation, i.e., polarity, of the polarizing portion 2530.

The polarizing portion 2530 includes a perimeter 2588. The perimeter 2588 is generally semi-circular in shape. The perimeter 2588 of the key 2500 can be different shapes in other embodiments, such as trapezoidal-shaped, triangular-shaped, or ellipsoid-shaped. The perimeter 2588 of the polarizing portion 2530 of the female polarizing key 2500 is configured to correspond substantially to the perimeter 2488 of the polarizing portion 2430 of the male polarizing key 2400, shown in FIGS. 62–66, such that the polarizing portion 2430 of the male polarizing key 2400 can fit within the polarizing portion 2530 of the female polarizing key 2500.

For convenient use of the polarizing system, the indicia 2561, 2562, 2563, 2564, 2565, 2566 of the six faces 2551, 2552, 2553, 2554, 2555, 2556, respectively, of the female polarizing key 2500 can be configured to correspond to a polarity that can accommodate a male polarizing key 2400 oriented to a polarity designated by the same respective indicium 2461, 2462, 2463, 2464, 2465, 2466 of its six faces 2451, 2452, 2453, 2454, 2455, 2456, respectively. For example, referring to FIGS. 72 and 73, a user can align the number "1" indicium 2561 of the first face 2551 of the female polarizing key 2500 with the number "1" indicium 2461 of the first face 2451 of the male polarizing key 2400 and insert the polarizing portion 2430 of the male polarizing key 2400 into the polarizing portion of the female key 2500.

Referring to FIG. 72, the receptacle housing 2610 includes a plurality of polarity cavities 2650, 2652, 2654 corresponding to the number of male polarizing keys 2400, 2402, 2404. The keys 2400, 2402, 2404 are installed in the polarity cavities 2650, 2652, 2654, respectively. The polarity cavities 2650, 2652, 2654 are similar to the polarity cavities 1450, 1452, 1454 of the receptacle housing 1410 shown in FIG. 34.

Referring to FIG. 73, the plug housing 2760 includes a plurality of polarity cavities 2780, 2782, 2784 corresponding to the number of female polarizing keys 2500, 2502, 2504. The keys 2500, 2502, 2504 are installed in the polarity cavities 2780, 2782, 2784, respectively. The polarity cavities 2780, 2782, 2784 are similar to the polarity cavities 1580, 1582, 1584 of the plug housing assembly 1560 shown in FIG. 36 and to the polarity cavities 1450, 1452, 1454 of the receptacle housing 1410 shown in FIG. 34. Accordingly, only the first polarity cavity 2650 of the receptacle housing 2610 in FIG. 72 will be discussed.

Figure 74:
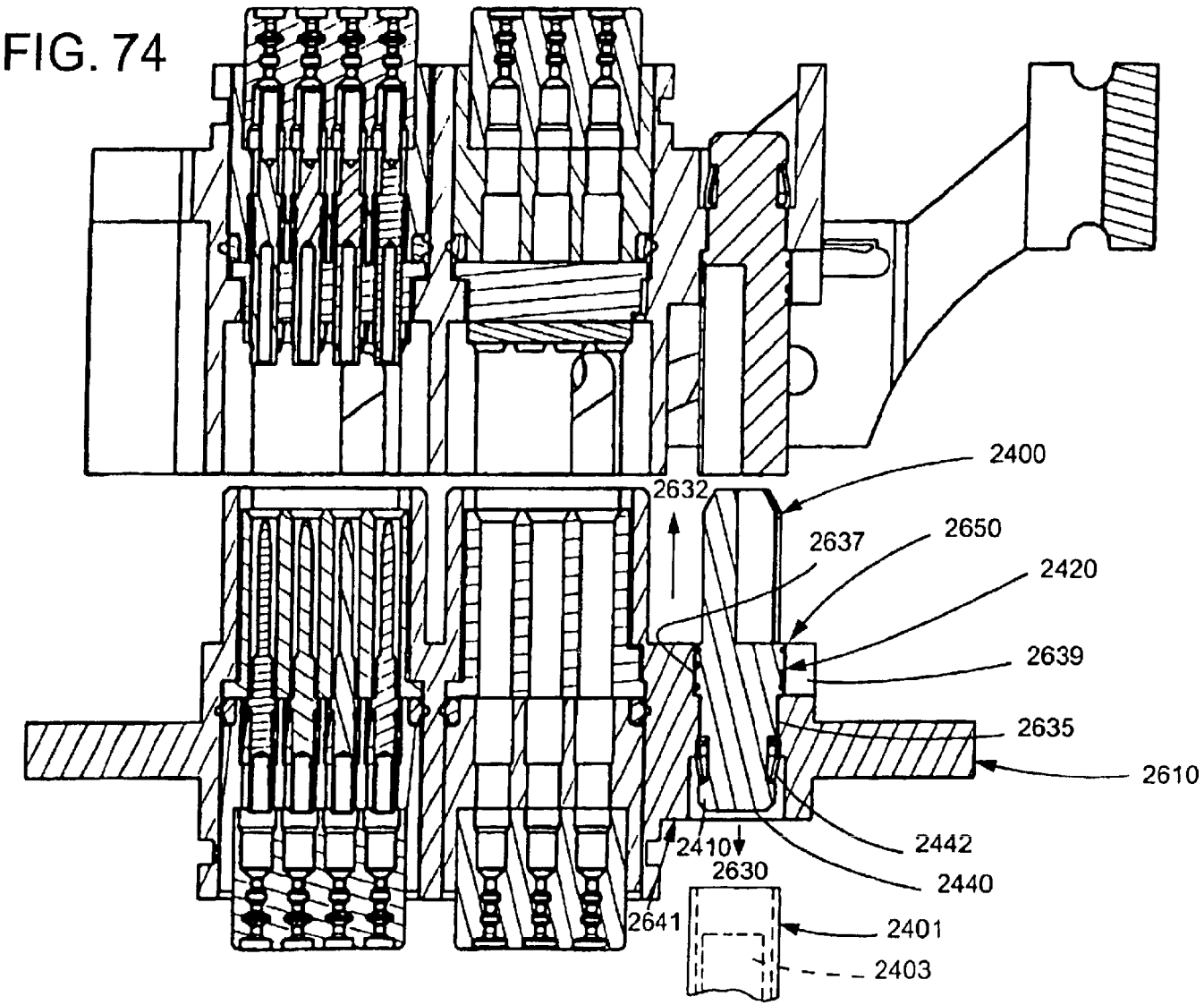
FIG. 74 is a cross-sectional view of the receptacle assembly taken along line 74*a*—74*a* in FIG. 72 and the plug assembly taken along line 74*b*—74*b* in FIG. 73 and a side elevational view of a removal tool for removing the polarizing keys from the respective housings.

Referring to FIG. 74, the key 2400 can be mounted to the receptacle housing 2610 by moving the key 2400 in an installation direction 2630. The first polarity cavity 2650 includes a first opening 2635, a second opening 2637, and a window 2639. The first opening 2635 is configured to removably retain the polarizing key 2400. During insertion of the key 2400, the tapered collar 2442 deflects inwardly to allow the collar 2442 to fit in the first opening 2635. The chamfered end 2440 facilitates the alignment and the insertion of the base 2410 of the key 2400 into the first opening 2635. Once the collar 2442 has moved in the installation direction 2630 out of the first opening 2635, the collar 2442 moves outward to its normal position. The indicia portion 2420 is seated in the second opening 2637. The indicia portion 2420 and the tapered collar 2442 of the key engage the receptacle housing 2610 to retain the key 2400.

To remove the key 2400, a removal tool 2401 is inserted from the wiring side 2641 of the housing 2610 into the polarizing cavity 2650. The tool 2401 is tubular and is configured to fit over the chamfered end 2440 and the tapered collar 2442 of the key 2400. The tool engages the collar 2442 to allow the key 2400 to be removed from the housing 2610. The collar 2442 deflects inwardly to allow the collar 2442 to fit in the first opening 2635. The key 2400 can move in the removal direction 2632. The tool 2401 includes a moveable plunger 2403 that can be operated to engage the key 2400 to move the key in the removal direction 2632. Once the collar 2442 is out of the first opening 2635, the collar 2442 can return to its normal position. The key 2400 is removed from the receptacle housing 2610.

Referring to FIG. 72, the second opening 2637 is configured to approximately correspond to the shape of the indicia portion 2420 of the polarizing key 2400. The second opening 2637 provides an interference with the polarizing key 2400 to prevent the installed polarizing key 2400 from rotating.

The window 2639 is provided to allow the user to view a particular indicium located on the polarizing key 2400 to indicate a particular polarity. The key 2400 can be installed in the second opening 2637 such that only one face of the indicia portion 2420 is visible through the window 2639. The user can select a particular desired polarity by aligning the desired face with the window 2639.

The number "1" indicium 2461 of the first face 2451 of the first polarizing key 2400 is visible through the window 2637 of the first polarity cavity 2650. The number "2" indicium 2462 of the second face 2452 of the second polarizing key 2402 is visible through the window 2639 of the second polarity cavity 2652. The number "3" indicium 2463 of the third face 2453 of the third polarizing key 2404 is visible through the window 2641 of the third polarity cavity 2654. The three male polarizing keys 2400, 2402, 2404 provide a polarity code, "123" as shown. In use, the user can select a desired polarity for the receptacle assembly 2602 to mate with a polarity of the plug assembly 2704 for interconnecting.

Referring to FIG. 73, to mate with the receptacle assembly 2602 shown in FIG. 72, the number "1" indicium 2561 of the first face 2551 of the first polarizing key 2500 is visible through the window 2737 of the first polarity cavity 2780. The number "2" indicium 2562 of the second face 2552 of the second polarizing key 2502 is visible through the window 2739 of the second polarity cavity 2782. The number "3" indicium 2563 of the third face 2553 of the third polarizing key 2504 is visible through the window 2741 of the third polarity cavity 2784. The three female polarizing keys 2500, 2502, 2504 provide a polarity code, "123" as shown. The plug assembly 2704 can be interconnected with the receptacle assembly 2602 shown in FIG. 72.

In other embodiments the electrical components for interconnection can each include a single set of polarizing keys, in which case there is a polarity character, such as "2", or can include other sets of polarizing keys, such as two, four, five, or more sets of polarizing keys.

Figure 76:
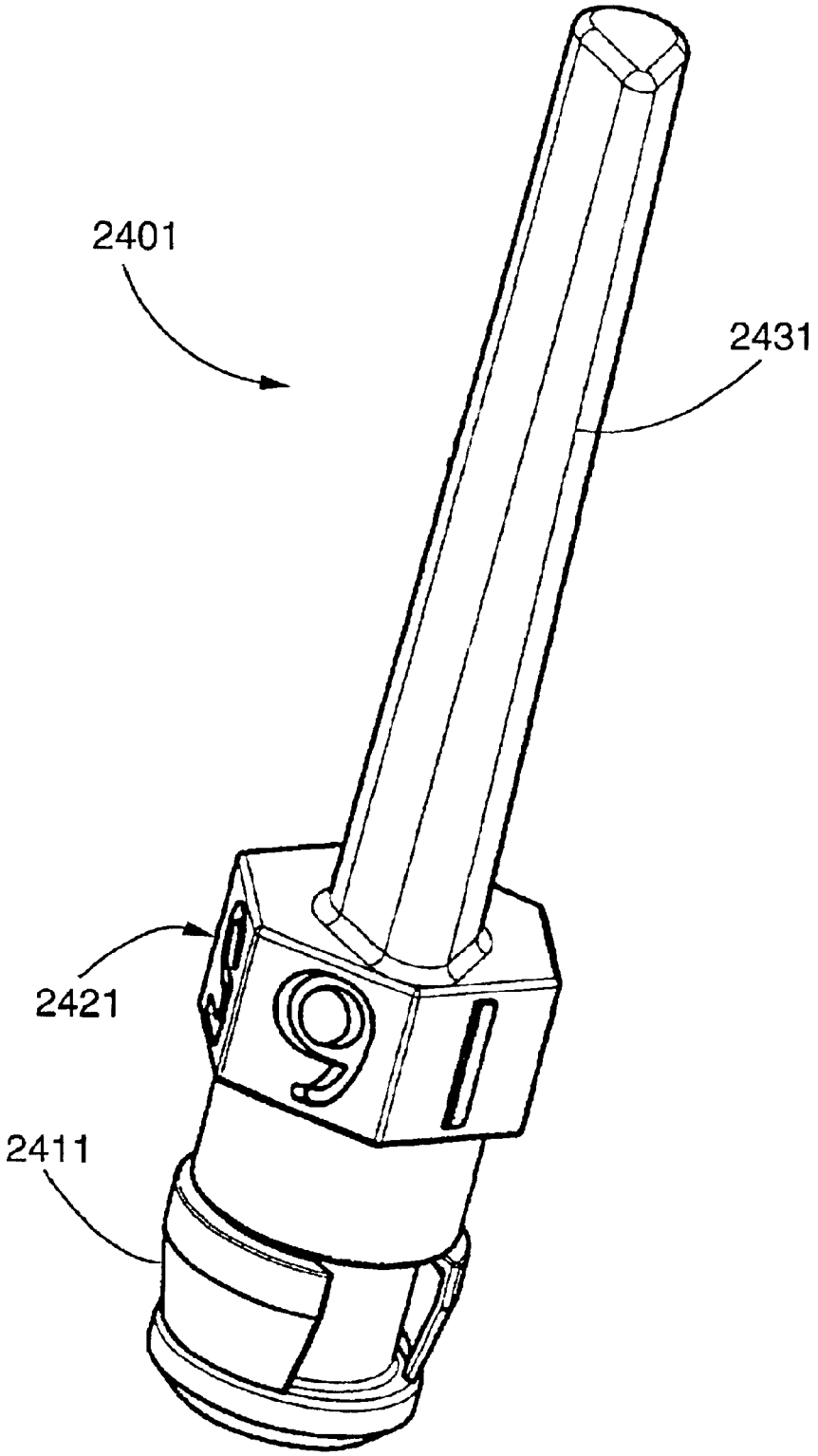
FIG. 76 is a perspective view of another embodiment of a male polarizing key.
Figure 77:
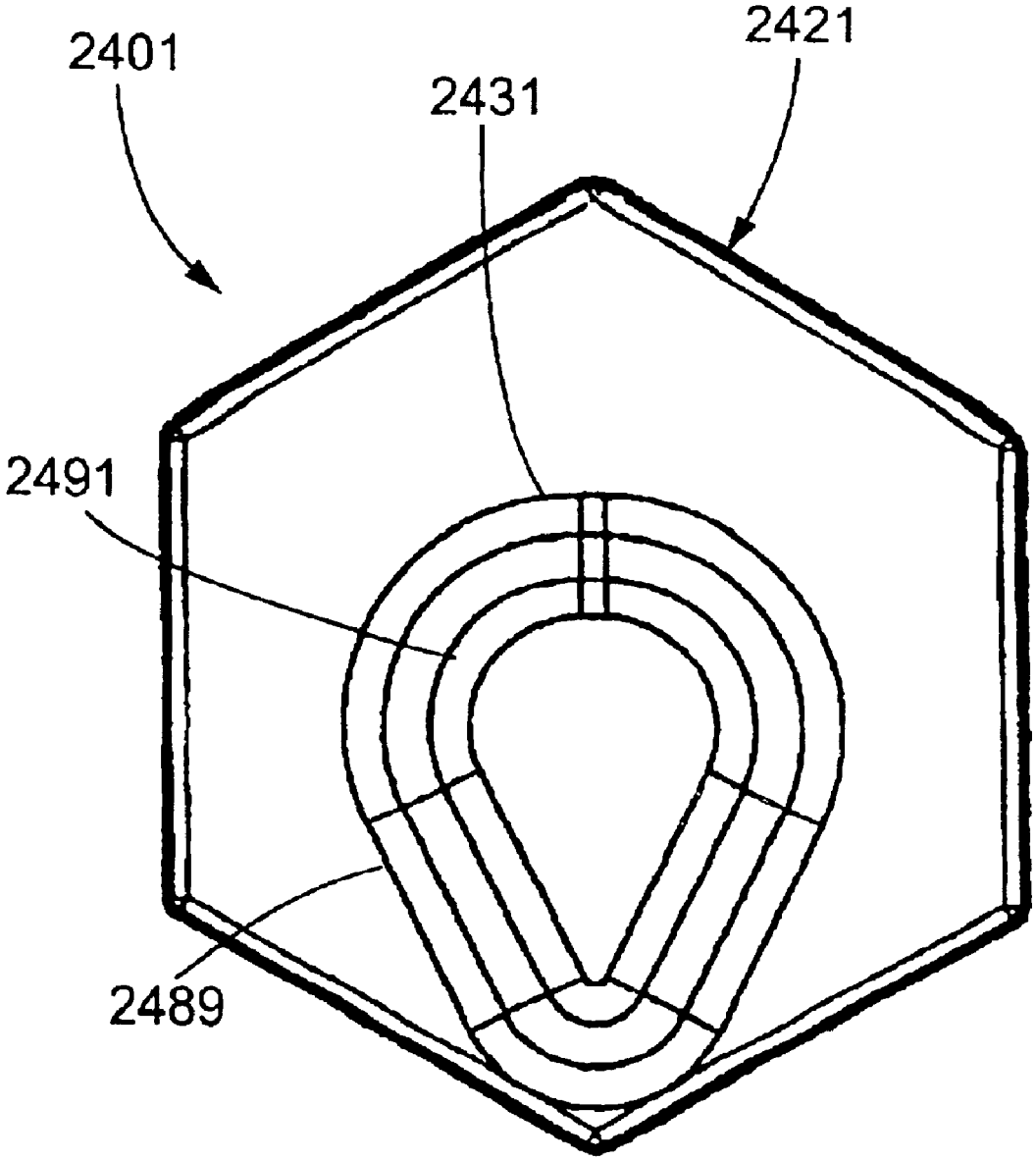
FIG. 77 is a top plan view of the male polarizing key in FIG. 76.

Referring to FIGS. 76 and 77, another embodiment of a male polarizing key 2401 is shown. The male polarizing key 2401 includes a base 2411, an indicia portion 2421, and a polarizing portion 2431. The base 2411 and the indicia portion 2421 are similar in construction to the base 2410 and the indicia portion 2420 of the male polarizing key 2400 shown in FIGS. 62–65.

The polarizing portion 2431 is a shaft that extends from the indicia portion 2421 to provide a male configuration for the key 2401. Referring to FIG. 77, the polarizing portion 2431 is disposed asymmetrically with respect to the indicia portion 2421 such that rotating the key 2401 about its longitudinal axis changes the orientation, i.e., polarity, of the polarizing portion 2431.

The polarizing portion 2431 includes a perimeter 2489, which is generally pear-shaped. The polarizing portion 2431 includes a chamfered end 2491 to facilitate the mating of the male polarizing key 2401 and a female polarizing key 2501, which is shown in FIGS. 78 and 79.

Figure 78:
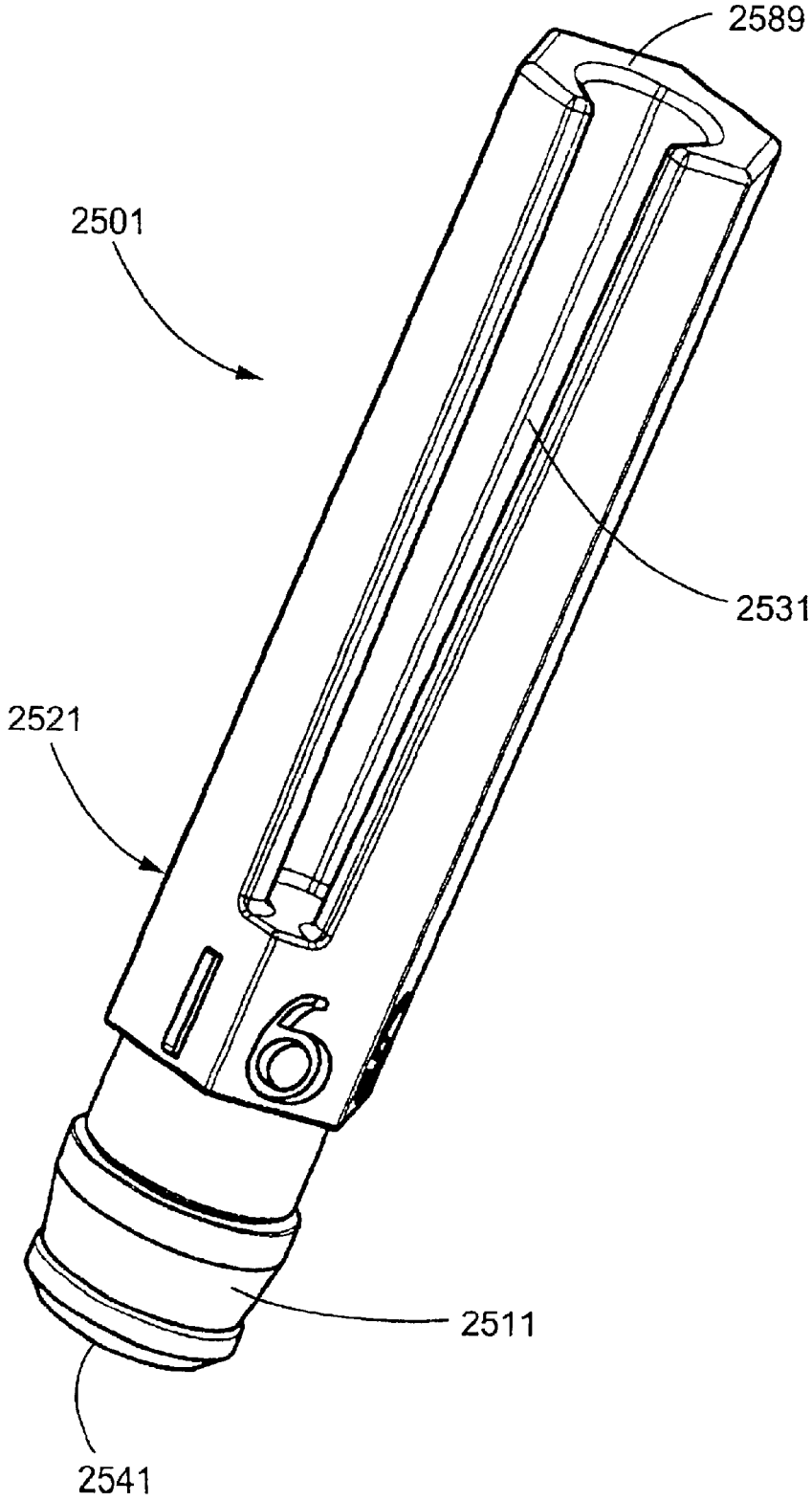
FIG. 78 is a perspective view of another embodiment of a female polarizing key.
Figure 79:
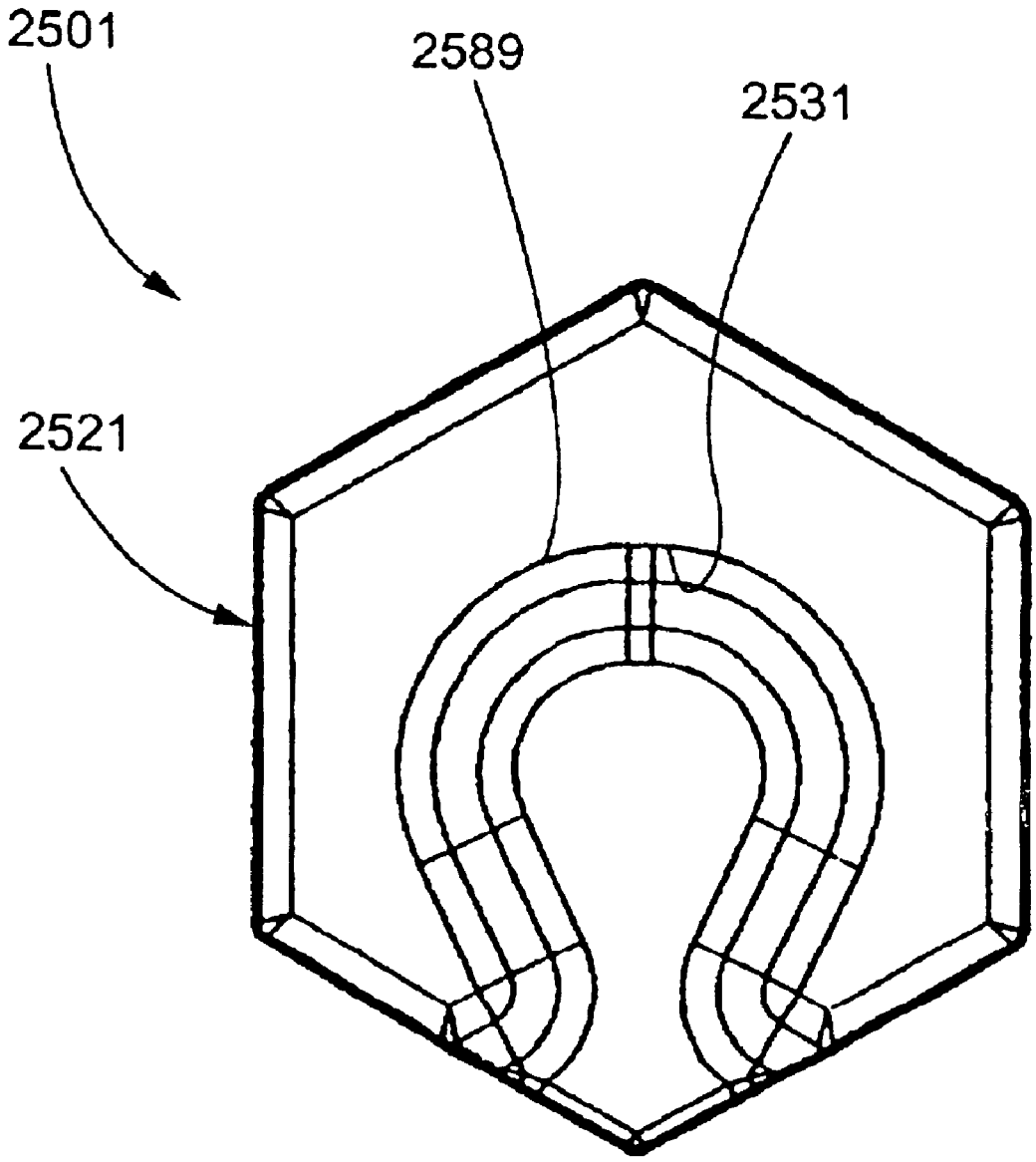
FIG. 79 is a top plan view of the female polarizing key in FIG. 78.

Referring to FIGS. 78 and 79, another embodiment of a female polarizing key 2501 is shown. The female polarizing key 2501 includes a base 2511, and indicia portion 2521, and a polarizing portion 2531. The base 2511 and the indicia portion 2521 are similar in construction to the base 2510 and the indicia portion 2520 of the female polarizing key 2500 shown in FIGS. 67–71.

The polarizing portion 2531 is a cavity that extends longitudinally from an end surface 2589 of the indicia portion 2521 a predetermined distance toward an end 2541 of the base 2511 to provide a female configuration for the key 2501. The polarizing portion 2531 of the female polarizing key 2501 extends longitudinally a distance sufficient to accommodate substantially all of the polarizing portion 2431 of the male polarizing key 2401, as shown in FIGS. 76 and 77.

Referring to FIG. 79, the polarizing portion 2531 is disposed asymmetrically with respect to the indicia portion 2521 such that rotating the key 2501 about its longitudinal axis changes the orientation, i.e., polarity, of the polarizing portion 2531.

The polarizing portion includes a perimeter 2589, which is generally pear-shaped. The perimeter 2589 of the female polarizing key 2501 is configured to correspond substantially to the perimeter 2489 of the male polarizing key 2401, as shown in FIGS. 76 and 77, such that the polarizing portion 2431 of the male key 2401 can fit within the polarizing portion 2531 of the female key 2501.

Figure 80:
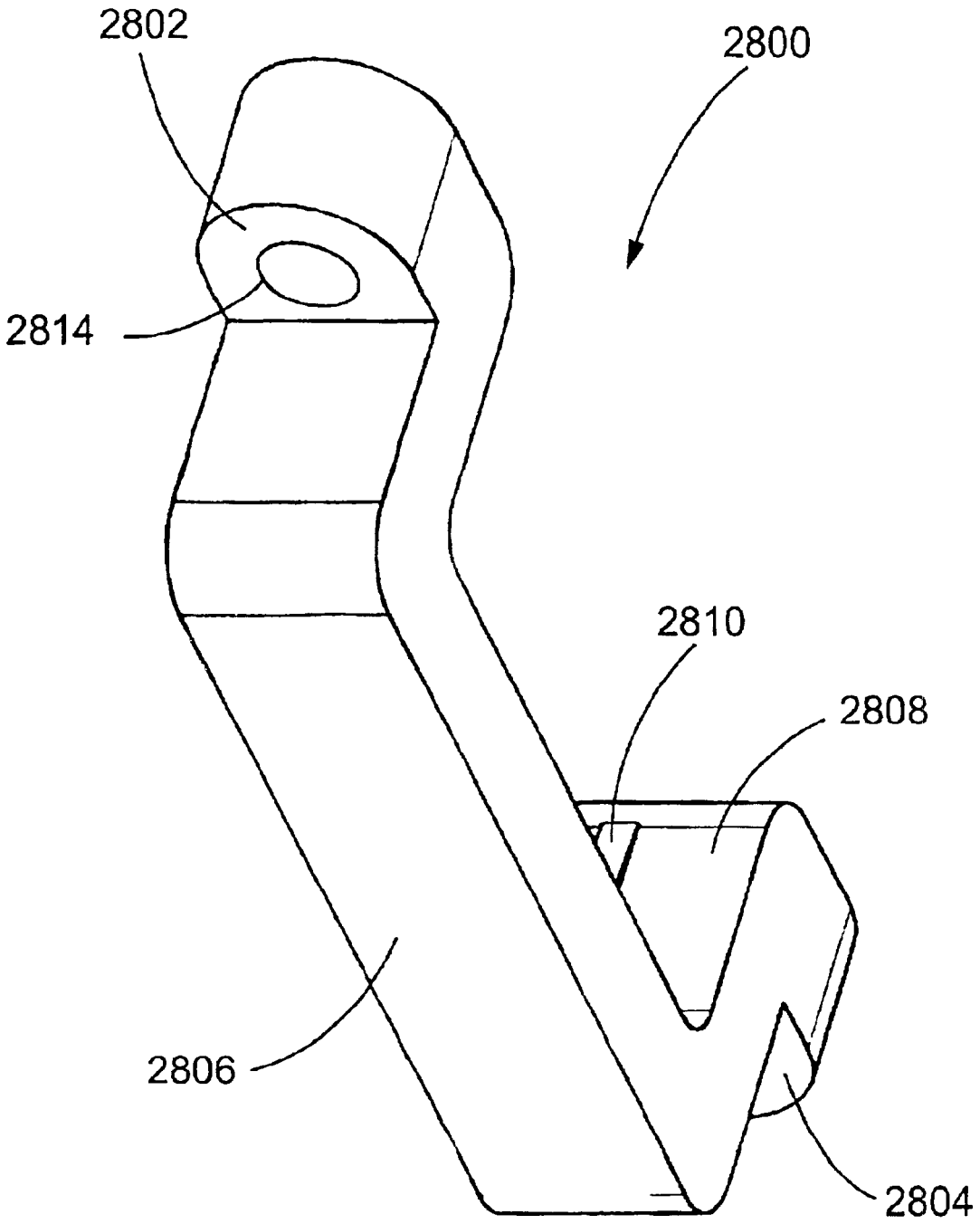
FIG. 80 is a perspective view of a backshell.
Figure 81:
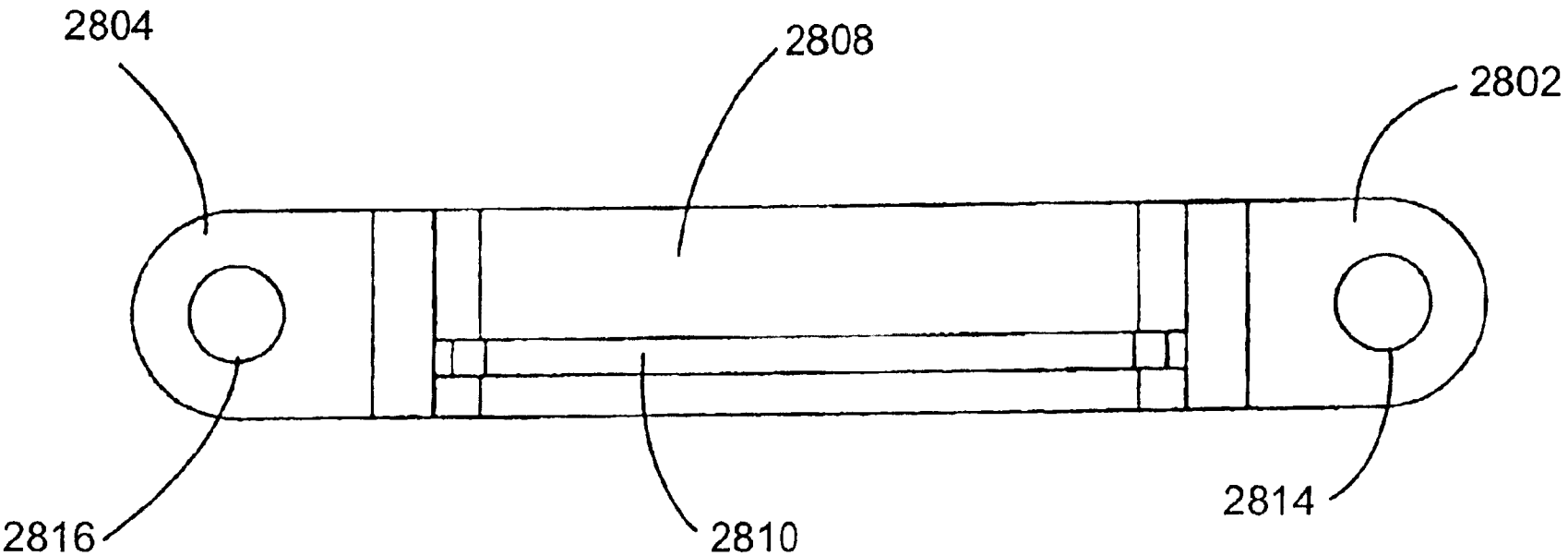
FIG. 81 is a side elevational view of the backshell in FIG. 80.
Figure 82:
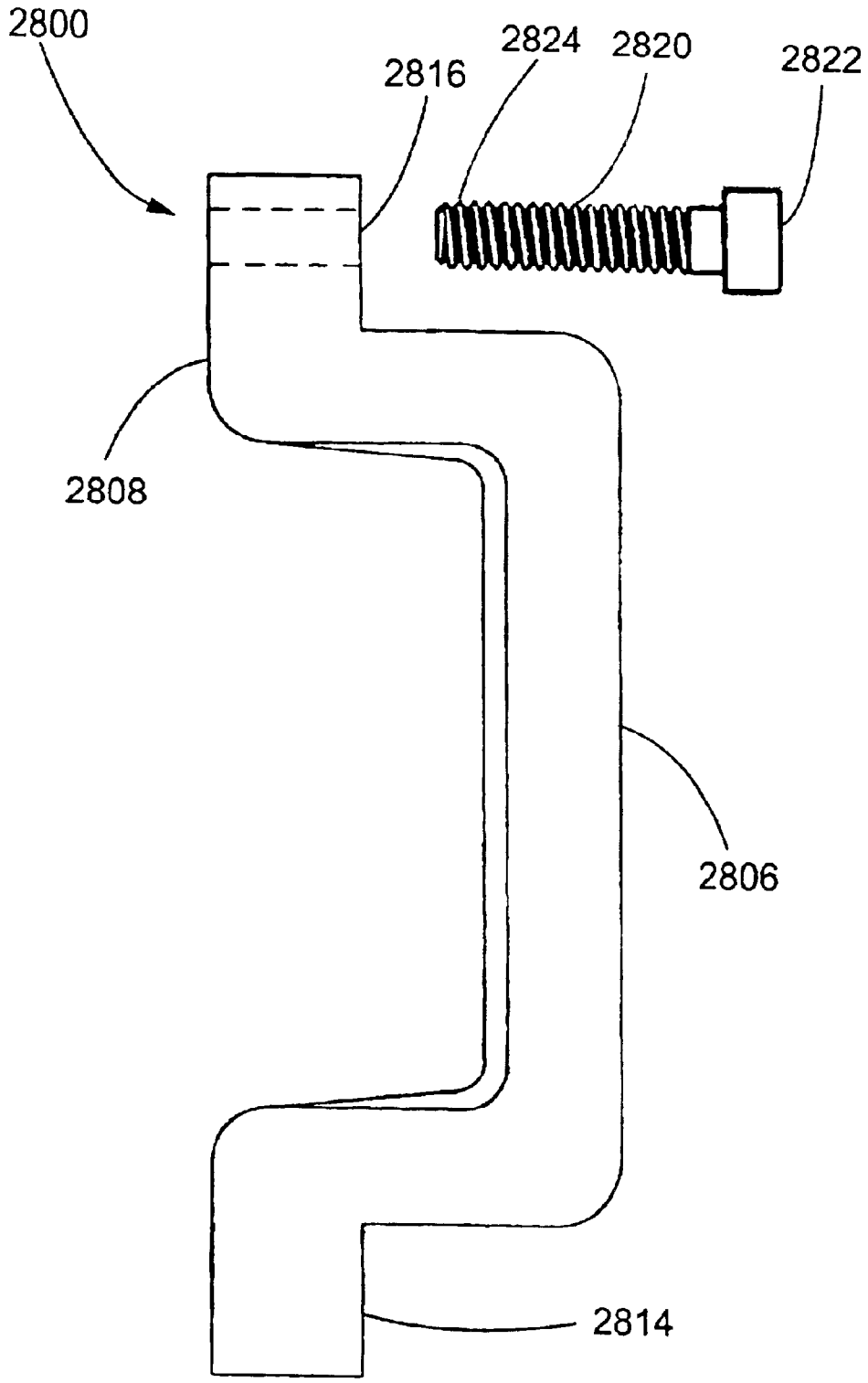
FIG. 82 is a top plan view of the backshell in FIG. 80.

Referring to FIGS. 80–107, various embodiments of backshells are shown. Each backshell can fit on any housing and any housing assembly. Each backshell can be combined with other backshells. Referring to FIGS. 80–82, a clamp backshell 2800 is shown. Referring to FIGS. 80 and 82, the clamp backshell 2800 is generally U-shaped. The clamp backshell 2800 includes a pair of mounting ears 2802, 2804, an outer surface 2806, an inner surface 2808, and an inner rib 2810. Each mounting ear 2802, 2804 includes a mounting hole 2814, 2816, respectively. The outer surface 2806 can include an indicium such as a company name, logo, or trademark, for example.

Figure 88:
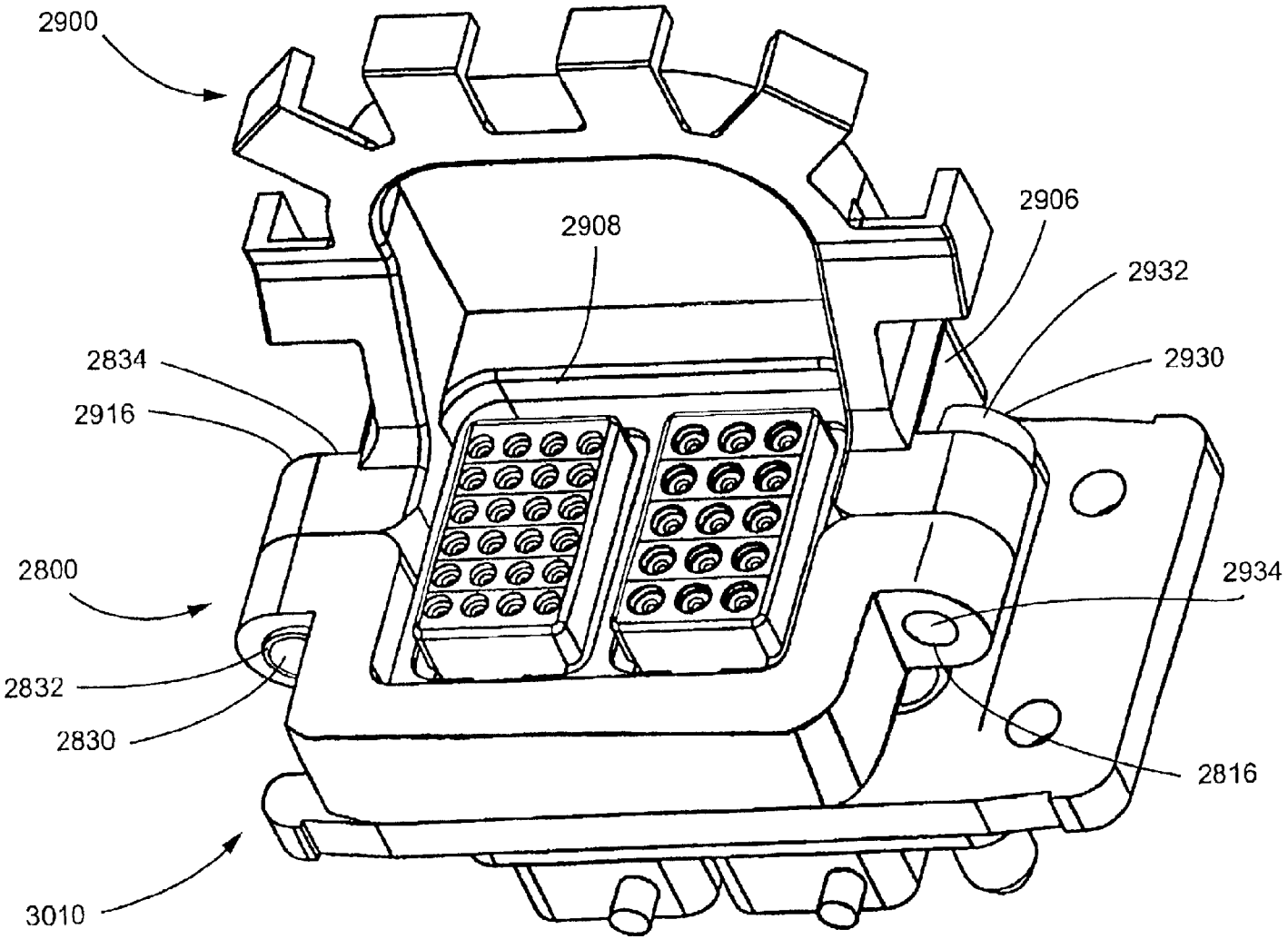
FIG. 88 is a perspective view of a pair of backshells mounted to a receptacle assembly.

Referring to FIG. 81, the inner rib 2810 is configured to engage an external groove on any size 2 receptacle housing, for example, the external groove 1447 of the receptacle housing 1410 shown in FIG. 35, and on any size 2 plug housing, for example, the external groove 1569 of the plug housing assembly 1560 shown in FIG. 36. The inner rib 2810 closely conforms to the external groove of a size 2 housing to mount the clamp backshell 2800 to the housing, as shown in FIG. 88. The clamp backshell 2800 can be mounted to size 1 housings as well. In other embodiments the clamp backshell can be configured such that it has an inner rib that closely conforms to an external groove on other sizes of housings, for example, a size 1 housing, such as the housings shown in FIGS. 38 and 39, a size 4 housing having a pair of external grooves, such as shown in FIG. 40, or a size 4 housing having a single external groove.

Referring to FIG. 82, the first and/or second mounting holes 2814, 2816 can be tapped to threadingly engage a screw or bolt, for example. In this embodiment, the second mounting hole 2816 is tapped, and the first mounting hole is not. A bolt 2820 can be threaded into the second mounting hole 2816 such that a head 2822 of the bolt 2820 is in adjacency with the outer surface 2806 of the clamp backshell 2800 and a threaded portion 2824 extends beyond the inner surface 2808 of the clamp backshell 2800 to engage the mounting hole of another backshell.

Figure 83:
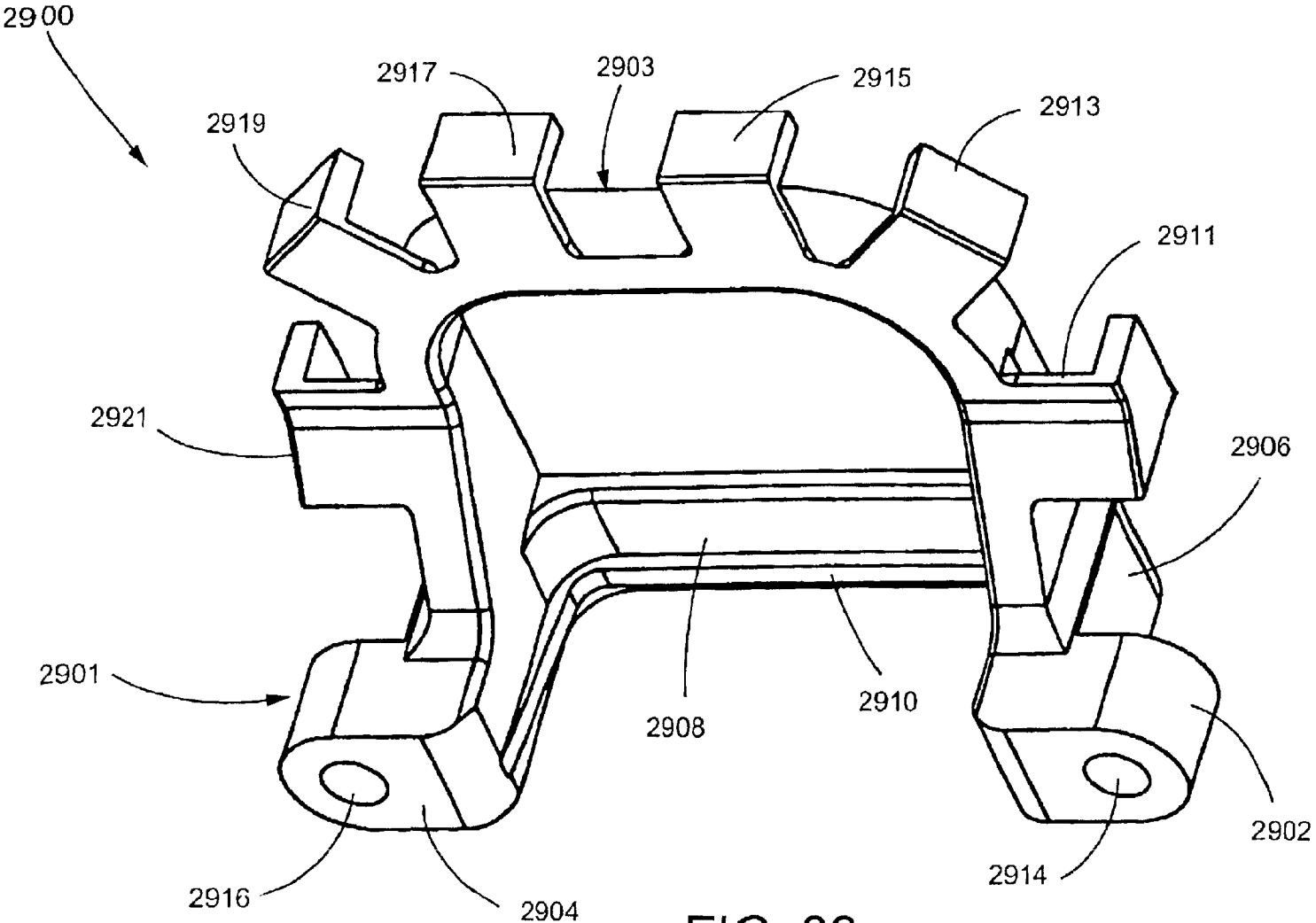
FIG. 83 is a perspective view of another embodiment of a backshell.

Referring to FIGS. 83–86, a strain relief backshell 2900 is shown. Referring to FIG. 83, the strain relief backshell 2900 includes a generally U-shaped base 2901 and a frame 2903. The base 2901 includes a pair of mounting ears 2902, 2904, an outer surface 2906, an inner surface 2908, and an inner rib 2910. Each mounting ear 2902, 2904 includes a mounting hole 2914, 2916, respectively. The outer surface 2906 can include an indicium such as a company name, logo, or trademark, for example.

Figure 87:
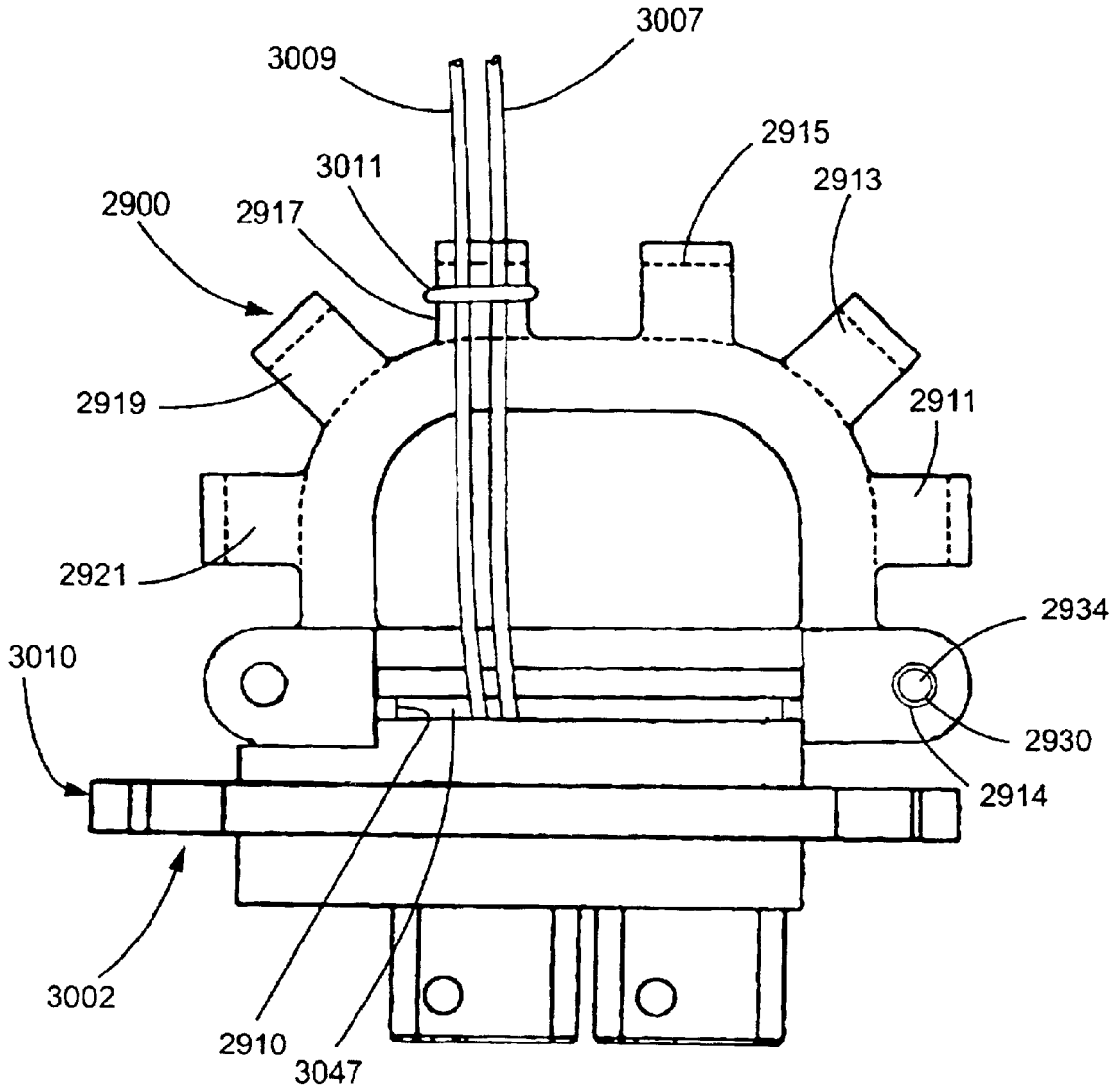
FIG. 87 is a side elevational view of the backshell in FIG. 83 mounted to a receptacle assembly.

The frame 2903 includes a plurality of fingers 2911, 2913, 2915, 2917, 2919, 2921 to "tie-wrap" wires for providing strain relief. One or more wires 3007, 3009 can be attached to each of the fingers 2911, 2913, 2915, 2917, 2919, 2921 by a tie-wrap 3011 to provide a strain relief for the wires as shown in FIG. 87. Returning to FIG. 83, the illustrative strain relief backshell 2900 includes six fingers. The first and the sixth fingers 2911, 2921 provide strain relief oriented at 0°, i.e. a horizontal orientation. The third and the fourth fingers 2915, 2917 provide strain relief oriented at 90°, i.e. a vertical orientation. The second and the fifth fingers 2913, 2919 provide strain relief oriented at 45° at respective diverging angles. The number and orientation of fingers can be varied in other embodiments.

Referring to FIG. 84, the first and/or second mounting holes 2914, 2916 can be tapped to threadingly engage a screw or bolt, for example. In this embodiment, the second mounting hole 2916 is tapped, and the first mounting hole is not. A bolt 2920 can be threaded into the second mounting hole 2916 such that a head 2922 of the bolt 2920 is in adjacency with the outer surface 2906 of the strain relief backshell 2900 and a threaded portion 2924 extends beyond the inner surface 2908 of the strain relief backshell 2900 to engage the mounting hole of another backshell.

Referring to FIGS. 85 and 86, the fingers 2911, 2913, 2915, 2917, 2919, 2921 are in spaced relation to each other along the frame 2903. Each finger 2911, 2913, 2915, 2917, 2919, 2921 includes a hooked end 2925 to help prevent the unintended removal of an attached tie wrap from the respective fingers 2911, 2913, 2915, 2917, 2919, 2921.

The inner rib 2910 is configured to engage an external groove on any size 2 receptacle housing, for example, the external groove 1447 of the receptacle housing 1410 shown in FIG. 35, and on any size 2 plug housing, for example, the external groove 1569 of the plug housing assembly 1560 shown in FIG. 36. The inner rib 2910 closely conforms to the external groove of a size 2 housing to mount the strain relief backshell 2900 to the housing, as shown in FIGS. 87 and 88. The strain relief backshell 2900 can be mounted to size 1 housings as well. In other embodiments the strain relief backshell can be configured such that it has an inner rib that closely conforms to an external groove on other sizes of housings, for example, a size 1 housing, such as the housings shown in FIGS. 38 and 39, a size 4 housing having a pair of external grooves, such as shown in FIG. 40, or a size 4 housing having a single external groove.

Referring to FIGS. 87 and 88, a pair of backshells 2800, 2900 can be mounted to a receptacle housing 3010 of a receptacle assembly 3002. Referring to FIG. 87, the strain relief backshell 2900 is shown mounted to one side of the receptacle housing 3010. The inner rib 2910 is configured to engage an external groove 3047 of the receptacle housing 3010. The inner rib 2910 closely conforms to the external groove 3047 to mount the strain relief backshell 2900 to the housing 3010. A first bolt 2930 is inserted into the first mounting hole such that a threaded portion 2934 of the bolt can project from the inner surface 2908 of the strain relief backshell 2900.

Referring to FIG. 88, the clamp backshell 2800 is shown mounted to the other side of the receptacle housing 3010. The inner rib of the clamp backshell 2800 is configured to engage the external groove of the receptacle housing 3010. The inner rib closely conforms to the external groove to mount the clamp backshell 2800 to the housing 3010.

A second bolt 2830 is inserted into the first mounting hole 2814 of the clamp backshell 2800 such that a head 2832 of the bolt is adjacent to the outer surface 2806 of the clamp backshell 2800. The clamp backshell 2800 and the strain relief backshell 2900 are connected together by the first bolt 2930 and the second bolt 2830. A head 2932 of the first bolt 2930 is adjacent the outer surface 2906. The threaded portion 2934 of the first bolt 2930 is threadingly engaged with the tapped second mounting hole 2816 of the clamp backshell 2800. A threaded portion 2834 of the second bolt 2830 is threadingly engaged with the tapped second mounting hole 2916 of the strain relief backshell 2900.

Figure 89:
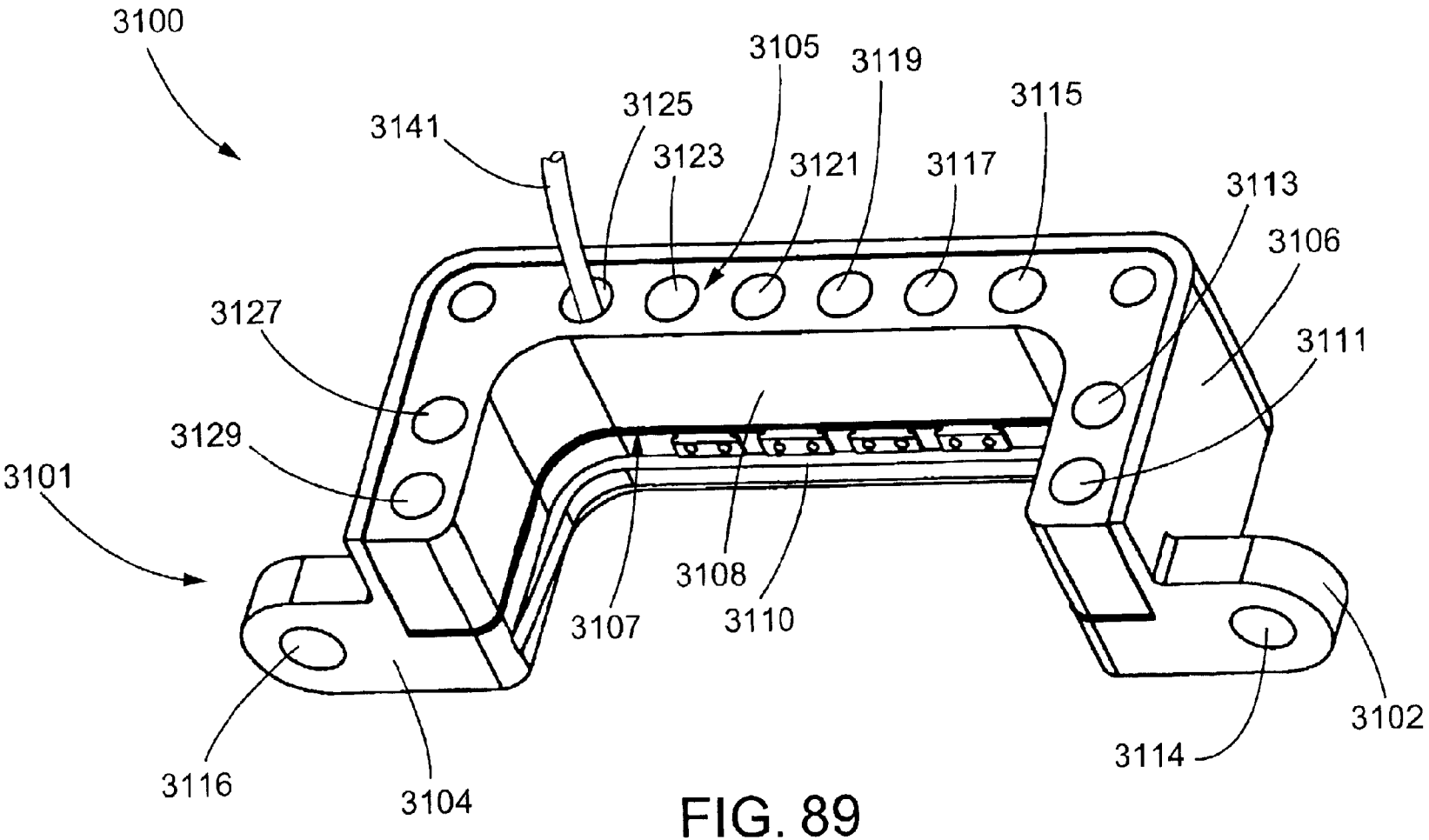
FIG. 89 is a perspective view of another embodiment of a backshell.

Referring to FIGS. 89–96, a shield termination backshell 3100 is shown. The shield termination backshell 3100 can provide "2-inch termination" to wire shields. "Two-inch termination" means that the backshell can provide a termination of the shield wire to ground within two inches of the separation from the contact wire. Referring to FIG. 89, the shield termination backshell 3100 includes a generally U-shaped base 3101, an insert 3105 and a grounding spring 3107. The base 3101 can be made from any suitable material, such as metal or plastic. The base 3101 includes a pair of mounting ears 3102, 3104, an outer surface 3106, an inner surface 3108, and an inner rib 3110. Each mounting ear 3102, 3104 includes a mounting hole 3114, 3116, respectively. The outer surface 3106 can include an indicium such as a company name, logo, or trademark, for example. The insert 3105 can be made from any suitable material, such as plastic or metal. The grounding spring 3107 can provide an electrical connection between contacts installed in the backshell 3100 and ground. The grounding spring 3107 can be made from any suitable conductive material, such as beryllium copper.

The backshell 3100 includes a plurality of contact cavities 3111, 3113, 3115, 3117, 3119, 3121, 3123, 3125, 3127, 3129 for accepting pin contacts crimped to wire shields. A wire 3141 is crimped or otherwise attached to a pin contact. The pin contact is installed in the eighth cavity 3125. The illustrative shield termination backshell 3100 includes ten cavities. The number of contact cavities can be varied in other embodiments.

Figure 90:
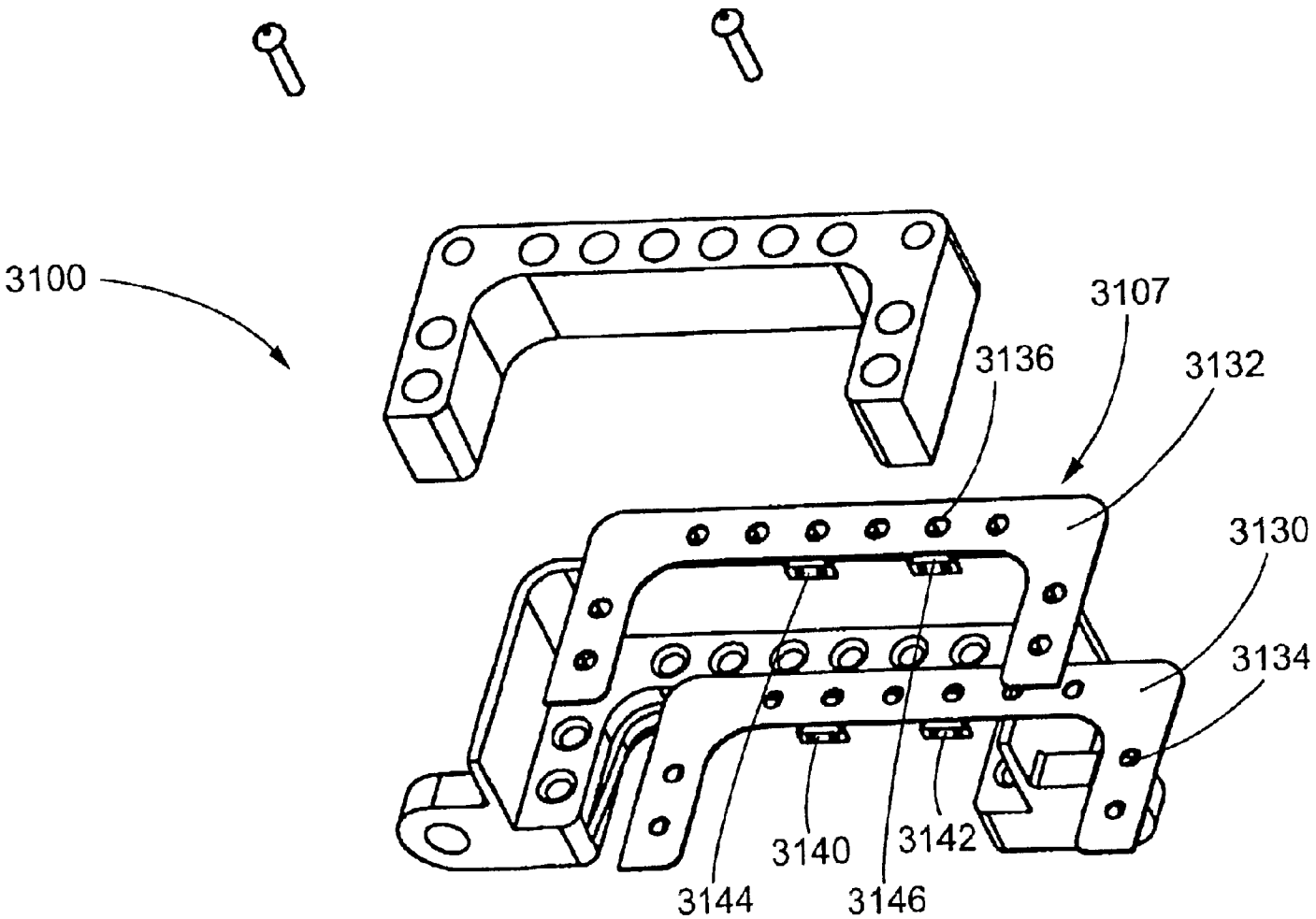
FIG. 90 is an exploded view of the backshell in FIG. 89.

Referring to FIG. 90, an exploded view of the backshell 3100 is shown. In this embodiment, the grounding spring 3107 includes a first layer 3130 and a second layer 3132. The first and second layers 3130, 3132 each include a plurality of holes 3134, 3136, respectively. The holes 3134, 3136 of each layer 3130, 3132, respectively, align with, and are part of, the contact cavities of the assembled backshell 3100, as shown in FIG. 89.

Figure 93:
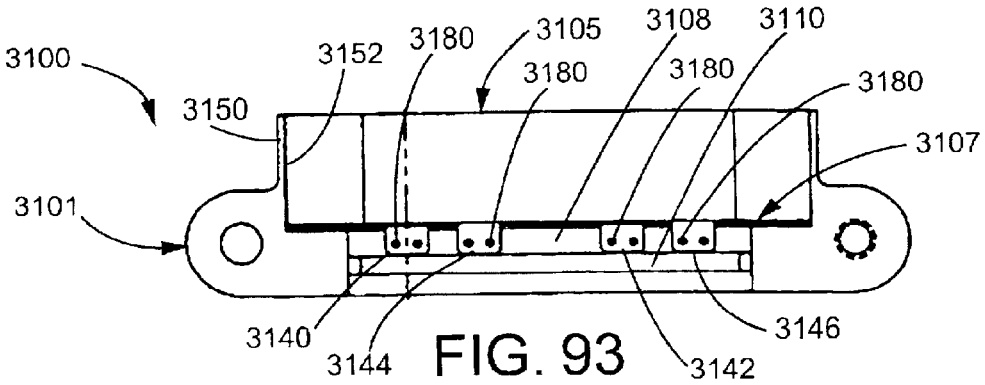
FIG. 93 is a side elevational view of the backshell in FIG. 89.

The first layer 3130 includes first and second depending tabs 3140, 3142. The first and second tabs 3140, 3142 are in spaced relation to each other. The second layer 3132 includes third and fourth depending tabs 3144, 3146. The third and fourth tabs 3144, 3146 are in spaced relation to each other. The tabs 3140, 3142, 3144, 3146 of the first and second layers 3130, 3132 are configured such that when the layers 3130, 3132 are assembled in the backshell 3100, the tabs project from the inner surface 3108, as shown in FIG. 93.

Figure 91:
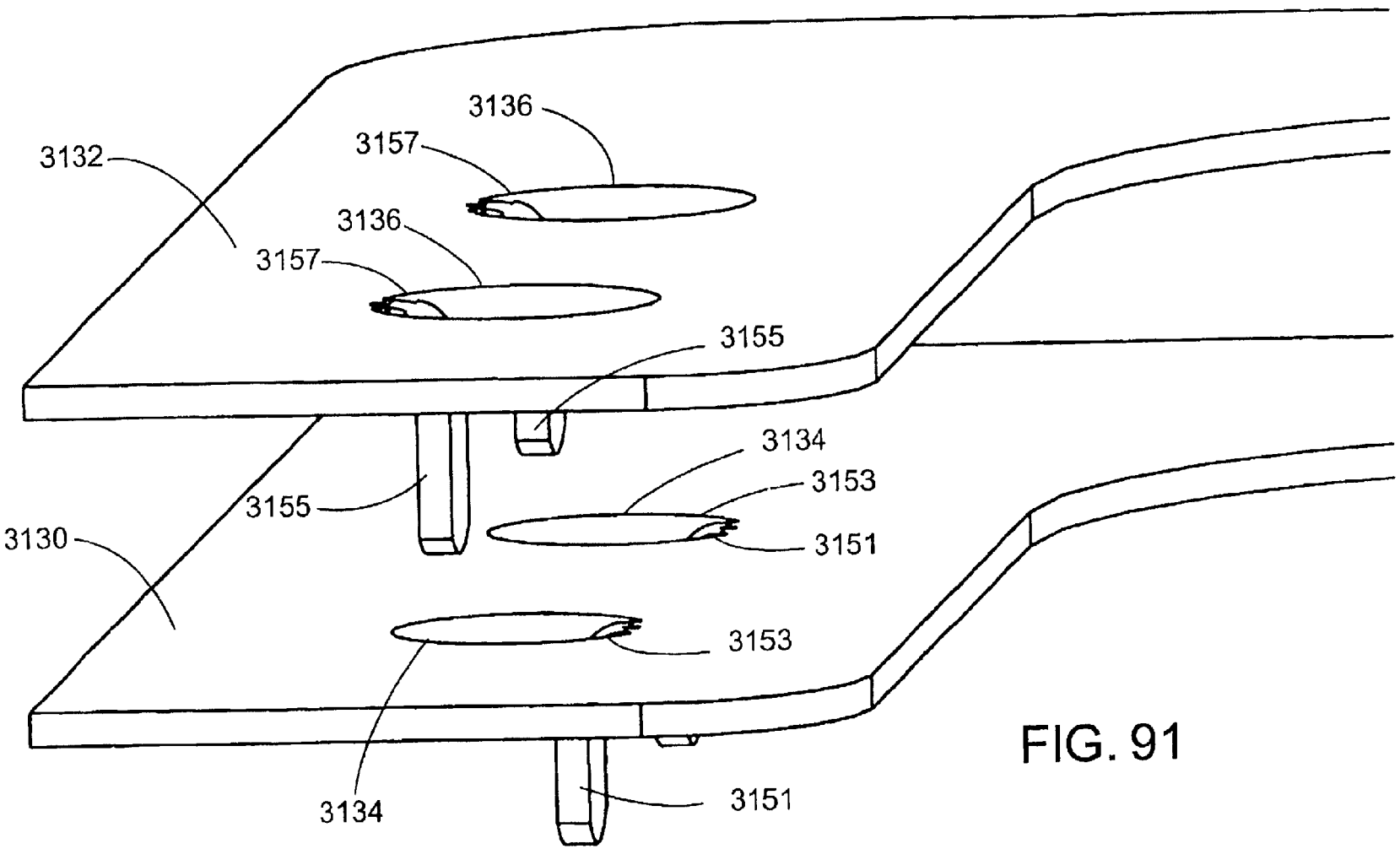
FIG. 91 is a fragmentary exploded view of a grounding spring.

Referring to FIG. 91, each hole 3134 of the first layer 3130 includes a depending grounding finger 3151. The grounding fingers 3151 are each disposed on an inner edge 3153 of the respective hole 3134. Each hole 3136 of the second layer 3132 includes a depending grounding finger 3155. The grounding fingers 3155 are each disposed on an outer edge 3157 of the respective hole 3136. The first and second layers 3130, 3132 are similar in construction in other respects and are similar in shape. In the assembled backshell 3100, the layers 3130, 3132 cooperate to provide a pair of converging grounding fingers 3151, 3155 in each contact cavity to engage an electrical contact.

In other embodiments the grounding spring can be made from a single layer.

Figure 92:
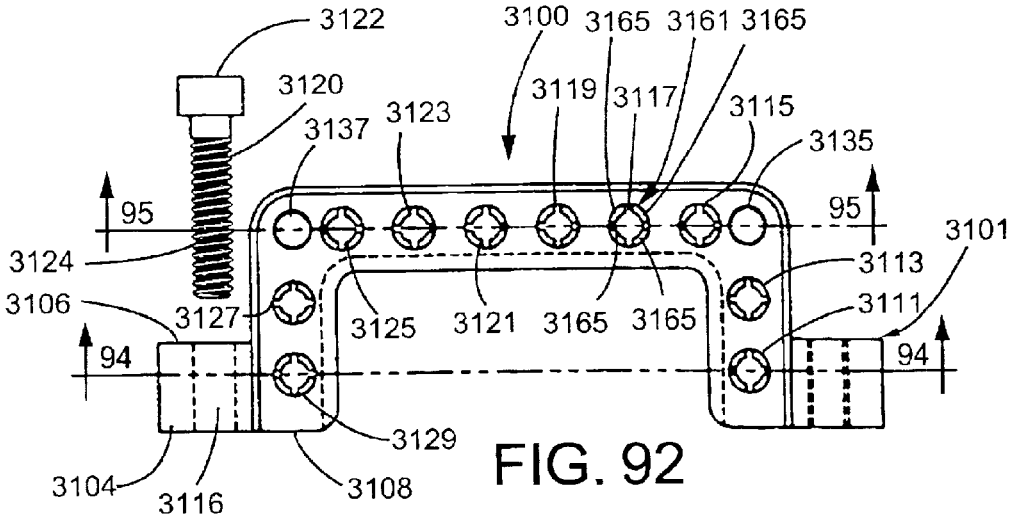
FIG. 92 is a top plan view of the backshell in FIG. 89.

Referring to FIG. 92, the first and/or second mounting holes 3114, 3116 can be tapped to threadingly engage a screw or bolt, for example. In this embodiment, the second mounting hole 3116 is tapped, and the first mounting hole is not. A bolt 3120 can be inserted into the second mounting hole 3116 such that a head 3122 of the bolt 3120 is in adjacency with the outer surface 3106 of the shield termination backshell 3100 and a threaded portion 3124 extends beyond the inner surface 3108 of the shield termination backshell 3100 to engage the mounting hole of another backshell. The contact cavities 3111, 3113, 3115, 3117, 3119, 3121, 3123, 3125, 3127, 3129 are in spaced relation to each other along the insert 3105.

Figure 95:
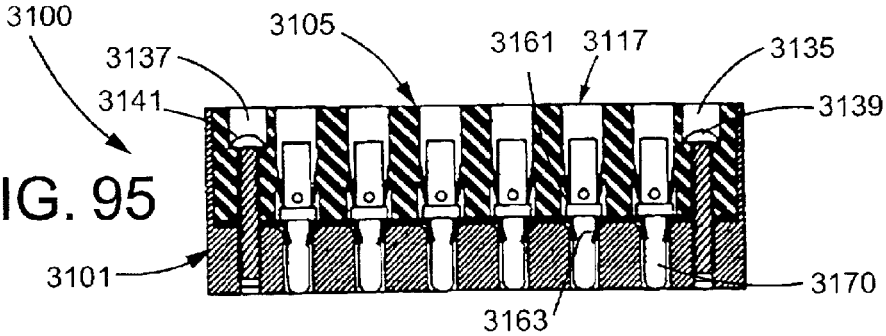
FIG. 95 is a cross-sectional view taken along the line 95—95 in FIG. 92.

The shield termination backshell 3100 includes a pair of mounting cavities 3135, 3137 to mount the insert 3105 to the base 3101 as shown in FIG. 95. Referring to FIG. 95, screws 3139, 3141 are threadingly engaged with the mounting cavities 3135, 3137, respectively, to mount the insert 3105 to the base 3101.

Figure 94:
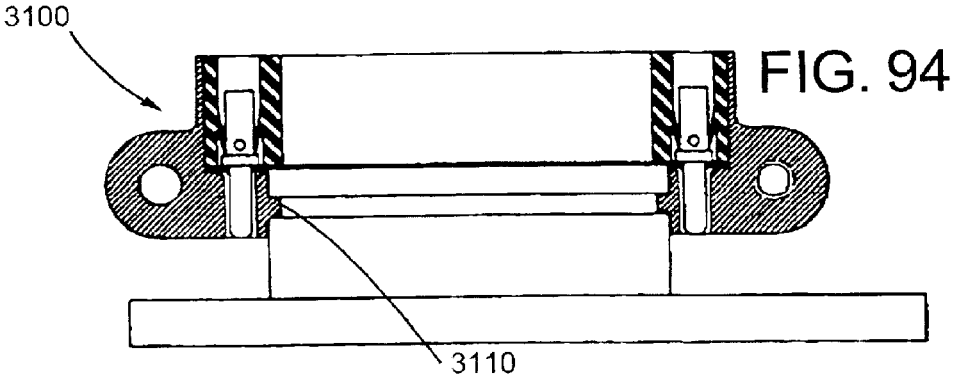
FIG. 94 is a cross-sectional view taken along the line 94—94 in FIG. 92 of the backshell and a side elevational view of a receptacle housing.

Referring to FIG. 93, the base 3101 includes a shroud portion 3150 that defines a recess 3152. The insert 3105 fits within the recess 3152 to present a flush appearance. The inner rib 3110 is configured to engage an external groove on any size 2 receptacle housing, for example, the external groove 1447 of the receptacle housing 1410 shown in FIG. 35, and on any size 2 plug housing, for example, the external groove 1569 of the plug housing assembly 1560 shown in FIG. 36. The inner rib 3110 closely conforms to the external groove of a size 2 housing to mount the shield termination backshell 3100 to the housing, as shown in FIG. 94. The shield termination backshell 3100 can be mounted to size 1 housings as well. In other embodiments the shield termination backshell can be configured such that it has an inner rib that closely conforms to an external groove on other sizes of housings, for example, a size 1 housing, such as the housings shown in FIGS. 38 and 39, a size 4 housing having a pair of external grooves, such as shown in FIG. 40, or a size 4 housing having a single external groove.

Referring to FIG. 93, the tabs 3140, 3142, 3144, 3146 of the grounding spring 107 protrude from under the insert 3105 and conform to the inner surface 3108 of the backshell 3100. Each tab 3140, 3142, 3144, 3146 includes a plurality of concave and convex hertzian bumps 3180 to facilitate the electrical connection between the grounding spring 3163 and the housing to which the backshell 3100 is mounted. The hertzian bumps can be compressed between the backshell 3100 and the housing to provide reliable conductivity.

Referring to FIG. 95, each contact cavity is identical. The fourth contact cavity 3117 will be discussed in detail. The description of the fourth contact cavity 3117 is applicable to the other contact cavities. The contact cavity 3117 is configured to retain an electrical contact and includes a retaining portion 3161 and a grounding portion 3163.

Figure 96:
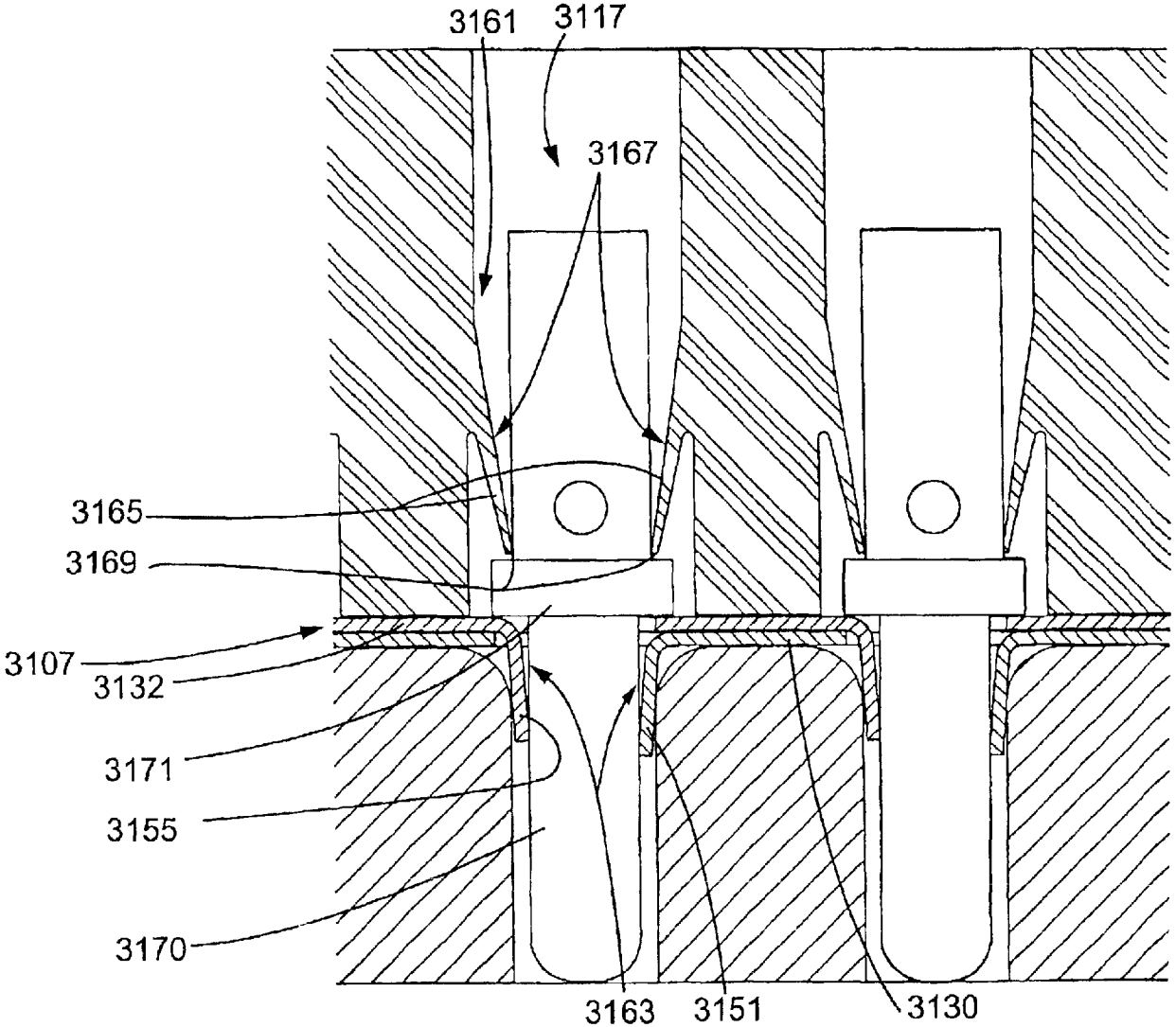
FIG. 96 is a partial cross-sectional view as in FIG. 95.

Referring to FIG. 96, the retaining portion 3161 includes a plurality of projections 3165. Each projection 3165 includes a ramped surface 3167 and a shoulder 3169. A locking portion 3171 of a pin contact 3170 can engage the shoulders 3169 of the contact cavity 3117 to retain the pin contact 3170.

The grounding portion 3163 includes a pair of converging grounding fingers 3151, 3155 of the first and second layers

3130, 3132, respectively, of the grounding spring 3107. Upon insertion of the contact 3170 into the contact cavity 3117, the grounding fingers 3151, 3155 deflect outward to accommodate the contact 3170. The grounding fingers 3151, 3155 can engage the contact 3170 to provide an electrical connection for grounding between the contact 3170 and the housing onto which the backshell 3100 is mounted.

Figure 97:
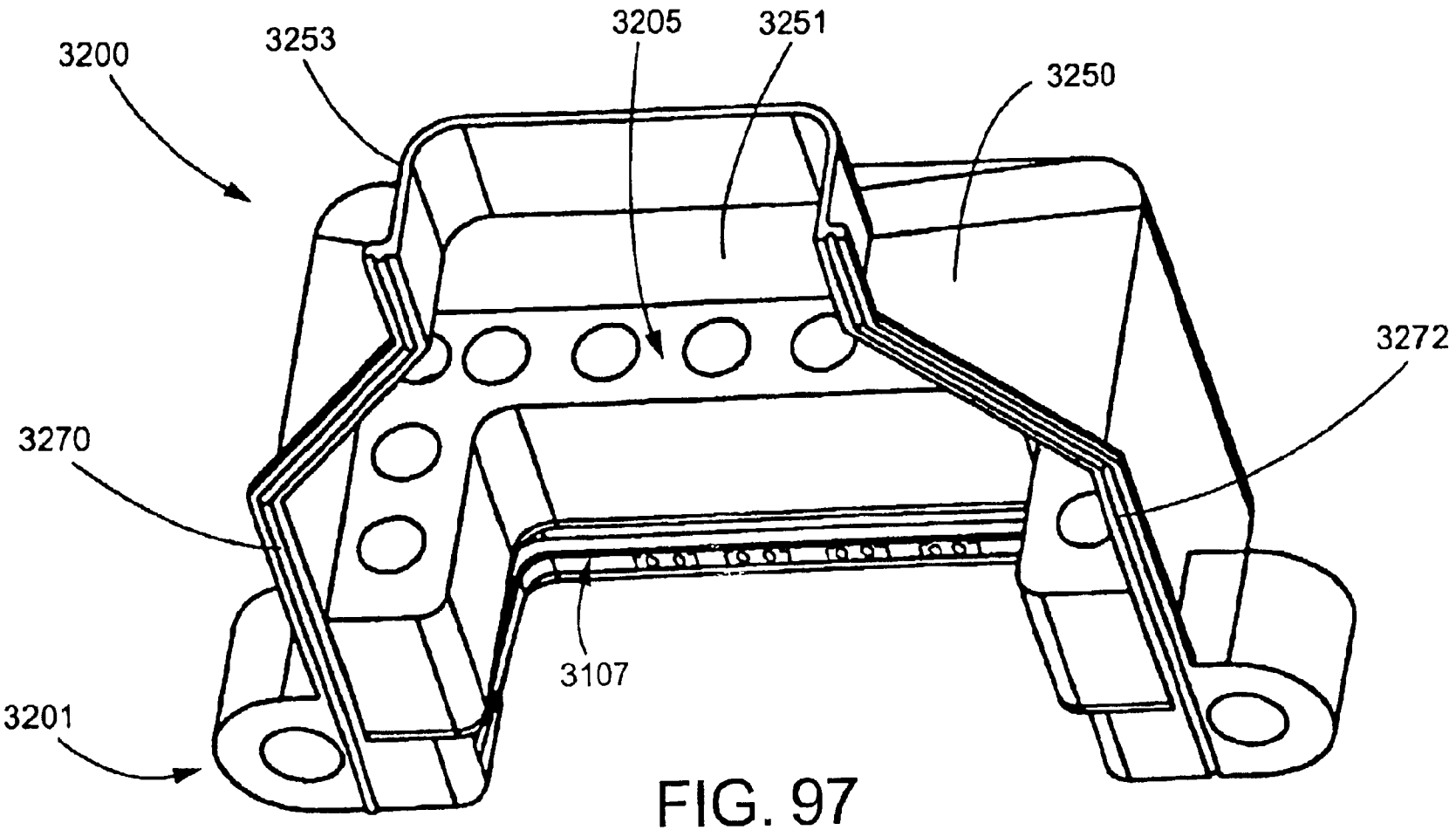
FIG. 97 is a perspective view of another embodiment of a backshell.
Figure 98:
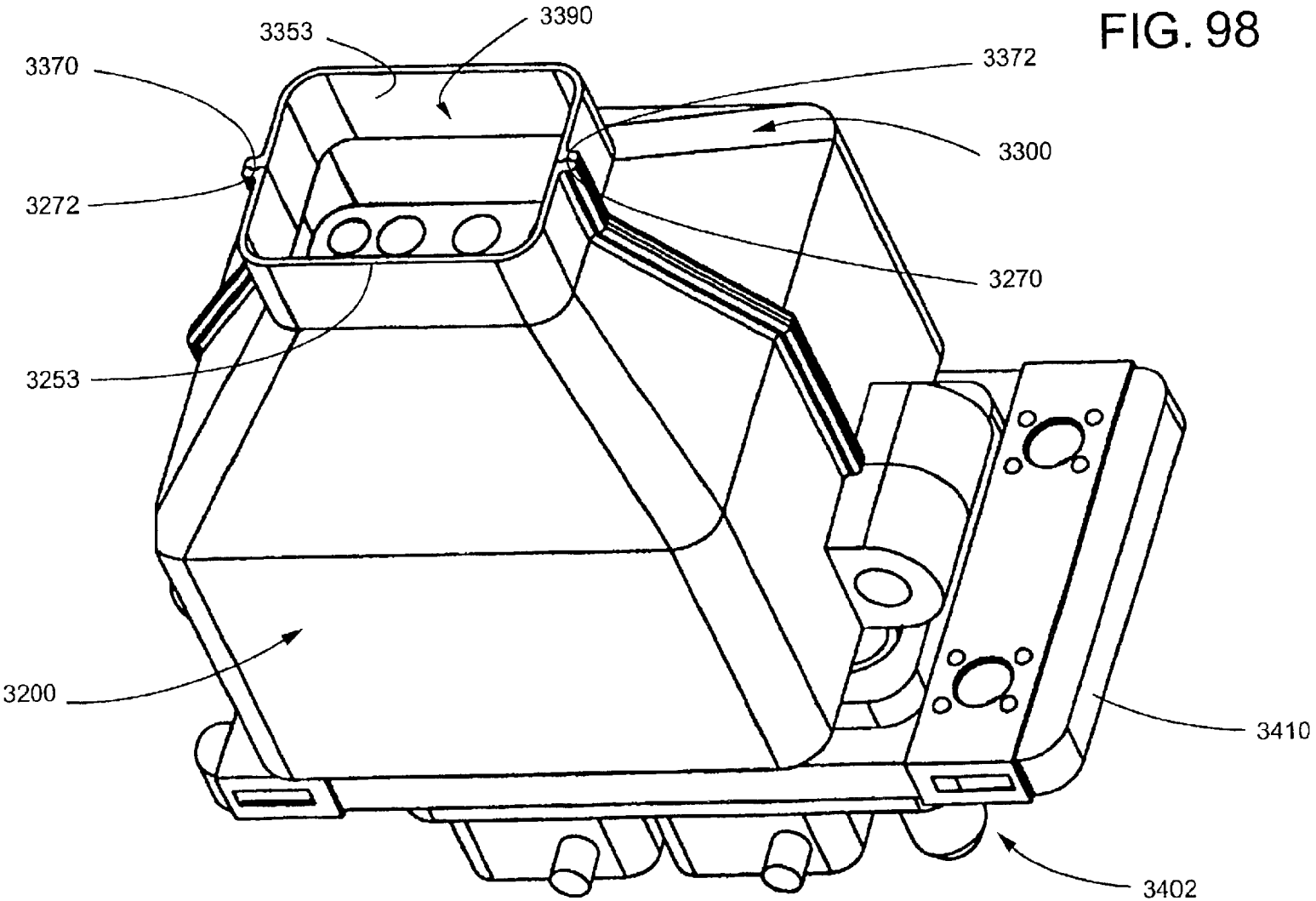
FIG. 98 is a perspective view of a pair of backshells mounted to a receptacle assembly.

Referring to FIGS. 97 and 98, a shrouded shield termination backshell 3200 is shown. The shrouded shield termination backshell includes "zero-length termination" to wire shields as well as full electromagnetic interference (EMI) shielding. "Zero-length termination" means that the backshell can a termination of the shield wire to ground with no separation from the contact wire outside of the backshell.

Referring to FIG. 97, the shrouded shield termination backshell 3200 includes a base 3201, an insert 3205, and a grounding spring 3107. The base 3201 includes a shroud portion 3250 that defines an enclosure portion 3251. The shroud portion 3250 includes a generally-rectangular aperture 3253. The base 3201 includes a rib 3270 and a groove 3272 for sealingly mating to a second shrouded shield termination backshell 3300 as shown in FIG. 98. The shrouded shield termination backshell 3200 is similar to the shield termination backshell 3100 shown in FIGS. 89–96 in other respects.

Referring to FIG. 98, the first shrouded shield termination backshell 3200 is mounted to a receptacle housing 3410 of a receptacle assembly 3402. The second shrouded shield termination backshell 3300 is mounted to the receptacle housing 3410. The rib 3270 of the first shrouded shield termination backshell 3200 is inserted in the groove 3372 of the second shrouded shield termination backshell 3300. The rib 3370 of the second shrouded shield termination backshell 3300 is inserted in the groove 3272 of the first shrouded shield termination backshell 3200. The apertures 3253, 3353 of the backshells 3200, 3300 define a generally-rectangular opening 3390.

Figure 104:
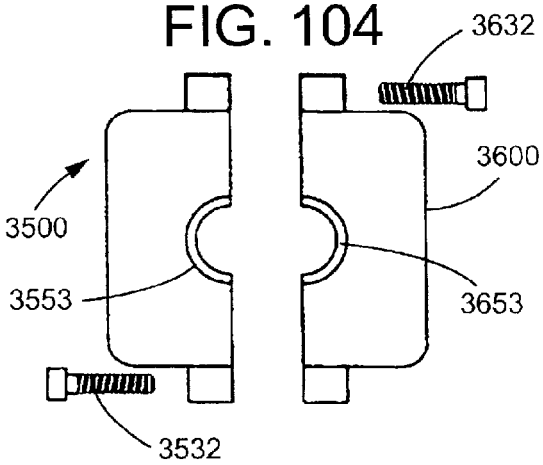
FIG. 104 is a top plan view of a pair of backshells for mounting to a housing.

Referring to FIGS. 99–101, a shrouded shield termination backshell 3500 is shown. The shrouded shield termination backshell 3500 includes a base 3501 having a shroud portion 3550 with a generally semi-circular aperture 3553. When mated to a second similar shrouded shield termination backshell 3600, the apertures 3553, 3653 of the backshells 3500, 3600 define a generally-circular opening, as shown in FIG. 104. The shrouded shield termination backshell 3500 is similar to the shrouded shield termination backshell 3200 shown in FIGS. 97 and 98 in other respects.

Figure 102:
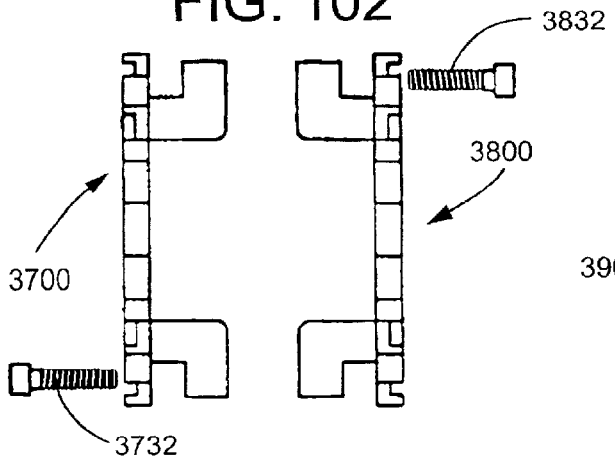
FIG. 102 is a top plan view of a pair of backshells for mounting to a housing.
Figure 103:
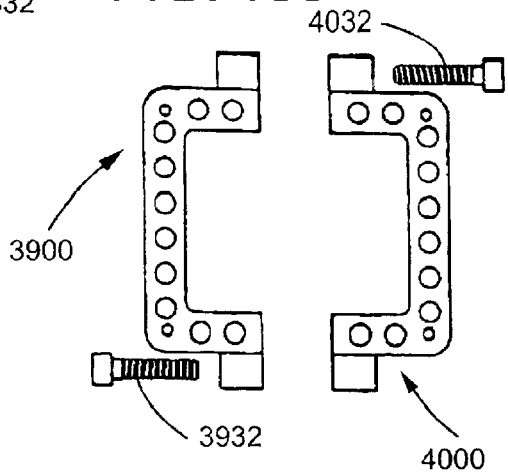
FIG. 103 is a top plan view of a pair of backshells for mounting to a housing.

Referring to FIGS. 102–107, various combinations of backshells are shown. Any backshell can be combined with any other backshell. Referring to FIG. 102, a pair of strain relief backshells 3700, 3800 can be connected together by a pair of bolts 3732, 3832. Referring to FIG. 103, a pair of shield termination backshells 3900, 4000 can be connected together by a pair of bolts 3932, 4032. Referring to FIG. 104, a pair of shrouded shield termination backshells 3500, 3600 can be connected together by a pair of bolts 3532, 3632.

Figure 105:
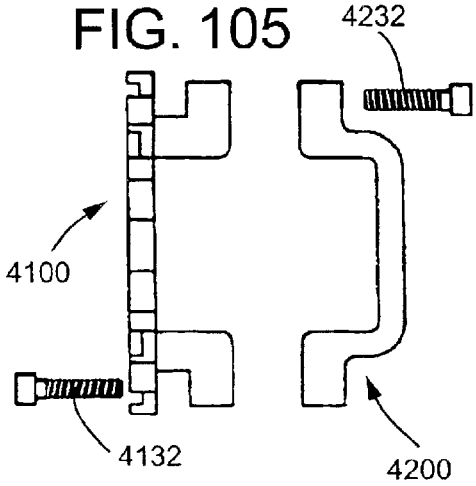
FIG. 105 is a top plan view of a pair of backshells for mounting to a housing.
Figure 106:
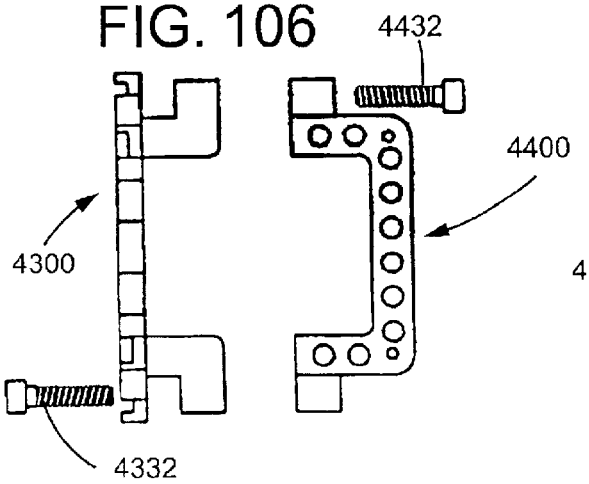
FIG. 106 is a top plan view of a pair of backshells for mounting to a housing.
Figure 107:
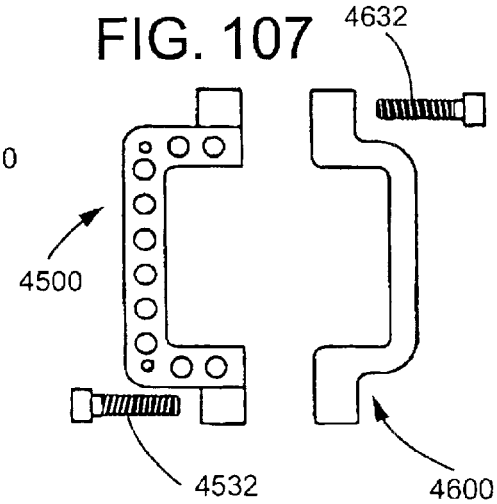
FIG. 107 is a top plan view of a pair of backshells for mounting to a housing.

Referring to FIG. 105, a strain relief backshell 4100 and a clamp backshell 4200 can be connected together by a pair of bolts 4132, 4232. Referring to FIG. 106, a strain relief backshell 4300 and a shield termination backshell 4400 can be connected together by a pair of bolts 4332, 4432. Referring to FIG. 107, a shield termination backshell 4500 and a clamp backshell 4600 can be connected together by a pair of bolts 4532, 4632.

Figure 108:
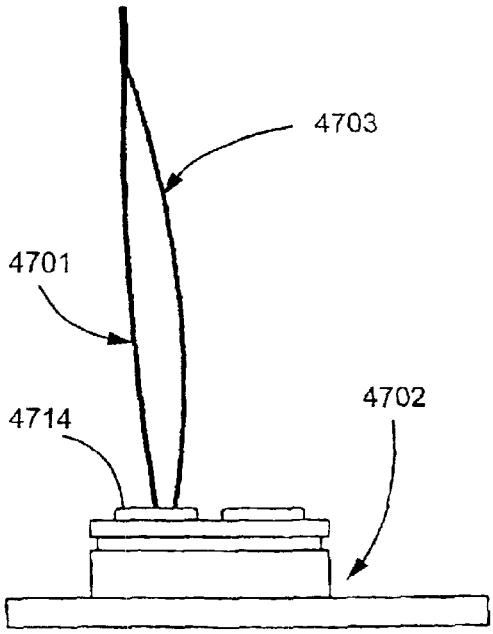
FIG. 108 is a side elevational view of a receptacle housing, a wire, and a wire shield.
Figure 109:
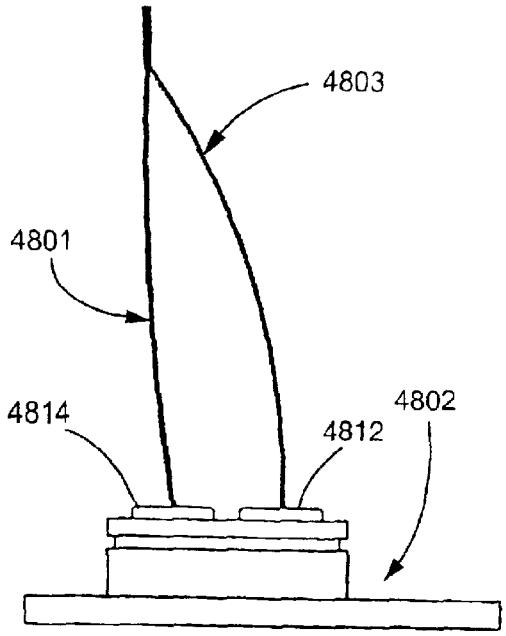
FIG. 109 is a side elevational view of a receptacle housing, a wire, and a wire shield.
Figure 110:
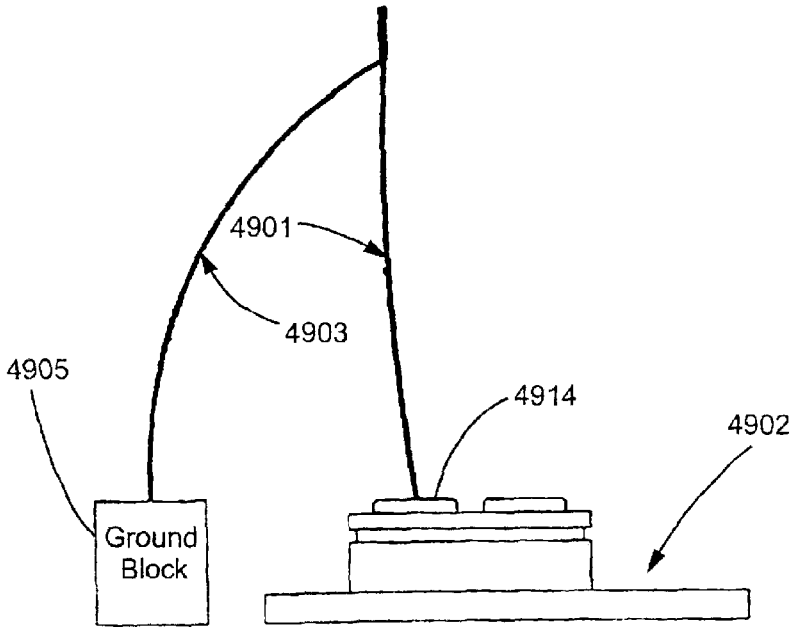
FIG. 110 is a side elevational view of a receptacle housing, a wire, a wire shield, and a ground block.

Referring to FIGS. 108–110, various configurations for electrically grounding a wire shield are shown. In other embodiments, a wire shield can be electrically grounded to a pin contact installed in a shield termination backshell and/or a shrouded shield termination backshell. Referring to FIG. 108, a wire 4701 and a wire shield 4703 are shown. The wire 4701 is electrically connected to a contact installed in a second insert 4714 of a receptacle assembly 4702. The wire shield 4703 is electrically connected to another contact installed in an adjacent contact chamber of the second insert 4712.

Referring to FIG. 109, a wire 4801 and a wire shield 4803 are shown. The wire 4801 is electrically connected to a contact installed in a second insert 4814 of a receptacle assembly 4802. The wire shield 4803 is electrically connected to a contact installed in a first insert 4812. In another embodiment, the wire shield is electrically connected to a contact installed in a first bussed insert.

Referring to FIG. 110, a wire 4901 and a wire shield 4903 are shown. The wire 4901 is electrically connected to a contact installed in a second insert 4914 of a receptacle assembly 4902. The wire shield 4903 is electrically connected to an adjacent grounding block 4905. In another embodiment, the wire shield is electrically connected to a contact installed in a bussed insert mounted in an adjacent track.

The electrical connector system offers cost savings by providing a simplified yet comprehensive connector system. The modular design of the components of the connector system allows for a very large number of possible unique connector assemblies through iterative combinations of a relatively small number of components. The connector system can realize a cost saving to users based on standardization of components and piece part number reduction.

The modular configuration of each component of the connector system facilitates the assembly of the components into a particular connector assembly and the installation of any particular assembly. For example, any insert can fit into any housing. Any backshell can fit onto any housing. Any housing will accept any contact size and/or type. The modular configuration assists the assembler to rapidly produce an accurate and repeatable assembly. The connector system does not require any special tools for assembly. Each housing can be mounted and mated in a variety of ways.

The connector system facilitates repairs, changes, and/or upgrades occurring in the field. The modular components of the connector system can be easily removed and replaced so that an individual component can be removed from an assembly and replaced with a replacement component with a minimum of hand tools. Inserts can be color coded to match the respective contact insertion and removal tools and seal plugs, and may match the bar color code of the respective contacts. Service can occur on an assembly even while the assembly is installed, such as in an aircraft. For example, a housing can be changed without rewiring the associated insert. In another example, a backshell can be changed while the rest of the connector assembly is still mounted and/or mated. As another example, additional contacts can be installed in an insert without disturbing existing shield terminations. Polarization keying can be changed, and the change can be identified, without the user re-marking the housing.

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. In addition, all references and copending applications cited herein are hereby incorporated by reference in their entireties.

What is claimed is:

1. A polarizing key comprising:

a base, the base including a resiliently flexible tapered collar;

an indicia portion, the indicia portion being in spaced relation to the tapered collar, the indicia portion including a plurality of faces, each face having an indicium; and a polarizing portion, the polarizing portion disposed asymmetrically to the indicia portion such that rotating the polarizing key about a longitudinal axis of the polarizing key changes the orientation of the polarizing portion.

2. The polarizing key according to claim 1 wherein the polarizing portion is a shaft to provide a male configuration.

3. The polarizing key according to claim 1 wherein the polarizing portion is a cavity to provide a female configuration.

4. The polarizing key according to claim 1 wherein the polarizing portion is a shaft.

5. The polarizing key according to claim 1 wherein the polarizing portion includes a perimeter.

6. The polarizing key according to claim 5 wherein the perimeter is generally semi-circular.

7. The polarizing key according to claim 5 wherein the perimeter is generally pear-shaped.

* * * * *

UNITED STATES PATENT AND TRADEMARK OFFICE

CERTIFICATE OF CORRECTION

PATENT NO. : 6,814,625 B2
APPLICATION NO. : 09/829665
DATED : November 9, 2004
INVENTOR(S) : Richmond et al.

It is certified that error appears in the above-identified patent and that said Letters Patent is hereby corrected as shown below:

Title Page
Page 2 of References Cited, column 2, line 4: "Ms27534-22D" should read --MS27534-22D-- and "M8 1969" should read --M81969--.

Signed and Sealed this

Seventeenth Day of June, 2008

JON W. DUDAS
*Director of the United States Patent and Trademark Office*